US010501988B2

(12) United States Patent
Fisher

(10) Patent No.: US 10,501,988 B2
(45) Date of Patent: Dec. 10, 2019

(54) POWER ASSIST MODULE FOR COVERINGS FOR ARCHITECTURAL STRUCTURES

(71) Applicant: Hunter Douglas, Inc., Pearl River, NY (US)

(72) Inventor: Robert E. Fisher, Thornton, CO (US)

(73) Assignee: Hunter Douglas Inc., Pearl River, NY (US)

( * ) Notice: Subject to any disclaimer, the term of this patent is extended or adjusted under 35 U.S.C. 154(b) by 291 days.

(21) Appl. No.: 15/422,573

(22) Filed: Feb. 2, 2017

(65) Prior Publication Data

US 2018/0216404 A1 Aug. 2, 2018

(51) Int. Cl.

| | |
|---|---|
| ***E06B 9/42*** | (2006.01) |
| ***E06B 9/60*** | (2006.01) |
| ***E06B 9/62*** | (2006.01) |
| ***E06B 9/68*** | (2006.01) |
| ***E06B 9/78*** | (2006.01) |
| ***E06B 9/50*** | (2006.01) |
| ***E06B 9/84*** | (2006.01) |
| ***E06B 9/90*** | (2006.01) |

(52) U.S. Cl.

CPC ..... *E06B 9/60* (2013.01); *E06B 9/42* (2013.01); *E06B 9/50* (2013.01); *E06B 9/62* (2013.01); *E06B 9/68* (2013.01); *E06B 9/78* (2013.01); *E06B 9/84* (2013.01); *E06B 9/90* (2013.01); *E06B 2009/785* (2013.01)

(58) Field of Classification Search

CPC ..... E06B 9/60; E06B 9/62; E06B 9/68; E06B 9/80; E06B 9/82; E06B 9/88; E06B 2009/583; E06B 2009/785; E06B 2009/807

USPC .... 160/315, 295, 297, 293.1, 292, 305, 309, 160/313, 318

See application file for complete search history.

(56) References Cited

U.S. PATENT DOCUMENTS

| | | | | |
|---|---|---|---|---|
| 700,951 | A | 5/1902 | Leach | |
| 873,438 | A | 12/1907 | John, Jr. | |
| 1,080,844 | A | 12/1913 | Nielsen | |
| 1,416,071 | A * | 5/1922 | Smurr | E05D 13/1238 16/198 |
| 1,725,285 | A | 8/1929 | Lalonde | |
| 1,786,512 | A | 12/1930 | Whitworth | |
| 1,885,400 | A * | 11/1932 | Karlsson | E06B 9/88 160/295 |
| 1,942,320 | A | 1/1934 | Young | |
| 2,020,595 | A * | 11/1935 | Weber | E06B 9/88 160/295 |

(Continued)

FOREIGN PATENT DOCUMENTS

| | | | |
|---|---|---|---|
| CA | 2993867 A1 * | 8/2018 | E06B 9/60 |
| EP | 0515845 A2 * | 12/1992 | E06B 3/9642 |

(Continued)

*Primary Examiner* — Johnnie A. Shablack

(74) *Attorney, Agent, or Firm* — Dority & Manning, P.A.

(57) ABSTRACT

In one aspect, a power assist module for covering for an architectural structure may include a spring and a spring shaft extending through the spring. Additionally, the power assist module may include a threaded shaft member coupled to the spring shaft and a follower member rotationally coupled to the threaded shaft member such that the follower member is moved axially along the threaded shaft member as the follower member is rotated relative to the threaded shaft member.

20 Claims, 48 Drawing Sheets

(56) References Cited

U.S. PATENT DOCUMENTS 2,540,742 A * 2/1951 Langer ..... E06B 9/60 160/317
2,969,689 A 1/1961 Martens
3,063,495 A * 11/1962 Petrick ..... G03B 21/58 160/24
4,427,050 A * 1/1984 Toppen ..... E06B 9/60 160/315
4,429,729 A * 2/1984 Winslow ..... E06B 9/60 144/193.1
4,482,137 A 11/1984 Gavagan et al.
4,523,620 A * 6/1985 Mortellite ..... E06B 9/60 160/315
4,880,045 A 11/1989 Stahler
5,078,198 A * 1/1992 Tedeschi ..... E06B 9/60 160/301
5,125,296 A 6/1992 Nelson et al.
5,437,324 A * 8/1995 Sternquist ..... E06B 9/44 160/299
5,464,052 A 11/1995 Wieczorek et al.
5,964,426 A * 10/1999 Tabellini ..... E06B 9/60 160/316
6,047,759 A 4/2000 Lysyj
6,209,610 B1 * 4/2001 Davies ..... E05D 15/0604 160/100
6,327,744 B1 * 12/2001 Dorma ..... E05D 13/1261 16/197
6,330,903 B1 12/2001 Weinreich
6,467,714 B1 10/2002 Rasmussen
6,470,951 B1 10/2002 Tao
6,615,897 B2 9/2003 Dorma
6,955,207 B2 * 10/2005 Minder ..... E06B 9/44 160/293.1
7,234,503 B2 * 6/2007 Kwak ..... E06B 9/42 160/295
7,520,311 B2 * 4/2009 Drew ..... E06B 9/322 160/171
7,617,859 B2 11/2009 Auger
8,418,741 B2 * 4/2013 Cheung ..... E06B 9/42 160/241
8,662,139 B2 * 3/2014 Anthony ..... E06B 9/34 160/121.1
8,739,854 B2 * 6/2014 Mullet ..... E06B 9/60 160/190
8,752,607 B2 * 6/2014 Anderson ..... E06B 9/262 160/84.05
9,062,494 B2 * 6/2015 Chen ..... E06B 9/60
9,080,381 B2 * 7/2015 Haarer ..... E06B 9/42
9,316,047 B2 * 4/2016 Balay ..... E06B 9/08
9,353,570 B2 * 5/2016 Smith ..... E06B 9/38
9,617,787 B2 * 4/2017 Bohlen ..... E06B 9/80
9,631,425 B2 * 4/2017 Campagna ..... E06B 9/60
9,708,851 B2 * 7/2017 Huang ..... E06B 9/324
9,714,540 B2 * 7/2017 Lorenzani ..... E06B 9/13
9,739,089 B2 * 8/2017 Smith ..... E06B 9/60
9,879,479 B2 * 1/2018 Haarer ..... E06B 9/42
10,030,439 B2 * 7/2018 Smith ..... E06B 9/38
10,098,758 B2 * 10/2018 Matthews ..... A61F 2/4425
10,138,676 B2 * 11/2018 Bohlen ..... E06B 9/62
2003/0131953 A1 * 7/2003 Coulibaly ..... B60J 1/2063 160/370.22
2005/0150615 A1 * 7/2005 Bousson ..... E06B 9/60 160/313
2006/0118248 A1 6/2006 Anderson et al.
2007/0056698 A1 * 3/2007 Lin ..... E06B 9/42 160/313
2007/0144686 A1 * 6/2007 Drew ..... E06B 9/322 160/170
2008/0099281 A1 * 5/2008 Anderson ..... E06B 9/322 185/37
2008/0173499 A1 * 7/2008 Allsopp ..... E06B 9/60 185/40 R
2008/0190572 A1 * 8/2008 Kwak ..... E06B 9/42 160/313
2010/0212843 A1 8/2010 Bohlen et al.
2011/0005694 A1 * 1/2011 Ng ..... E06B 9/44 160/311
2011/0024064 A1 * 2/2011 Ng ..... E06B 9/42 160/317
2012/0061035 A1 3/2012 Hsieh
2013/0020038 A1 * 1/2013 Barnes ..... B60J 1/2016 160/294
2013/0062024 A1 * 3/2013 Huang ..... E06B 9/50 160/127
2013/0153161 A1 * 6/2013 Haarer ..... E06B 9/42 160/293.1
2015/0275575 A1 * 10/2015 Haarer ..... E06B 9/42 160/315
2015/0284999 A1 * 10/2015 Liu ..... E06B 9/80 242/396
2015/0285000 A1 * 10/2015 Liu ..... E06B 9/80 242/396
2015/0366675 A1 * 12/2015 Matthews ..... A61F 2/4425 623/17.16
2015/0376941 A1 * 12/2015 Fujita ..... E06B 9/26 160/241
2016/0083998 A1 * 3/2016 Grutzner ..... E06B 9/44 160/238
2016/0354088 A1 * 12/2016 Cabrera ..... A61B 17/1155
2017/0107760 A1 * 4/2017 Campagna ..... E06B 9/60
2017/0175440 A1 * 6/2017 Bohlen ..... E06B 9/80
2017/0218703 A1 * 8/2017 Wei ..... E06B 9/34
2017/0234065 A1 * 8/2017 Anderson ..... E06B 9/262 160/370
2017/0281432 A1 * 10/2017 Glerum ..... A61F 2/447
2018/0023340 A1 * 1/2018 Goldberg ..... E06B 9/56
2018/0106106 A1 * 4/2018 de Vries ..... E06B 9/78
2018/0106107 A1 * 4/2018 Smith ..... E06B 9/42
2018/0155984 A1 * 6/2018 Jay ..... E06B 9/88
2018/0171703 A1 * 6/2018 Buccola, Jr. ..... E06B 9/322
2018/0171709 A1 * 6/2018 Haarer ..... E06B 9/42
2018/0179812 A1 * 6/2018 Dubina ..... E06B 9/42
2018/0179814 A1 * 6/2018 Kwak ..... E06B 9/42
2018/0216404 A1 * 8/2018 Fisher ..... E06B 9/60
2018/0283091 A1 * 10/2018 Veatch ..... E06B 9/13
2018/0328106 A1 * 11/2018 Smith ..... E06B 9/38
2018/0334854 A1 * 11/2018 Chen ..... E06B 9/80

FOREIGN PATENT DOCUMENTS

EP 1921246 A2 * 5/2008 ..... E06B 9/72
JP 2009102916 A * 5/2009
WO WO-2008141389 A1 * 11/2008 ..... E06B 9/44
WO WO-2013027533 A1 * 2/2013 ..... B60J 1/2038

* cited by examiner 12
50
48
46
44
58
42
56
78
56
108
52
110
60
104
102
106

166
214
222
220
200
202
198
204
224
216
212
208
226
210
188
180

220
188
202
180
224
216
214
222
210
226
204
208
198
212
200

166
220
222
202
188
214
210
198
200
180
204
208
224
216
212

166

POWER ASSIST MODULE FOR COVERINGS FOR ARCHITECTURAL STRUCTURES

FIELD OF THE INVENTION

The present subject matter relates generally to coverings for architectural structures and, more particularly, to a power assist module for a covering with improved wear resistance, increased durability, and enhanced performance.

BACKGROUND OF THE INVENTION

In a top down roller shade, the entire light blocking material typically wraps around a rotator rail (also referred to as a rotator tube or roller tube) as the shade is raised or retracted. Therefore, the weight of the shade is transferred to the rotator rail as the shade is raised, and the force required to raise the shade is thus progressively lower as the shade (the light blocking element) approaches the fully raised (fully open or retracted) position. Of course, there are also bottom up shades and composite shades which are able to do both, to go top down and/or bottom up. In the case of a bottom/up shade, the weight of the shade is transferred to the rotator rail as the shade is lowered, mimicking the weight operating pattern of a top/down blind.

A wide variety of drive mechanisms are known for extending and retracting coverings—moving the coverings vertically or horizontally or tilting slats. A number of these drive mechanisms may use a spring motor or power assist module to provide the catalyst force (and/or to supplement the operator supplied catalyst force) to move the coverings. For instance, various examples of power assist modules are disclosed in U.S. Pat. No. 9,080,381 (hereinafter the "'381 patent"), entitled "Power Assist Module for Roller Shades," the disclosure of which is hereby incorporated by reference herein in its entirety for all purposes. In general, the '381 patent discloses power assist modules that can be pre-wound prior to installation and that retain their pre-wound condition even when removed from the associated roller tube or rotator rail.

While the power assist modules of the '381 patent exhibit significant advantages over similar modules and related systems within the marketplace, a need still exists for further refinements and improvements to such power assist modules. For example, due to the configuration and/or material properties of several of the components of the power assist modules, such modules may be subject to wear and/or durability issues, particularly with reference to the mechanical stops utilized within the power assist modules and at the locations of the threaded engagement defined between corresponding threaded components of the power assist modules.

Accordingly, an improved power assist module for a covering for an architectural structure would be welcomed in the technology.

BRIEF DESCRIPTION OF THE INVENTION

Aspects and advantages of the present subject matter will be set forth in part in the following description, or may be obvious from the description, or may be learned through practice of the present subject matter.

In various aspects, the present subject matter is directed to a power assist module for a covering for an architectural structure. In general, the power assist module may include a spring and a spring shaft extending through the spring. Additionally, the power assist module may include a threaded shaft member coupled to the spring shaft and a follower member rotationally coupled to the threaded shaft member such that the follower member is moved axially along the threaded shaft member as the follower member is rotated relative to the threaded shaft member.

Moreover, in one embodiment, the threaded shaft member may include a mechanical stop configured to contact a corresponding mechanical stop of the follower. In such an embodiment, the threaded shaft member and the follower may both be formed from a durable type of material selected to prevent wear or damage to the stops due to the periodic contact between the stops during operation of the covering. For instance, both the threaded shaft member and the follower may be formed from a metal material such that a metal-on-metal contact interface is defined between the mechanical stops.

Further, in one embodiment, the power assist module may also include a separate threaded insert configured to be received within the follower member. In such an embodiment, the threaded insert may be configured to threadably engage the threaded shaft member to allow the follower member to be rotationally coupled to the threaded shaft member. Additionally, the threaded insert may, in one embodiment, be formed from a dissimilar type of material than the threaded shaft member, with the differing materials being selected to prevent thread wear and/or to enhance the threaded engagement provided at the threaded interface defined between the threaded insert and the threaded shaft member.

These and other features, aspects and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
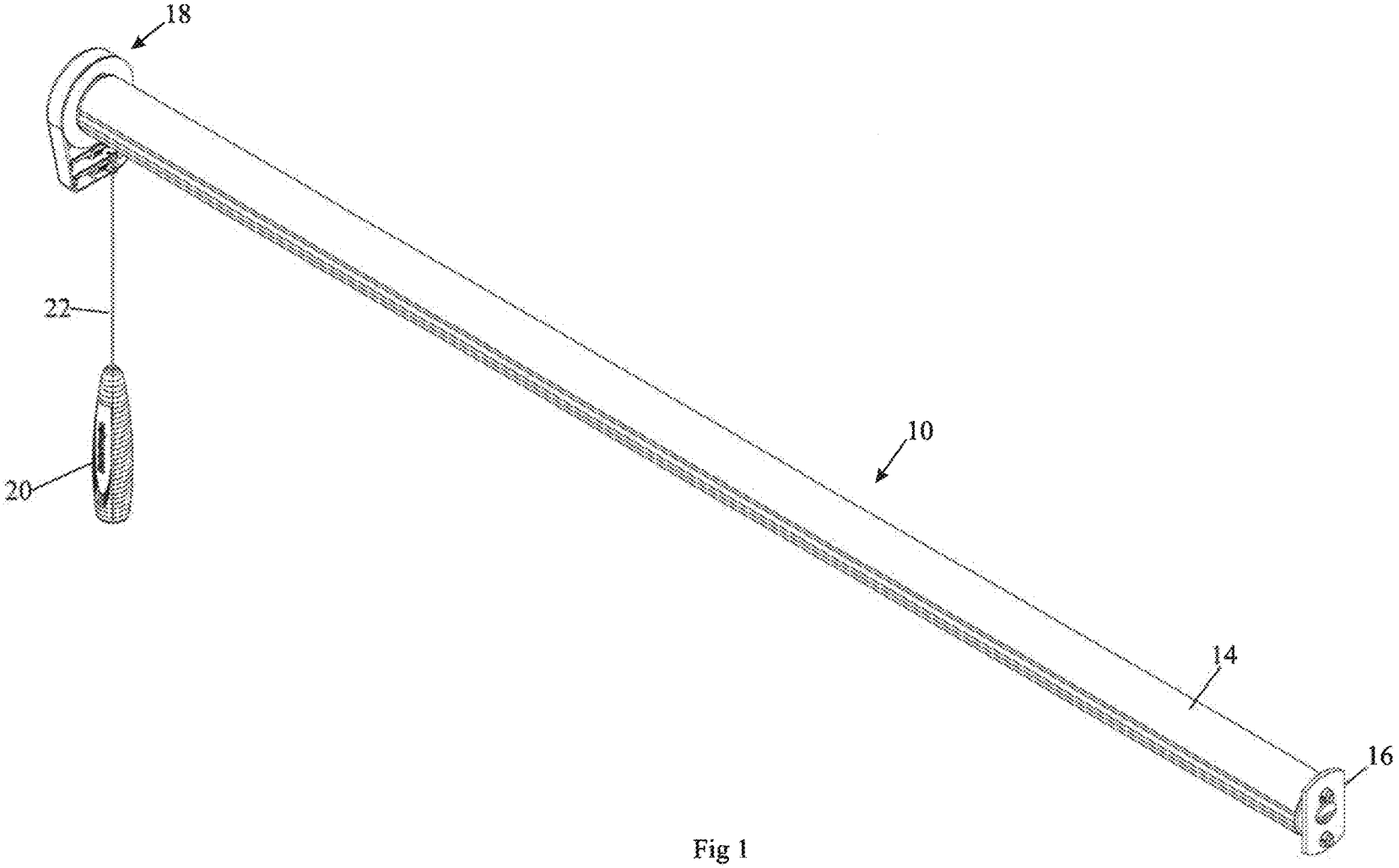
FIG. 1 illustrates a perspective view of one embodiment of a roller shade including a control mechanism for extending and retracting the shade in accordance with aspects of the present subject matter.

In general, the present subject matter is directed to a power assist module for a covering for an architectural feature or structure (referred to herein simply as architectural "structure" for the sake of convenience without intent to limit), such as a window or door. In several embodiments, the power assist module may be configured to assist the covering in moving from an extended position to a retracted position. For instance, in one embodiment, the power assist module may include a spring configured to be wound up as the covering is moved towards the extended position, thereby allowing the spring to store energy. Thereafter, the spring may be allowed to unwind or release its stored energy when it is desired to move the covering to the retracted position, thereby allowing the spring to assist in raising the covering.

In one embodiment, the power assist module may also include an elongated spring shaft configured to be received within the spring such that the spring surrounds at least a portion the spring shaft. In addition, the power assist module may also include a threaded shaft member coupled to the spring shaft and a follower member configured to be received on the threaded shaft member. In one embodiment, the follower member may be rotationally coupled to the threaded shaft member such that the follower member is moved axially along the threaded shaft member as the follower member is rotated relative to the threaded shaft member.

Additionally, in one embodiment, the threaded shaft member and the follower member may define corresponding shoulders or mechanical stops configured to contact each other when the covering is moved to the fully retracted position. For instance, the threaded shaft member may include a first stop and the follower member may include a corresponding second stop. In such an embodiment, as the covering is being raised and the follower member is moving axially along the threaded shaft member as the follower member rotates relative to the threaded shaft member, the second stop may contact or abut against the first stop once the follower member has moved axially along the threaded shaft member a given or predetermined axial distance (e.g., corresponding to when the cover reaches its fully retracted position), thereby preventing further rotation of the follower member relative to threaded shaft member.

In one embodiment, all or a portion of both of the threaded shaft member and the follower member may be formed from a durable material selected to prevent damage occurring to one or both of the mechanical stops due to the repeated contact or engagement of the stops as the covering is retracted to its fully raised position. For instance, the threaded shaft member and the follower member may both be formed from the same type of durable material. Specifically, in one embodiment, both the threaded shaft member and the follower member may be formed from a metal material such that a metal-on-metal contact interface is defined between the mechanical stops when the covering is retracted to its fully extended position. Such metal-on-metal contact may increase the durability and component life of the mechanical stops, particularly as compared to mechanical stops formed from dissimilar types of materials (e.g., a plastic-on-metal contact interface).

Moreover, in one embodiment, the power assist module may include a separate threaded insert positioned within the follower member for rotationally coupling the follower member to the threaded shaft member. Specifically, the threaded insert may be configured to threadably engage a threaded portion of the threaded shaft member such that the follower member is moved axially along the threaded shaft member as both the follower member and the threaded insert rotate relative to the threaded shaft member.

In one embodiment, all or a portion of the threaded insert may be formed from a dissimilar type of material than the threaded shaft member such that the threads of the threaded insert are formed from a first type of material and the threads of the threaded shaft member are formed from a second type of material. By selecting such dissimilar types of materials to be used at the interface between the threaded insert and the threaded shaft member, the amount of wear occurring on the threads of the threaded insert and/or the threaded shaft member may be reduced significantly, thereby increasing the component life(s) of such component(s). For instance, in one embodiment, the threaded insert may be formed from a polymer material (e.g., a lubrous plastic material) while the threaded shaft member may be formed from a metal material (e.g., steel or aluminum). In addition, the dissimilar materials may also provide for a smoother, threaded engagement between the threaded insert and the threaded shaft member, with less sticking or friction between the adjacent components.

Moreover, in one embodiment, all or a portion of the threaded insert may be formed from a dissimilar type of material than the follower member within which it is received. For instance, in a particular embodiment, the threaded insert may be formed from a polymer material while the follower member may be formed from a metal material.

Additionally, in one embodiment, the threaded insert may be configured to define a plurality of internal threads along its axial length for engaging corresponding external threads of the threaded shaft member. By including multiple internal threads, the threaded engagement between the threaded insert and the threaded shaft member may be significantly more robust as compared to embodiments using only a single or partial thread. Specifically, the various internal threads may allow any loads transferred between the threaded shaft member and the threaded insert to spread out amongst the internal threads of the insert, thereby increasing the load carrying capability of the internal threads and also preventing or minimizing thread wear. Additionally, by providing numerous internal threads for engagement with the threaded portion of the threaded shaft member, the shaft member may track better within the threaded insert, thereby preventing axial "cocking" or displacement of the threaded shaft member relative to the follower member.

Referring now to the drawings, FIGS. 1 through 15 illustrate one embodiment of a covering having power assist modules 12 in accordance with aspects of the present subject matter. Specifically, in the illustrated embodiment, the covering is configured as a roller shade 10. Note that the terms "roller shade" and "shade" are used interchangeably to mean either the entire roller shade assembly 10 or just the light blocking element of the roller shade assembly 10. The intended meaning should be clear from the context in which it is used.

Figure 2:
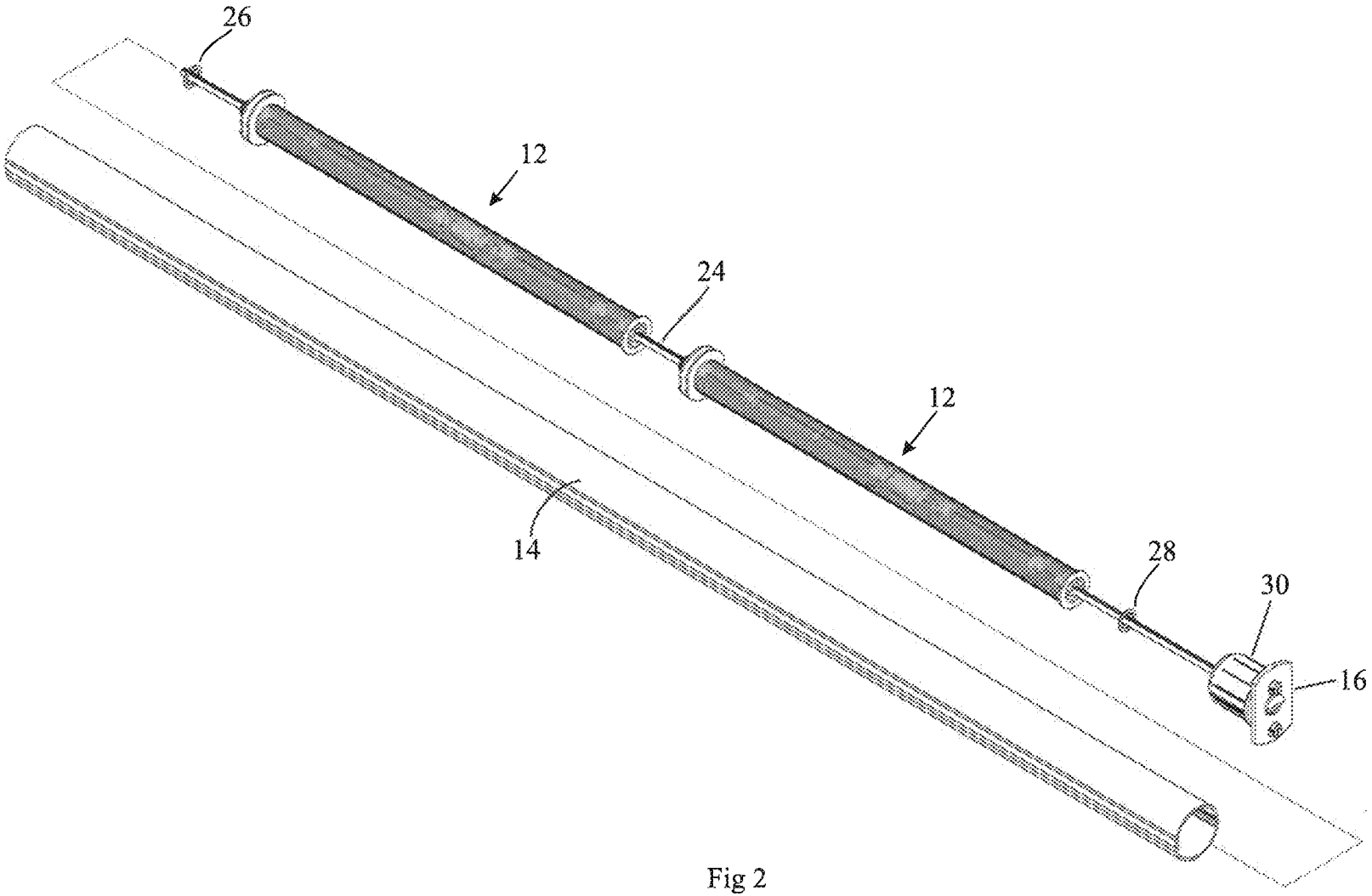
FIG. 2 illustrates a partially exploded perspective view of the roller shade of FIG. 1, with the control mechanism omitted for clarity.

As shown in FIG. 1, the roller shade 10 includes a rotator rail 14 mounted between a bracket clip 16 and a drive mechanism 18, which provide good rotational support for the rotator rail 14 at both ends. The rotator rail 14, in turn, provides support for one or more power assist modules 12 located inside the rotator rail 14, as shown in FIG. 2. The right end of the rotator rail 14 is supported on a tube bearing 30, which mounts onto the bracket clip 16 as described in more detail later. The left end of the rotator rail 14 is supported on the drive mechanism 18. The details of the drive mechanism support are shown better in FIG. 17, in which the drive mechanism 18' is identical to the drive mechanism 18 of this embodiment and includes a rotating drive spool with an external profile similar to the external profile of the tube bearing 30. Both the bracket clip 16 and the drive mechanism 18 are releasably secured to mounting brackets (not shown) which are fixedly secured to a wall or to a window frame.

The drive mechanism 18 is described in U. S. Patent Publication No. 2006/0118248 "Drive for coverings for architectural openings," filed Jan. 13, 2006, which is hereby incorporated by reference herein in its entirety for all purposes. FIGS. 116-121 of the '248 publication depict an embodiment of a roller shade 760 with a roller lock mechanism 762, and the specification gives a complete detailed description of its operation. A brief summary of the operation of this drive mechanism 18 is stated below with respect to FIG. 1 of this specification.

When the tassel weight 20 of the drive mechanism 18 is pulled down by the user, the drive cord 22 (which wraps around a capstan and onto a drive spool, not shown) is also pulled down. This causes the capstan and the drive spool to rotate about their respective axes of rotation. The rotator rail 14 is secured to the drive spool for rotation about the same axis of rotation as the drive spool. As the rotator rail 14 rotates, the shade is retracted with the assistance of the power assist modules 12, as described in more detail below.

When the user releases the tassel weight 20, the force of gravity acting to extend the shade urges the rotation of the rotator rail 14 and of the drive spool in the opposite direction from before. This pulls up on the drive cord 22, which shifts the capstan to a position where the capstan is not allowed to rotate. This locks up the roller lock mechanism so as to prevent the shade from falling (extending).

To extend the shade, the user lifts up on the tassel weight 20 which removes tension on the drive cord 22, allowing the cord 22 to surge the capstan, unlocking the roller lock mechanism. The drive spool and the rotator rail 14 are then allowed to rotate due to the force of gravity acting to extend the shade. As the shade extends, the power assist modules 12 are wound up in preparation for when they are called to assist in retracting the shade.

There may also be an "overpowered" version of this drive in which pulling down on the tassel weight 20 by the user extends the shade. As the shade extends, the power assist modules 12 are wound up in preparation for when they are called to assist in retracting the shade. When the user releases the tassel weight 20, the "overpowered" power assist modules 12 urge the shade to rotate in the opposite direction to raise the shade, which shifts the capstan to a position where the capstan is not allowed to rotate. This locks up the roller lock mechanism so as to prevent the shade from rising (retracting). To retract the shade, the user lifts up on the tassel weight 20, which removes tension on the drive cord 22, allowing the cord 22 to surge the capstan, unlocking the roller lock mechanism. The drive spool and the rotator rail 14 are then allowed to rotate due to the force of the "overpowered" power assist modules 12 acting to retract the shade.

It should be appreciated that the cord drive 18 described above is simply one example of a drive mechanism that may be used to drive the roller shade 10. Various other types of drive mechanism are known and may alternatively be used to drive the roller shade 10 in accordance with aspects of the present subject matter.

Figure 3:
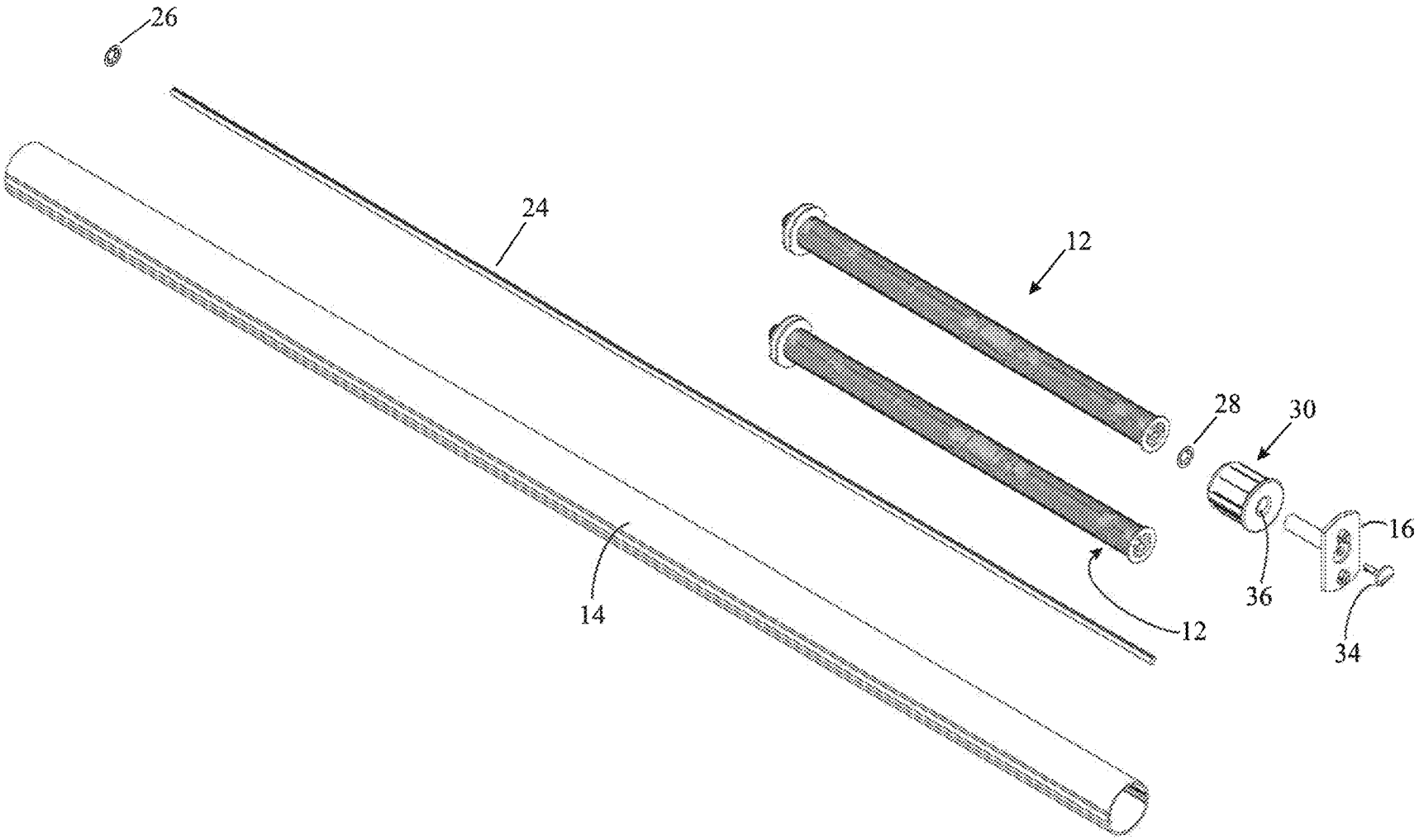
FIG. 3 illustrates a partially exploded perspective view of the roller shade of FIG. 2.

FIGS. 2 and 3 show the roller shade 10 with the drive mechanism omitted for clarity. In this embodiment, two power assist modules 12 are mounted over a rod 24. It is understood that any number of power assist modules 12 may be incorporated into a roller shade 10. It should also be understood that the power assist modules 12 may each have springs 50 (See FIG. 5) with different spring constants K, and, as explained later, each of the power assist modules 12 may be pre-wound to a desired degree independent of the other power assist modules 12 in the shade 10. The rod 24 has a non-circular cross-sectional profile (as best appreciated in FIG. 7B) in order to non-rotationally engage various other components as described below. One speed nut 26 is installed onto the rod 24 to prevent the power assist modules 12 from sliding off of the rod 24 (keeping the power assist modules 12 inside the rotator rail 14). Another speed nut 28 is installed onto the rod 24 near its other end (See also FIGS. 8, 7A, and 7C) to prevent the tube bearing 30 from sliding off of the shaft 32 of the bracket clip 16, as described in more detail below. Finally, a plunger 34 is used to secure the bracket clip 16 to a wall-mounted or window-frame-mounted bracket (not shown). The rod 24 is not threaded. The speed nuts 26, 28 have deformable tangs which deform temporarily in one direction, allowing the speed nut to be pushed axially along the rod 24 in a first direction and then to grab onto the rod 24 to resist movement in the opposite direction.

FIGS. 2 and 3 clearly show that, in this embodiment, the rod 24 is shorter than the rotator rail 14 such that the rod 24 does not extend the full length of the rotator rail 14. In this embodiment, the right end of the rod 24 extends to the bracket clip 16, where it is secured against rotation, but the left end does not extend all the way to the drive mechanism 18. If desired, the rod 24 alternatively could be secured against rotation by the drive mechanism 18 and not extend all the way to the bracket clip 16. As another alternative, the rod 24 could extend the full length of the rotator rail 14 and be secured against rotation both at the drive mechanism 18 and at the bracket clip 16. As long as one end of the rod 24 is secured against rotation, it is not necessary for the rod 24 to be supported at both ends, because it is supported by the rotator rail 14 at various points along its length, as will be explained in more detail later.

The tube bearing 30 (See FIGS. 3 and 8) is a substantially cylindrical element including a shaft portion 35 (See FIG. 8) having an internal surface which defines an inner circular cross-section through-opening 36 and provides rotational support of the tube bearing 30 on the shaft 32 of the bracket clip 16. The tube bearing 30 has a cylindrical outer surface 38, which engages and supports the inner surface 54 (See FIG. 15) of the rotator rail 14. A shoulder 40 limits how far the tube bearing 30 slides into the rotator rail 14.

Figure 8:
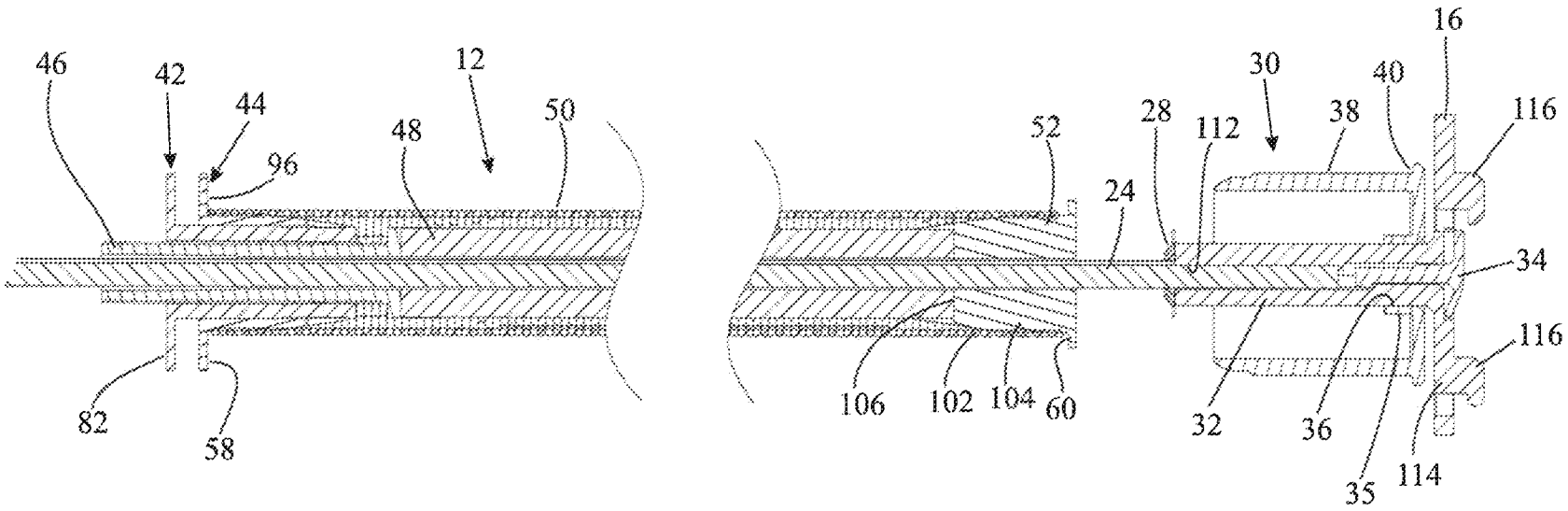
FIG. 8 illustrates an enlarged view of the right end portion of FIG. 7A.

Referring to FIG. 8, the substantially cylindrical shaft member 32 of the bracket clip 16 defines a non-circular cross-sectional profiled inner bore 112 which receives and engages the rod 24 to support the right end of the rod 24 and prevent it from rotating. A radially-extending flange 114 on the bracket clip 16 defines hooked projections 116 to mount the bracket clip 16 to a wall-mounted or a window-frame-mounted bracket (not shown). Since the bracket clip 16 is stationary relative to the wall or window frame, and since it receives and engages the rod 24 with a non-circular profile, it prevents rotation of the rod 24 relative to the wall or window frame. As mentioned above, the shaft 32 on the bracket clip 16 provides rotational support for the tube bearing 30.

Figures 4, 5:
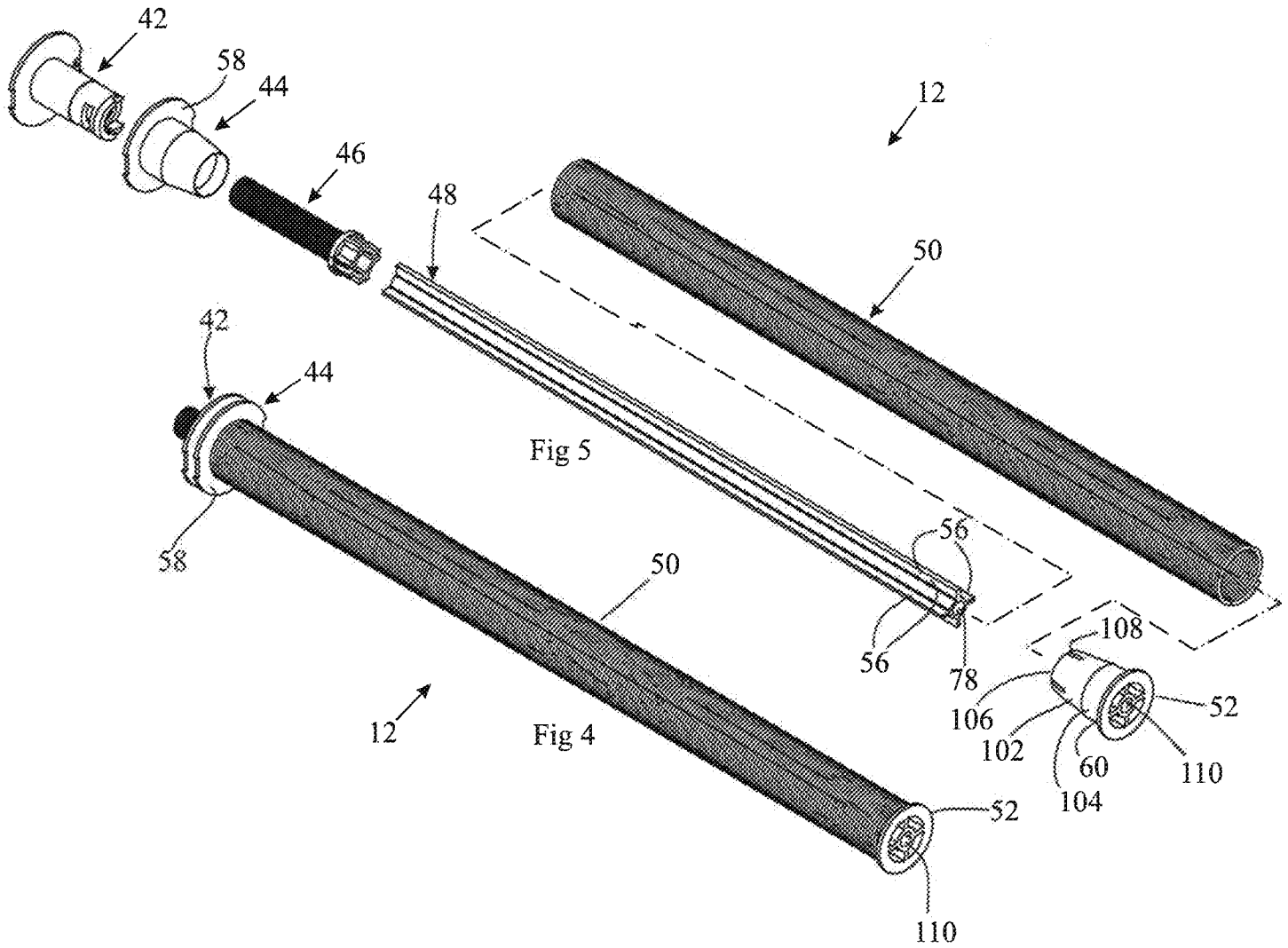
FIG. 4 illustrates a perspective view of one of the power assist modules of FIG. 3.
FIG. 5 illustrates an exploded perspective view of the power assist module of FIG. 4.
Figure 6:
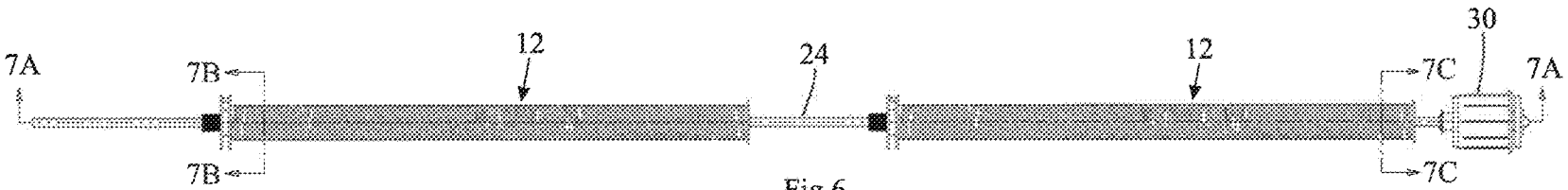
FIG. 6 illustrates a side view of the roller shade of FIG. 1, with the rotator rail and the control mechanism omitted for clarity.

Referring now to FIGS. 4, 5, and 8, the power assist module 12 includes a drive plug shaft 42 (which may also be referred to as a threaded follower member 42), a drive plug 44, a limiter 46 (which may also be referred to as a threaded shaft member 46), a spring shaft 48, a spring 50, and a spring plug 52. These components are described in detail below.

Figure 10:
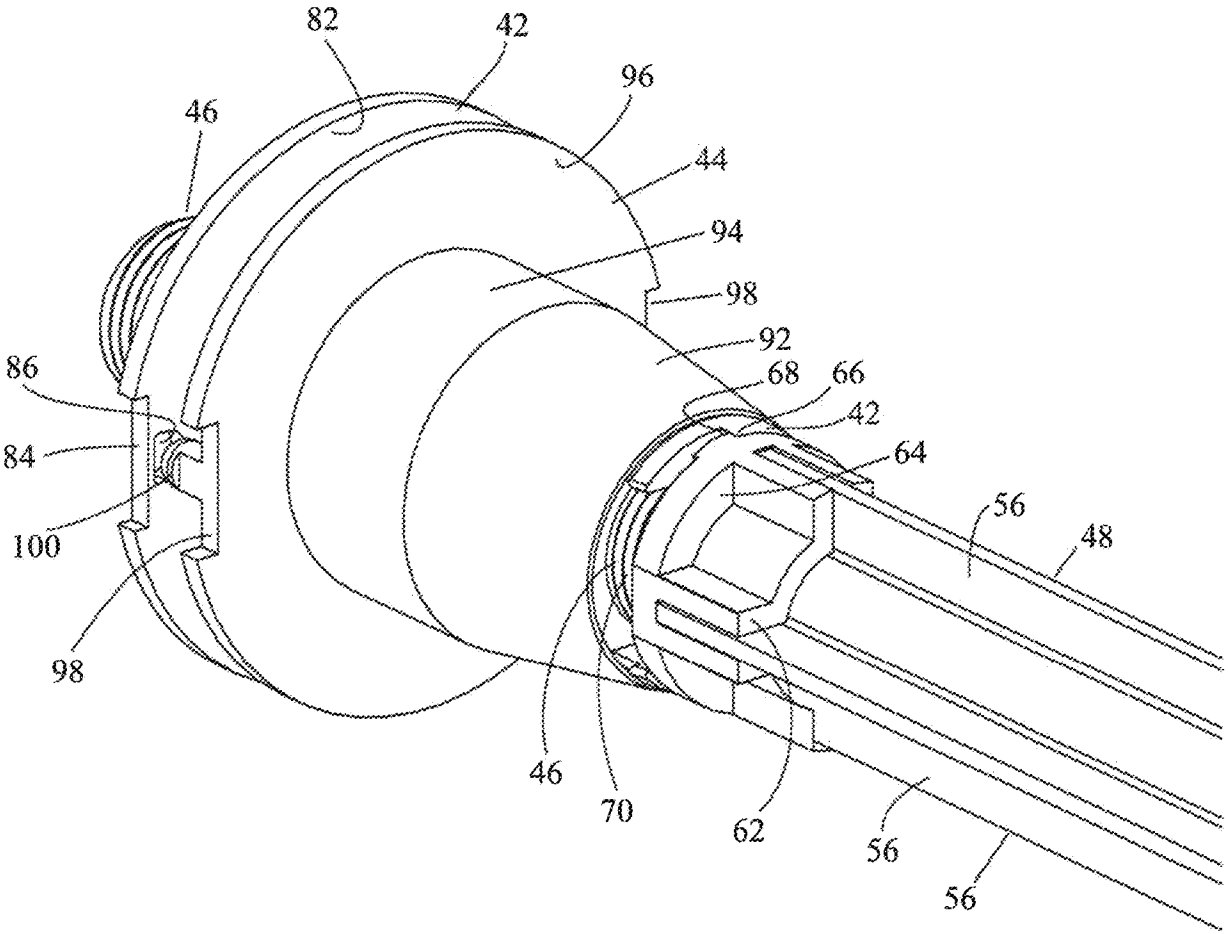
FIG. 10 illustrates is a partially broken away, perspective view of a preliminary assembly step of the drive plug shaft, the drive plug, and the limiter of FIG. 9, also including the spring shaft.

Referring to FIGS. 5 and 10, the spring shaft 48 is a substantially cylindrical, hollow member defining first and second ends and having a plurality of ribs 56 (in this embodiment of the shaft 48 there are four ribs 56 projecting radially outwardly at the 12 o'clock, 3 o'clock, 6 o'clock, and 9 o'clock positions, spaced apart at ninety degree intervals) and extending axially from the first end to the second end. The length of the spring shaft 48 is such that, when assembled onto a power assist module 12 (See FIG. 8), the distance between the radial flange 58 on the drive plug 44 and the radial flange 60 on the spring plug 52 is slightly longer than the axial length of the spring 50 when the spring 50 is in its relaxed (unwound) state to allow for spring growth as it is prewound.

The ribs 56 not only serve to engage similarly cross-shaped grooves on the limiter 46 and on the spring plug 52, as described in more detail below; they also provide contact points for the inside surface of the spring 50 to contact the shaft 48. As the spring 50 is wound up tighter, its inner diameter is reduced and its axial length increases. This may cause some portion(s) of the inner surface of the spring 50 to collapse onto the shaft 48. The ribs 56 provide an outside perimeter which is sufficient to maintain the spring coaxial with the shaft 48. This prevents the spring 50 from becoming skewed and interfering with the inner surface of the rotator rail 14. The ribs 56 also provide a limited number of contact points between the shaft 48 and the inner surface of the spring 50 in order to minimize the frictional resistance between the spring 50 and the shaft 48.

As described below, the ribs 56 on the spring shaft 48 form a cross-shaped pattern designed to fit into and engage similarly cross-shaped grooves on the limiter 46 and on the spring plug 52. As best appreciated in FIG. 5, the spring shaft 48 defines a circular cross-sectional profiled inner bore 78 which both slidably and rotatably receives the rod 24. It should be noted that the spring shaft 48 need not be supported for rotation relative to the rod 24. The spring shaft 48 could have an internal cross-sectional profile similar to that of the limiter 46 described below to prevent any rotation between the spring shaft 48 and the rod 24, but this constraint is not necessary. The spring plug 52 has a non-circular cross-section internal opening 110, which receives the rod 24 and matches the non-circular cross-section of the rod 24 in order to key the spring plug 52 to the rod 24 so the spring plug 52 does not rotate.

Figure 9:
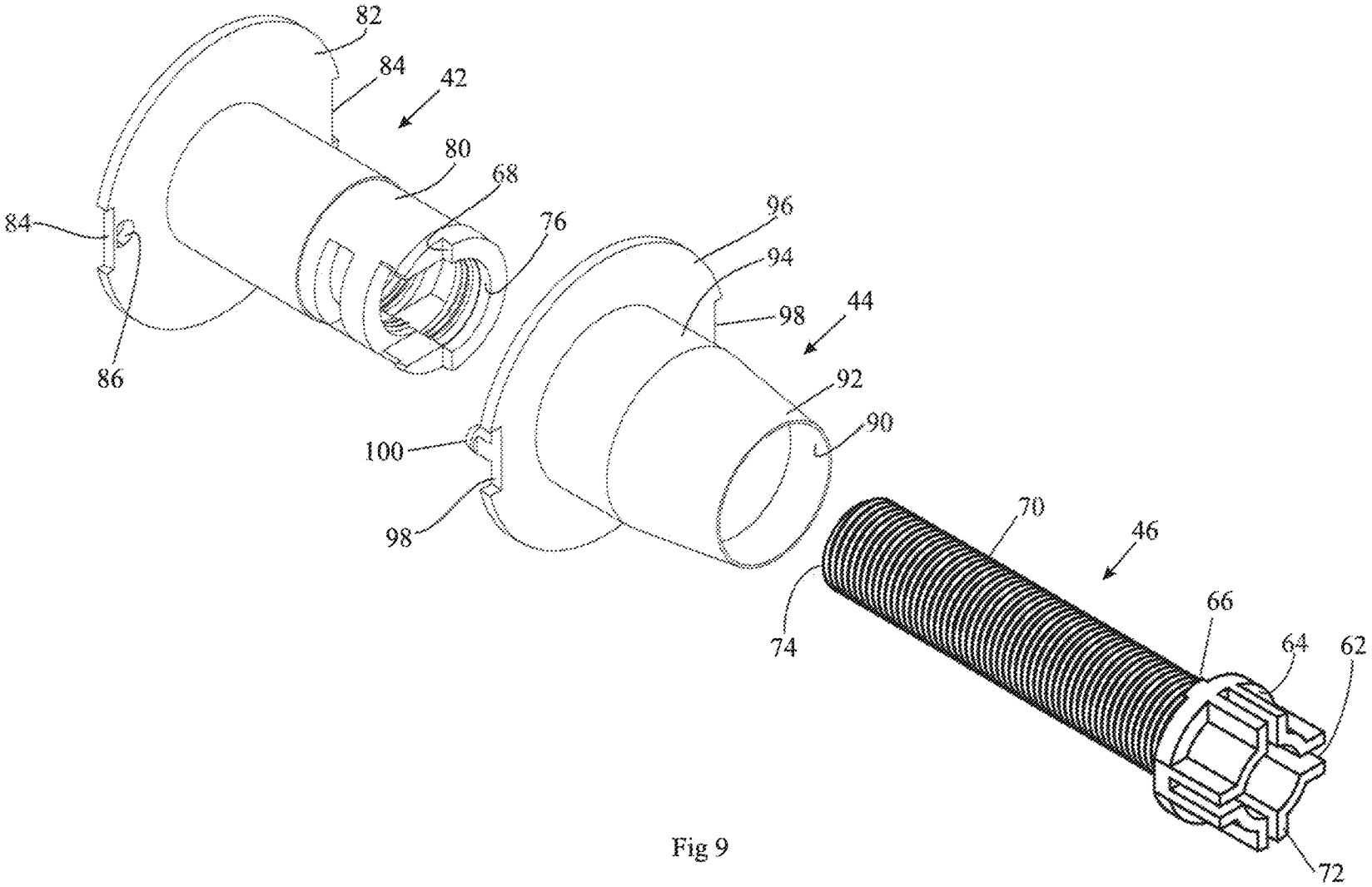
FIG. 9 illustrates an exploded perspective view of the drive plug shaft, the drive plug, and the limiter of the power assist module of FIG. 5.

Referring now to FIG. 9, the limiter 46 (also referred to as the threaded shaft member 46) is a substantially cylindrical, hollow member. In one embodiment, the limiter 46 may define a cross-shaped groove 62 at a first end 72. This groove 62 receives the ribs 56 of the spring shaft 48 (See FIG. 10) such that these two components are locked together from rotation relative to each other, at least long enough to allow a pre-wind to be added to the spring 50 without having to mount the power assist module 12 to a rod 24, as explained in more detail later.

In one embodiment, a radially-extending shoulder 64 on the limiter 46 may limit how far the spring shaft 48 can be inserted into the limiter 46. Additionally, the other side of the shoulder 64 may define a stop projection 66 extending axially from the shoulder 64. As described in more detail later, and depicted in FIG. 10, the stop 66 impacts against a similar axially-extending stop projection 68 on the drive plug shaft 42 to limit the extent to which the drive plug shaft 42 can be threaded into the limiter 46 (and thus how far the drive plug shaft 42 can be rotated relative to the rod 24 to which the limiter 46 is keyed, as explained below).

Figure 7A:
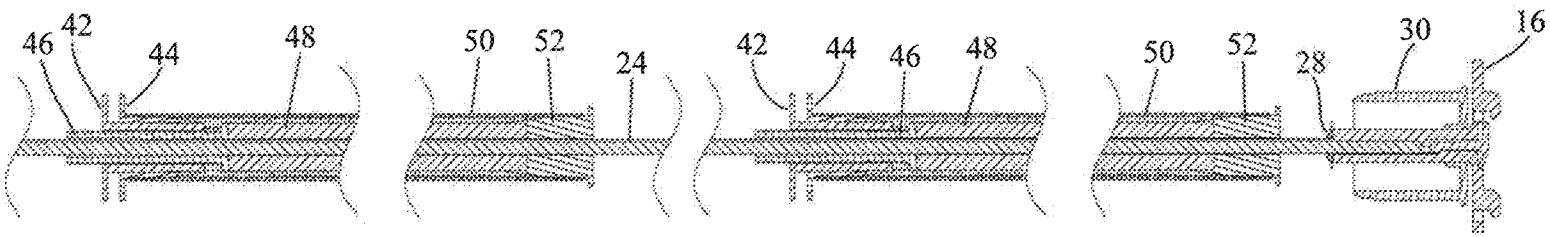
FIG. 7A illustrates a view along line 7A-7A of FIG. 6.
Figure 7C:
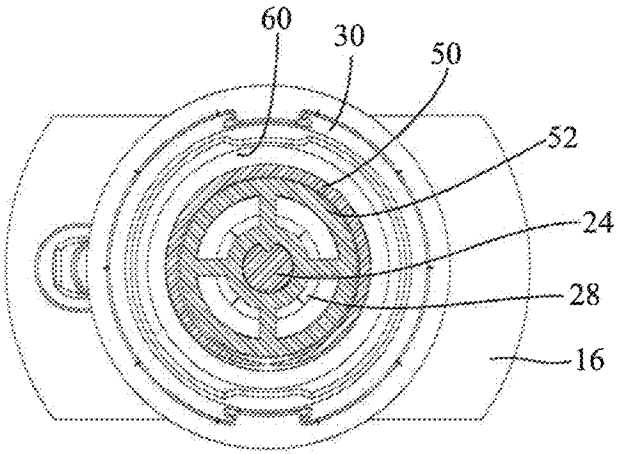
FIG. 7C illustrates a view along line 7C-7C of FIG. 6.
Figure 7B:
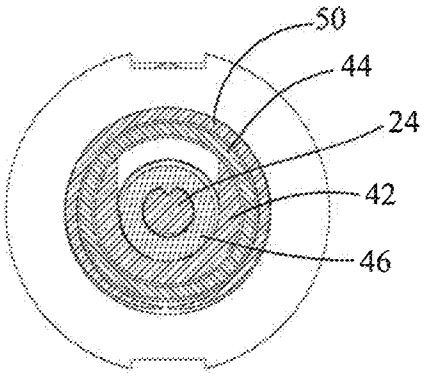
FIG. 7B illustrates a view along line 7B-7B of FIG. 6.

Referring to FIG. 7B, the limiter 46 has a non-circular internal cross-sectional profile which matches the non-circular cross-sectional profile of the rod 24. This allows the limiter 46 to slide axially along the rod 24 while preventing the limiter 46 from rotating relative to the rod 24. As explained earlier, the rod 24 is secured against rotation relative to the bracket clip 16 by a similar mechanism, and the bracket clip 16 is, in turn, secured to the brackets (not shown) mounted to the wall or to the window frame. Therefore, the rod 24 cannot rotate relative to the wall or to the window frame, and any components that are also secured against rotation relative to the rod 24, such as the spring plug 52 and the limiter 46, similarly do not rotate relative to the wall or to the window frame.

Finally, the limiter 46 defines an externally threaded portion 70 (See FIG. 9) extending from the shoulder 64 to the second end 74 of the limiter 46. This threaded portion 70 may, in one embodiment, be threaded into an internally threaded portion 76 of the drive plug shaft 42 until the stop projection 66 on the limiter 46 impacts against the stop projection 68 on the drive plug shaft 42, as shown in FIG. 10, corresponding to the position where the shade is in the fully retracted position, as discussed in more detail later.

It should be noted that, as the shade 10 is extended, the spring 50 becomes coiled tighter, resulting in a gradual collapse of the diameter of its coils and consequent increase in the overall length of the spring 50. In a preferred embodiment, the threaded portion 70 of the limiter 46 has a thread pitch such that the drive plug shaft 42 unthreads from the limiter 46 at a rate (controlled by the thread pitch) which is equal to the rate at which the spring 50 "grows" in length as it is coiled tighter as the shade 10 is extended.

Referring back FIG. 9, the drive plug shaft 42 is a substantially cylindrical, hollow member defining an internally threaded portion 76 and a smooth, cylindrical external portion 80 which is used for rotational support of the drive plug 44 as explained later. One end of the drive plug shaft 42 has a radially extending flange 82 which defines two diametrically opposed flat recesses 84 and a through opening 86 adjacent to one of the flats, the purpose of which is explained later. In the illustrated embodiment, the internally threaded portion 76 is formed integrally with the drive plug shaft 42. However, in other embodiments, the internal threads may be defined by a separate, threaded insert positioned within the drive plug shaft 42. For instance, as will be described below with reference to FIGS. 67-69, a nut or other suitable threaded member may be installed within the drive plug shaft 42 to allow the threaded member to threadably engage the threaded portion 70 of the limiter 46.

The flange 82 of the drive plug shaft 42 is sized to be received inside the rotator rail 14 (See FIG. 15), and the flat recesses 84 receive, and are engaged by, the inwardly-projecting and axially extending ribs 88 on the inner surface 54 of the rotator rail 14. Therefore, as the rotator rail 14 rotates, it causes the drive plug shaft 42 to rotate. When the rotator rail 14 rotates so as to extend the roller shade 10, the drive plug shaft 42 rotates relative to the limiter 46, partially unscrewing itself relative to the non-rotating limiter 46 and causing the drive plug shaft 42 to move axially away from (but not to be fully unthreaded from) the limiter 46. As indicated above, the limiter 46 does not rotate because it is keyed to the rod 24 (which is secured to the wall or window frame via the bracket clip 16).

Likewise, as the roller shade 10 is retracted, the drive plug shaft 42 threads onto the limiter 46. This continues until the stop 68 on the drive plug shaft 42 impacts against the stop 66 on the limiter 46, at which point the drive plug shaft 42, and therefore also the rotator rail 14 (which is keyed to the drive plug shaft 42 via the flat recesses 84) are stopped against further rotation. As explained later, the spring 50 will still have some unwinding left in it when the rotator rail is stopped, and this is the degree of"pre wind" which may be added to the power assist module 12 to ensure that the shade is fully retracted.

It should be appreciated that, given the periodic contact between the stop projections 66, 68 as the roller shade 10 is retracted, the drive plug shaft 42 and the limiter 46 (or at least the portions of such components forming the stop projections 66, 68) may be formed from a durable type of material(s) having suitable material properties so as to prevent damage to one or both of the stop projections 66, 68 as the stop projections 66, 68 contact each other. For instance, in one embodiment, both the drive plug shaft 42 and the limiter 46 (or at least the portions of such components forming the stop projections 66, 68) may be formed from a metal material (e.g., aluminum, steel, or any other suitable metal) such that metal-on-metal contact is provided at the interface between the stop projections 66, 68 when the roller shade is retracted. As a result, the component life of the drive plug shaft 42 and/or the limiter 46 may be significantly improved as compared to the use of a less durable material(s) for one or both of the stop projections 66, 68 (e.g., when a plastic-on-metal contact interface is provided between the stop projections 66, 68).

Referring now to FIGS. 9 and 7B, the drive plug 44 is a substantially cylindrical, hollow member defining a circular cross-sectional profiled inner bore 90 which is supported for rotation on the circular cross-section portion 80 of the drive plug shaft 42. The external surface of the drive plug 44 defines a first, frustoconical portion 92 and a second, cylindrical portion 94, as well as a radially extending flange 96 which is very similar to the flange 82 on the drive plug shaft 42, including having diametrically opposed flat recesses 98. The flange 96 also defines an axially-directed projection 100 adjacent to one of the flat recesses 98. The projection 100 is received in the through opening 86 on the flange 82 of the drive plug shaft 42, such that, when the drive plug shaft 42 rotates, the drive plug 44 rotates with it. Since the flat recesses 98 on the drive plug 44 are aligned with the flat recesses 84 on the drive plug shaft 42 when the projection 100 is received in the opening 86, the ribs 88 on the rotator rail 14 are received in and engage both sets of flat recesses 84, 98. Thus, the drive plug shaft 42 and the drive plug 44 both rotate with the rotator rail 14 as the roller shade 10 is extended and retracted. The force required to transfer the rotational torque from the drive plug 44 to the drive plug shaft 42, especially when the spring 50 is fully wound, is not borne exclusively by the projection 100 on the drive plug 44, but rather it is shared with, and in fact is borne substantially by, the aligned flat recesses 98, 84 of the drive plug 44 and drive plug shaft 42, respectively.

Referring now to FIGS. 4 and 8, the spring plug 52 is similar to the drive plug 44, having a first, frustoconical portion 102 and a second, cylindrical portion 104, and a shoulder 60 which limits how far the spring plug 52 fits into the spring 50. The first end 106 of the spring plug 52 defines a cross-shaped groove 108, similar to the cross-shaped groove 62 on the limiter 46. The cross-shaped groove 108 of the spring plug 52 receives the cross-shaped ribs 56 of the spring shaft 48. The spring plug 52 defines an inner bore 110 (See FIGS. 4 and 5) with a non-circular cross-sectional profile that matches the non-circular cross-sectional profile of the rod 24 and keys the spring plug 52 to the rod 24. Since the rod 24 is secured to the bracket clip 16 against rotation relative to a wall or window frame, and since the spring plug 52 is keyed to the rod 24, the spring plug 52 is also secured against rotation relative to the wall or window frame, but it may slide axially along the rod 24 if required.

Figure 11:
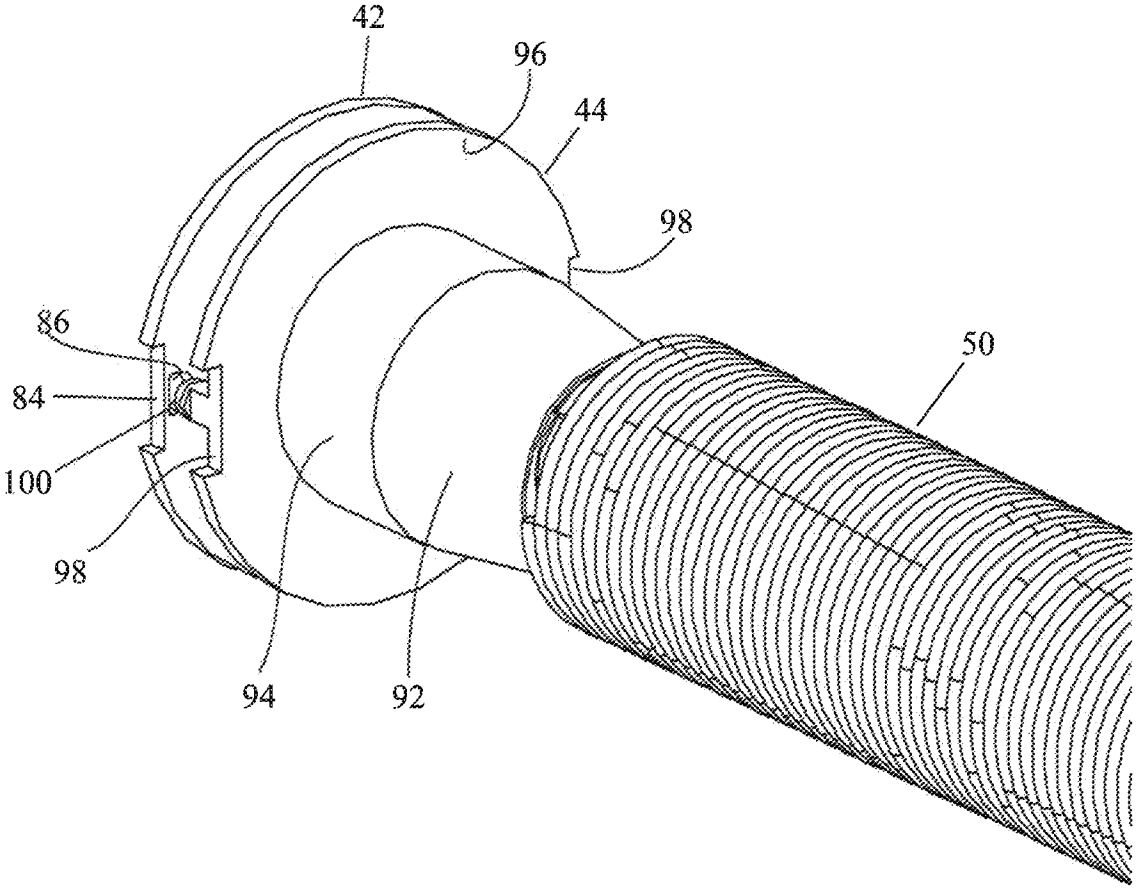
FIGS. 11, 12, and 13 illustrates partially broken away, perspective views of progressive assembly steps of the spring to the drive plug of FIG. 10.
Figure 12:
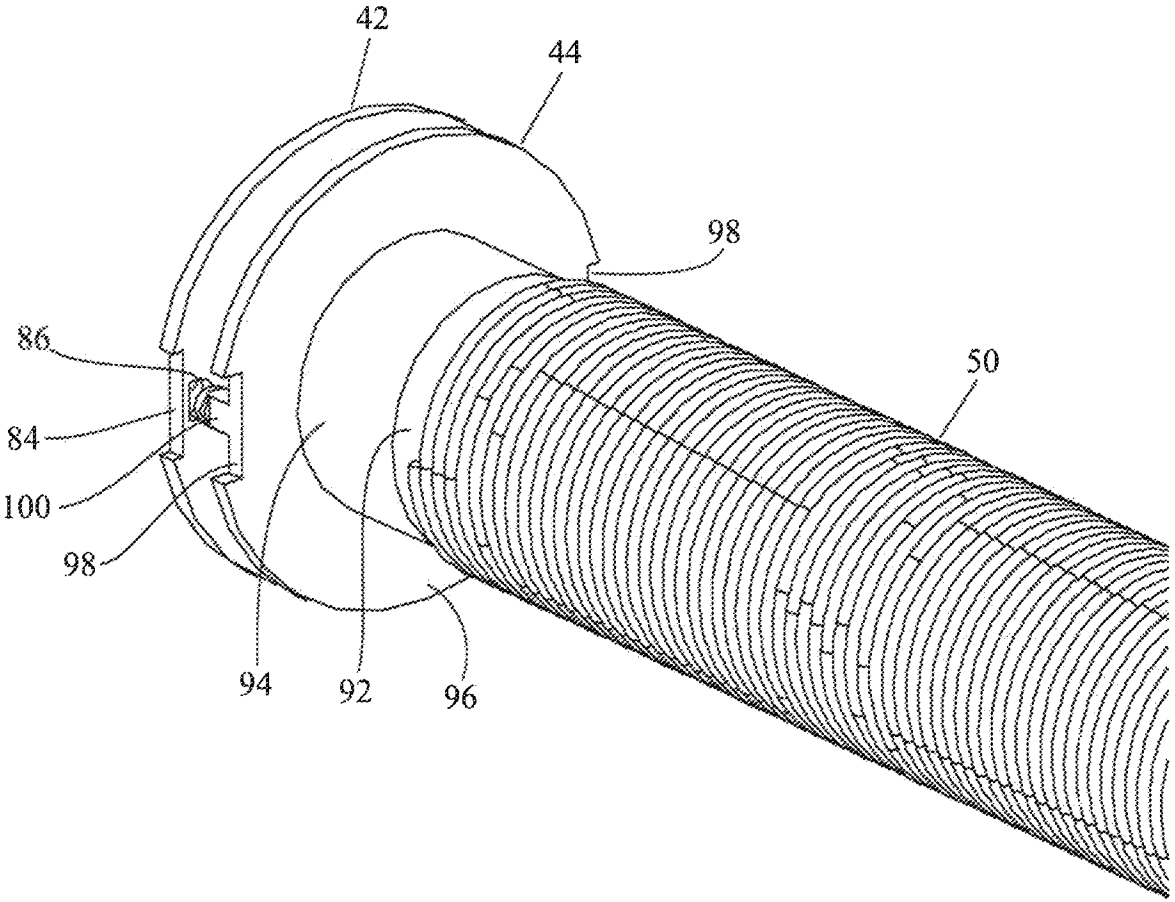
Figure 13:
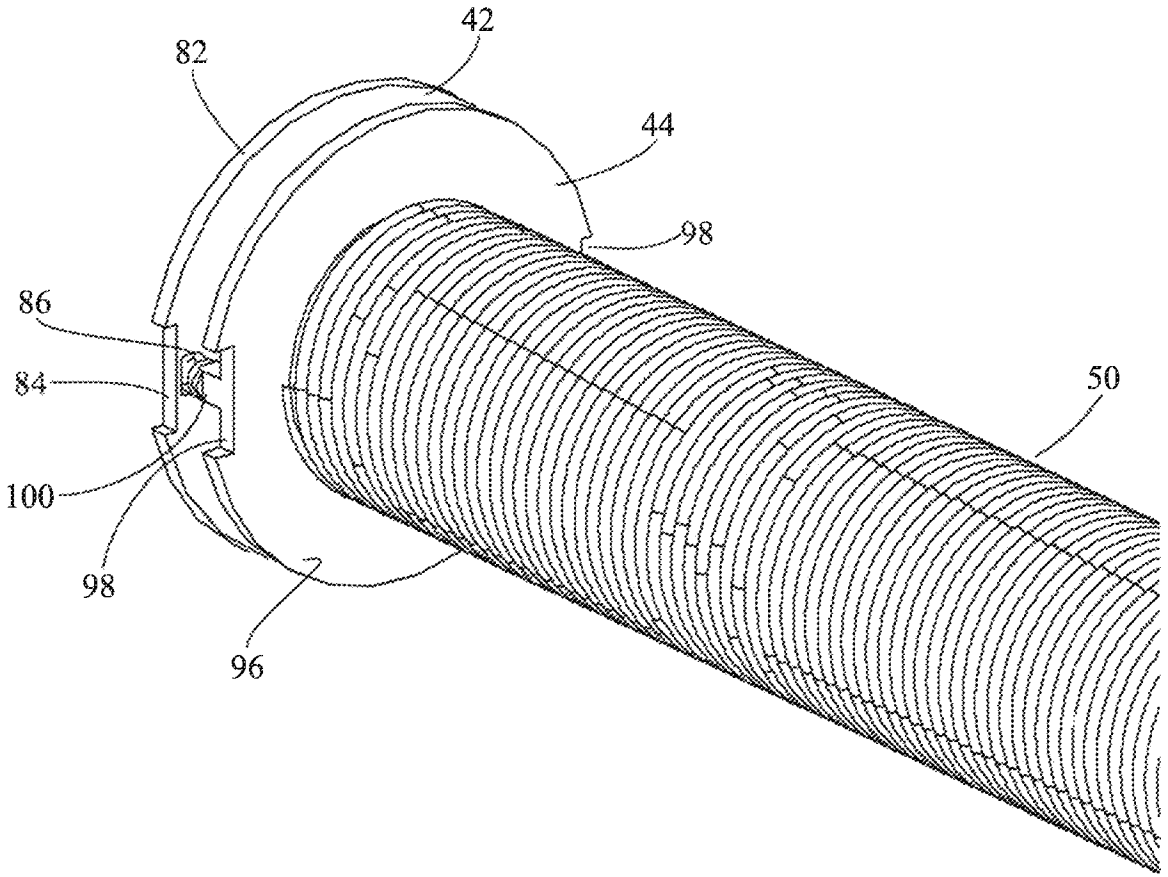

The spring 50 is a coil spring having first and second ends. Referring to FIGS. 11, 12, and 13, the spring 50 is assembled onto the drive plug 44 by lining up the first end of the spring 50 with the frustoconical portion 92 of the drive plug 44. The spring 50 is then "threaded" onto the drive plug 44 by rotating the spring 50 in a clockwise direction (as seen from the vantage point of FIG. 11). This "opens up" the spring 50, increasing its inside diameter and allowing it to be pushed onto and "threaded" up the tapered surface of the frustoconical portion 92 of the drive plug 44, as shown in FIG. 12. A final effort to push the spring 50 onto the drive plug 44 places the spring 50 fully onto the cylindrical portion 94 of the drive plug 44, until the first end of the spring 50 is abutting the flange 96 of the drive plug 44. When the spring 50 is released (that is, when it is no longer being "opened" by the clockwise rotation against the drive plug 44), it will collapse, reducing its inside diameter, so it clamps onto the cylindrical portion 92 of the drive plug 44. The second end of the spring 50 is similarly mounted onto and secured to the cylindrical portion 104 of the spring plug 52 (see FIG. 5). Note that the frustoconical portions of the drive plug 44 and of the spring plug 52 may be threaded (not shown in the figures) to assist in the assembly of the spring 50 to these plugs 44, 52.

To assemble the roller shade 10, the power assist modules 12 are first assembled as follows. As shown in FIGS. 9 and 10, the drive plug 44 is mounted for rotation onto the outer surface 80 of the drive plug shaft 42, with the flange 96 of the drive plug 44 adjacent to the flange 82 of the drive plug shaft 42 and with the projection 100 of the drive plug 44 not yet inserted into the through opening 86 of the drive plug shaft 42. The limiter 46 is threaded into the drive plug shaft 42 until the stop projection 66 on the limiter 46 impacts against the stop projection 68 on the drive plug shaft 42, as shown in FIG. 10. The spring 50 is then threaded onto the frustoconical portion 92 of the drive plug shaft 42, as described earlier and as shown in FIGS. 11, 12, and finally onto the cylindrical portion 94 of the drive plug shaft 42 as shown in FIG. 13. One end of the spring shaft 48 is inserted into the spring 50 until its ribs 56 are received in the cross-shaped groove 62 of the limiter 46. The spring plug 52 is then installed on the other end of the spring 50, with the groove 108 of the spring plug 52 receiving the ribs 56 of the spring shaft 48 and with the second end of the spring 50 threaded onto the cylindrical portion 104 of the spring plug 52. Note that so far the rod 24 has not yet been installed. The power assist modules 12 are now assembled as pictured in FIG. 4.

Referring to FIG. 13, to "pre-wind" the power assist module 12, the assembler holds onto the drive plug shaft 42 while rotating the drive plug 44 in a clockwise direction (as seen from the vantage point of FIG. 13). This causes the spring 50 to start winding up relative to its other end, which is stationary (non-rotating). The other end of the spring 50 is non-rotating because it is secured to the spring plug 52, which is connected to the spring shaft 48 via the cross-shaped groove 108 on the spring plug 52, which is engaged with the cross-shaped ribs 56 on the spring shaft 48. The spring shaft 48 is, in turn, connected to the limiter 46 (as shown in FIG. 10) via the groove 62 on the limiter 46 which also receives the cross-shaped ribs 56 on the spring shaft 48. The limiter 46 is prevented from rotation because the stop projection 68 on the drive plug shaft 42 is impacting against the stop projection 66 on the limiter 46, and the assembler is holding onto the drive plug shaft 42 to prevent its rotation.

Figure 14:
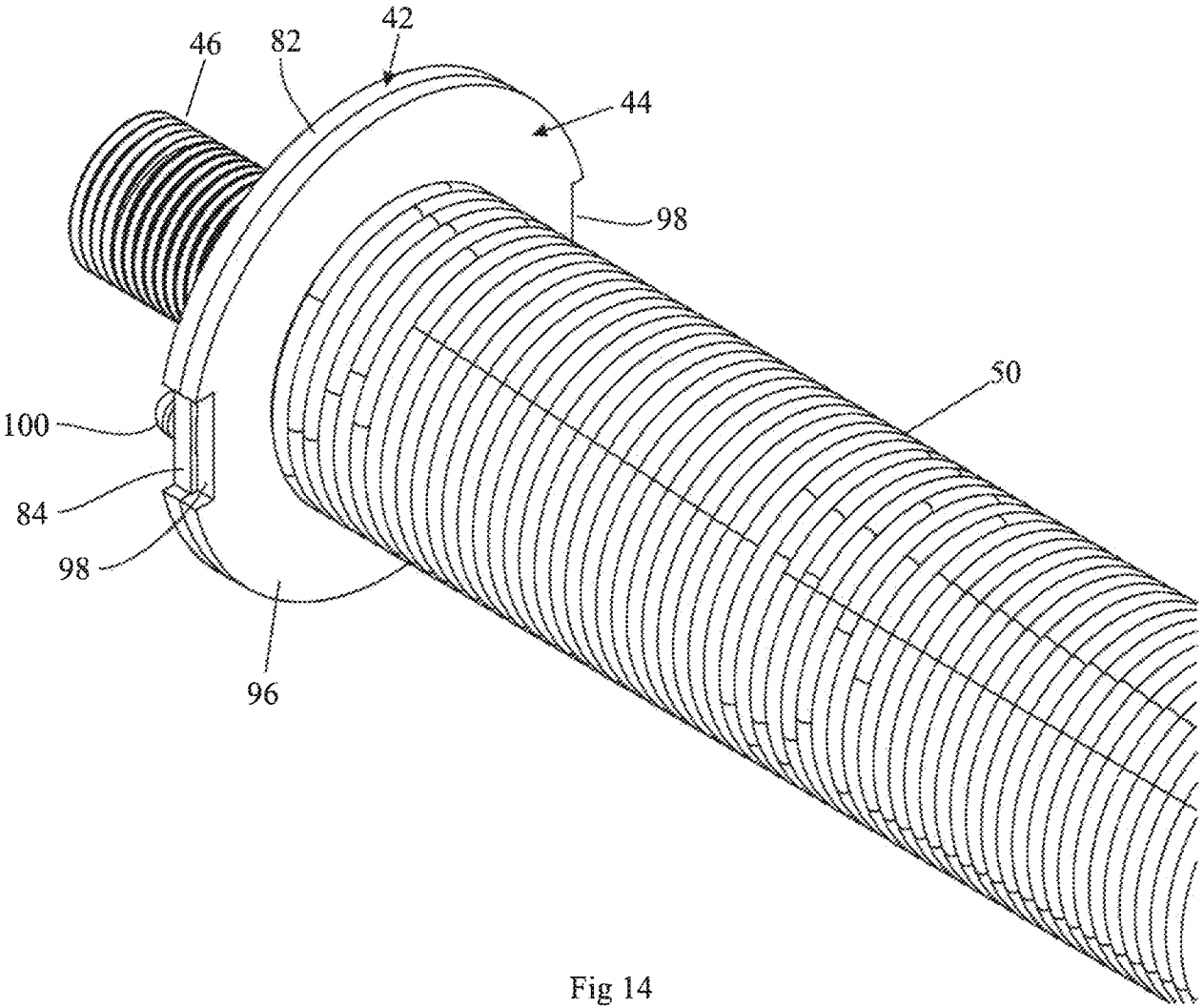
FIG. 14 illustrates a partially broken away, perspective view of the step for locking the drive plug to the drive plug shaft once the desired degree of "pre-wind" has been added to the power assist module.
Figure 15:
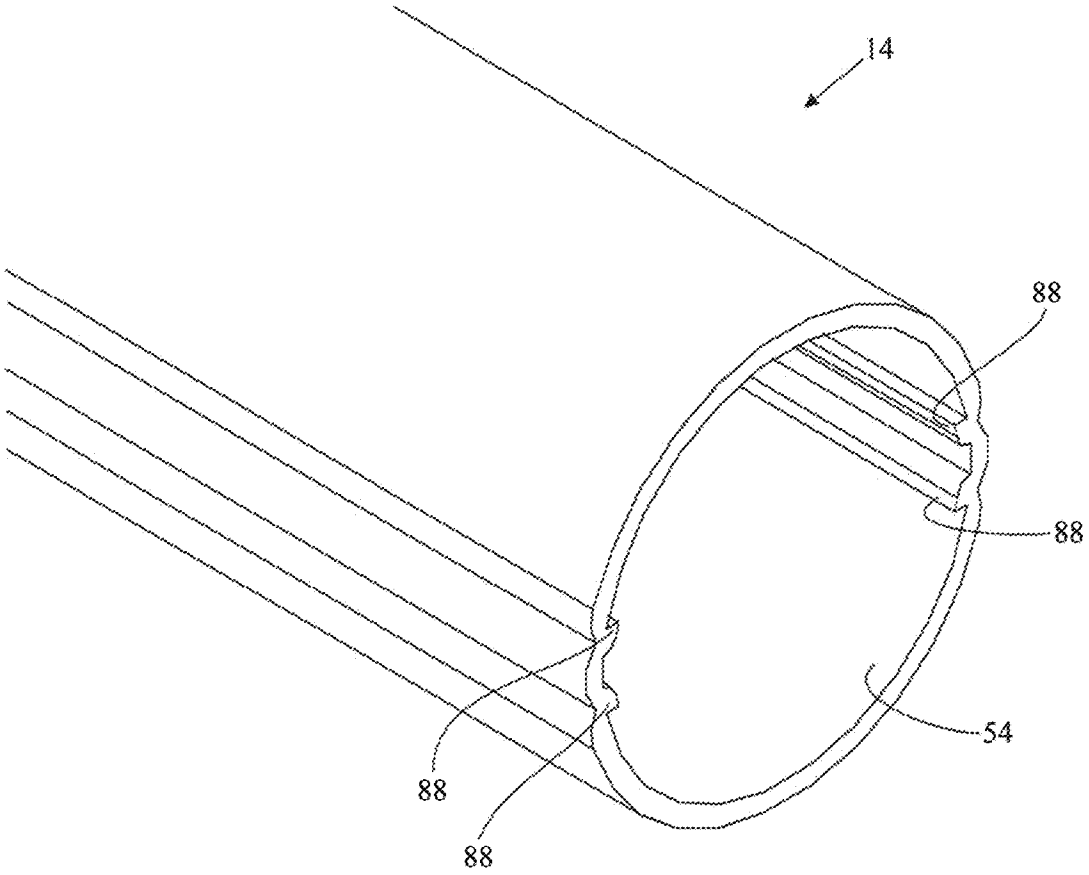
FIG. 15 illustrates a partially broken away, perspective end view of the rotator rail of FIGS. 1 and 2.

It can therefore be seen that, as the assembler rotates the drive plug 44 while holding onto the drive plug shaft 42, he is winding up the spring 50. Every time the projection 100 on the drive plug 44 rotates past the through opening 86 on the drive plug shaft 42, the spring 50 will have one complete turn of "pre-wind" added to it. Once the desired degree of "pre-wind" is reached, the assembler lines up the projection 100 on the drive plug 44 with the opening 86 in the drive plug shaft 42 and snaps the drive plug 44 and the drive plug shaft 42 together as shown in FIG. 14, with the flange 96 of the drive plug 44 in direct contact with the flange 82 of the drive plug shaft 42 and with the projection 100 of the drive plug 44 extending through the opening 86 in the flange 82 of the drive plug shaft 42. This "locks" the "pre-wind" onto the power assist module 12. The power assist module 12 is now assembled and "pre-wound" and is ready for installation in the roller shade 10. Note that more than one projection 100 on the drive plug 44 and/or more than one opening 86 in the drive plug shaft 42 may be present. In any event, the flats 84 on the drive plug shaft 42 line up with the flats 98 on the drive plug 44 so they may all catch the ribs 88 (See FIG. 15) of the rotator rail 14, as explained in more detail below.

From the foregoing discussion, it should be clear that the pre-winding method involves holding one end of the spring 50 to prevent its rotation, while the other end of the spring 50 is rotated. Referring to FIG. 4, in the pre-wind method described above, the right end of the spring 50 is held against rotation by the spring plug 52 (which is connected to the limiter 46 via the spring tube 48, all of which are prevented from rotation relative to the drive plug shaft 42, which is being held stationary by the person who is doing the prewinding. Using this pre-winding method, the spring 50 can only be pre-wound in discrete quantities, such as in one revolution increments for the embodiment depicted in FIG. 9.

Each power assist module 12 may be "pre-wound" to the desired degree of "pre-wind" independently of the other power assist modules 12 in the roller shade 10. For instance, some of the power assist modules 12 may be installed with no "pre-wind", while others may have one or more turns of "pre-wind" added to them prior to installation onto the roller shade 10. It should once again be noted that so far the rod 24 has not yet been installed. However, each power assist module 12 is an independent unit which may be stocked or shipped to an installer already with a desired degree of "pre-wind". This degree of "pre-wind" may be changed by simply separating the drive plug 44 from the drive plug shaft 42 far enough to free the projection 100 on the drive plug 44 from the through opening 86 of the drive plug shaft 42, which "unlocks" the power assist module 12 so that the degree of "pre-wind" may be adjusted by rotating the drive plug 44 clockwise relative to the drive plug shaft 42 to add more "pre-wind" or by rotating the drive plug 44 counter-clockwise relative to the drive plug shaft 42 to reduce the degree of "pre-wind" and then re-inserting the projection 100 on the drive plug 44 through the through opening 86 of the drive plug shaft 42 to again lock the drive plug 44 and drive plug shaft 42 together.

Instead of pre-winding as described above, at the drive plug end of the spring 50, another alternative is to prewind at the spring plug end of the spring 50. Referring again to FIGS. 4 and 5, the user holds onto the spring 50 at its rightmost end, near the spring plug 52, to prevent the rotation of the spring 50. He then grasps the flange 60 on the spring plug 52 and rotates it clockwise. This action "opens up" the end of the spring 50, allowing the spring plug 52 to be rotated while the rightmost end of the spring 50 is held against rotation. Rotation of the spring plug 52 also causes rotation of the spring tube 48, the limiter 46, the drive plug shaft 42, drive plug 44 (which is snapped together for rotation with the drive plug shaft 42) and the leftmost end of the spring 50 (adjacent the drive plug 44). Since the user is holding the rightmost end of the spring 50 against rotation, rotation of the left end of the spring 50 by means of rotating the spring plug 52 prewinds the spring 50. Using this procedure, the spring 50 may be pre-wound any desired amount, including any fractional number of revolutions for an infinitely adjustable degree of pre-wind of the spring 50. As soon as the user stops rotating the spring plug 52, the rightmost end of the spring 50 will "collapse" back onto the cylindrical portion 104 of the spring plug 52, locking onto the spring plug 52 to keep the desired pre-wind on the spring 50.

It should be noted that, if this alternative pre-wind procedure is used, the two-piece, snap together design of the drive plug shaft 42 and drive plug 44 is not needed and may be replaced by a single piece unit. However, the two-piece design described herein still has another advantage in that it provides an easy way to release any degree of pre-wind on the spring 50 simply by separating the drive plug shaft 42 from the drive plug 44. As soon as these two parts 42, 44 are unsnapped and released, the spring 50 will uncoil and lose all its pre-wind.

Referring now to FIGS. 2 and 8, to assemble the roller shade 10, the tube bearing 30 is mounted onto the shaft 32 of the bracket clip 16. The rod 24 is inserted, with a forced interference fit, into the inner bore 112 of the bracket clip 16, and the speed nut 28 is slid onto the rod 24 (from the left end as shown in FIG. 8) until it reaches the end of the inner bore 112 of the bracket clip 16. This prevents the tube bearing 30 from falling off of the bracket clip 16 because the tube bearing shaft 35 cannot pass over the flange of the speed nut 28 at the end of the bracket clip 16. One or more power assist modules 12 are then installed onto the rod 24 by sliding them onto the left end of the rod 24. The rod 24 engages the spring plug 52 and the limiter 46 of each power assist module 12 such that they are able to slide axially along the length of the rod 24, but they are unable to rotate relative to the rod 24. Since the rod 24 is axially secured to the bracket clip 16 and is prevented from rotating relative to the bracket clip 16, and since the bracket clip 16 is secured to a bracket which is mounted to a wall or to a window frame, then the rod 24 and the spring plugs 52 and limiters 46 of the power assist modules 12 are all mounted so they do not rotate relative to the wall or window frame.

The spring shaft 48 of each module 12 is both slidably and rotatably supported on the rod 24. The drive plug shaft 42 is threaded onto the non-rotating limiter 46, and the drive plug 44 is rotatably supported on the drive plug shaft 42 and is locked for rotation with the drive plug shaft 42 via the projection 100 inserted through the opening 86 on the drive plug shaft 42.

Once the desired number of modules 12 is slid onto the rod 24, the speed nut 26 is then slid onto the end of the rod 24 to the desired position, as shown in FIG. 2, to serve as a stop for the drive plug shaft 42 of the last module 12 by the flange of the speed nut 26 abutting the flange 82 of the drive plug shaft 42. This keeps the power assist modules 12 from sliding out beyond the rotator rail 14. The rotator rail 14 is then slid from left to right over the entire subassembly, making sure that the ribs 88 (See FIG. 15) on the inner surface 54 of the rotator rail 14 are received in the flat recesses 84, 98 on each drive plug shaft 42 and drive plug 44, respectively (and in the similar flat recesses on the tube bearing 30, as shown in FIG. 7C). The rotator rail 14 slides all the way over all the power assist modules 12 and fits snugly over the generally cylindrical outer surface 38 of the tube bearing 30 until it is stopped by the shoulder 40 of the tube bearing 30. Finally, the cord drive mechanism 18 is installed, which includes a drive spool (not shown) which engages the left end of the rotator rail 14 and causes it to rotate.

As was already described earlier, when the tassel weight 20 of the drive mechanism 18 is pulled down by the user, the drive cord 22 (which wraps around a capstan and onto a drive spool, not shown) is also pulled down. This causes the capstan and the drive spool to rotate about their respective axes of rotation in a first direction in order to retract the shade. The rotator rail 14 is secured to the drive spool for rotation with the drive spool about the same axis of rotation as the drive spool (e.g., like the tube bearing 30, the drive spool also has flat recesses that receive the internal ribs 88 of the rotator rail 14). As the rotator rail 14 rotates in the first direction, with the user pulling down on the drive cord 22, the shade is retracted with the help of the springs 50. The right end of each spring 50 (from the perspective of FIG. 8) does not rotate, since the spring plug 52 on which it is mounted does not rotate. The left end of each spring 50 drives the drive plug 44 on which it is mounted and the respective drive plug shaft 42 that is connected to the drive plug 44 by means of the projection 100 and by means of the rotator rail 14, which has internal ribs 88 that key the rotator rail 14 to all the drive plugs 44 and drive plug shafts 42. Thus, as the springs 50 drive their respective drive plugs 44, they drive the rotator rail 14 in the first direction, with the assistance of the user pulling down on the drive cord, which drives the drive mechanism 18 and the rotator rail 14 in the first direction, to retract the shade.

The "pre-wind" in the power assist modules 12 provides force to retract the roller shade 10 all the way until the shade is completely retracted. Once the shade is completely retracted, the stop projection 66 on the limiter 46 impacts against the stop projection 68 on the drive plug shaft 42 to prevent any further rotation of the rotator rail 14.

When the user releases the tassel weight 20, the force of gravity acting to extend the shade urges the rotation of the drive spool in the opposite direction. This pulls up on the drive cord 22 which shifts the capstan to a position where the capstan is not allowed to rotate. This locks up the roller lock mechanism so as to prevent the shade from falling (extending).

To extend the shade, the user lifts up on the tassel weight 20, which relieves tension on the drive cord 22, allowing the cord 22 to surge the capstan (as described in US 2006/0118248, which was previously incorporated by reference herein). The drive spool and the rotator rail 14 are then allowed to rotate in a second direction due to the force of gravity acting to extend the shade, overcoming the force of the power assist modules 12. This causes the power assist modules 12 to wind up in preparation for when they are called to assist in retracting the shade again. When the user releases the tassel weight 20 again, the gravitational force acting on the tassel weight 20 puts enough tension on the drive cord 22 to prevent any further surging of the capstan, which locks the roller lock mechanism and locks the roller shade in place (as indicated earlier, other alternative cord operated locking mechanisms could be used).

It should be noted that, in the above-described embodiment(s) of the roller shade 10, the rod 24 is supported and secured against rotation by the non-drive end bracket clip 16 (See FIG. 8). The spring plug 52 is keyed to the rod 24, so it also is secured for non-rotation to the non-drive end bracket clip 16. The limiter 46 is also keyed to the rod 24, so it also is secured for non-rotation to the non-drive end bracket clip. As the rotator rail 14 (See FIG. 1) is extended, its inside surface 54 (See FIG. 15) engages the drive plug 44 and the drive plug shaft 42 (via the projections 88 which engage the flats 84, 98 (See FIG. 14) of the drive plug shaft 42 and of the drive plug 44, respectively. The drive plug shaft 42 threads itself partially off of the limiter 46 as the spring 50 winds up.

When retracting the roller shade 10, the rotator rail 14 is urged to rotate by the spring 50 so as to unwind the spring 50, and this action re-threads the drive plug shaft 42 onto the limiter 46 until the stop 66 on the limiter 46 impacts against the stop 68 on the drive plug shaft 42, preventing any further rotation of the drive plug shaft 42 and therefore also of the rotator rail 14, and this corresponds to the fully retracted position of the rotator rail 14.

Various additional embodiments of the present subject matter will now be described below. It should be appreciated that, in general, such embodiments may operate in substantially the same manner as the embodiment(s) described above, with the following primary differences in implementation of the design:

- The rod 24 may be secured against rotation to either the drive end or the non-drive end of the roller shade, whereas the embodiment(s) described above was configured to be secured against rotation to the non-drive end. This may be accomplished, for example, by using a coupler.
- Instead of keying the limiter to the rod 24, it may be secured via swaging to the spring shaft.
- The spring shaft may have a "C" cross-section, and may preferably be made from a material, such as extruded aluminum, that is torsionally strong enough to handle the torque applied by the spring 50.
- The rod 24 may only be keyed to a single element (e.g., the spring plug) in each power assist module, which may facilitate the installation of the rod 24 through the power assist modules.
- The designs of the drive plug shaft and of the drive plug may be different from the embodiment(s) described above.
- Rotator rail adaptors may be added at the spring plug end of each power assist module to provide additional support for the rod 24. These rotator rail adaptors may mount onto, but rotate independently from, their corresponding spring plugs and may accommodate a range of rotator rail sizes (diameters).

FIGS. 16-38 show a second embodiment of a roller shade 10' made in accordance with the present invention. The same item numbers are used for this second embodiment 10' as were used for the first embodiment 10, with the addition of a "prime" designation (as in 10') to differentiate the second embodiment from the first embodiment.

Figure 16:
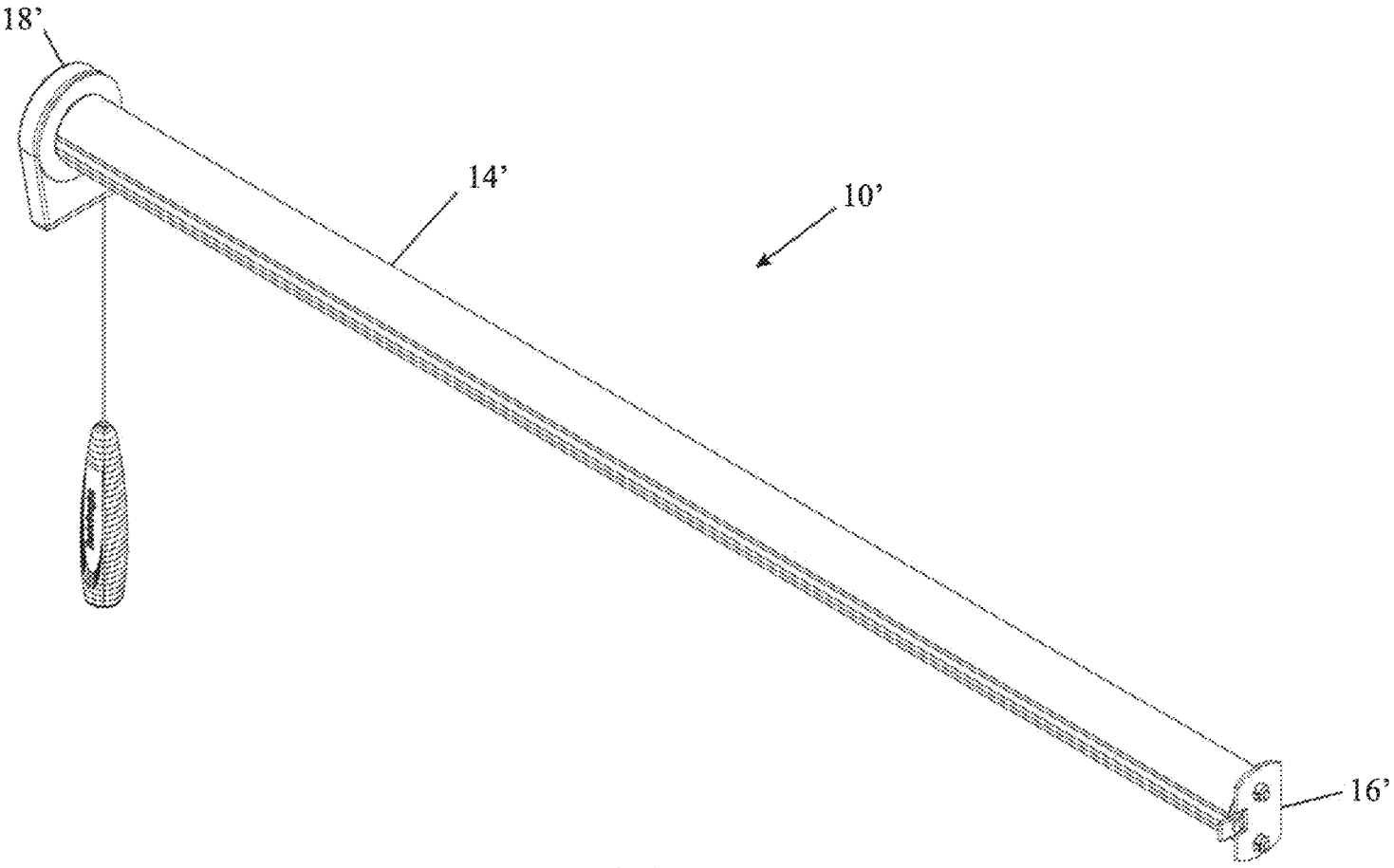
FIG. 16 illustrates a perspective view of another embodiment of a roller shade including a control mechanism for extending and retracting the shade in accordance with aspects of the present subject matter.
Figure 17:
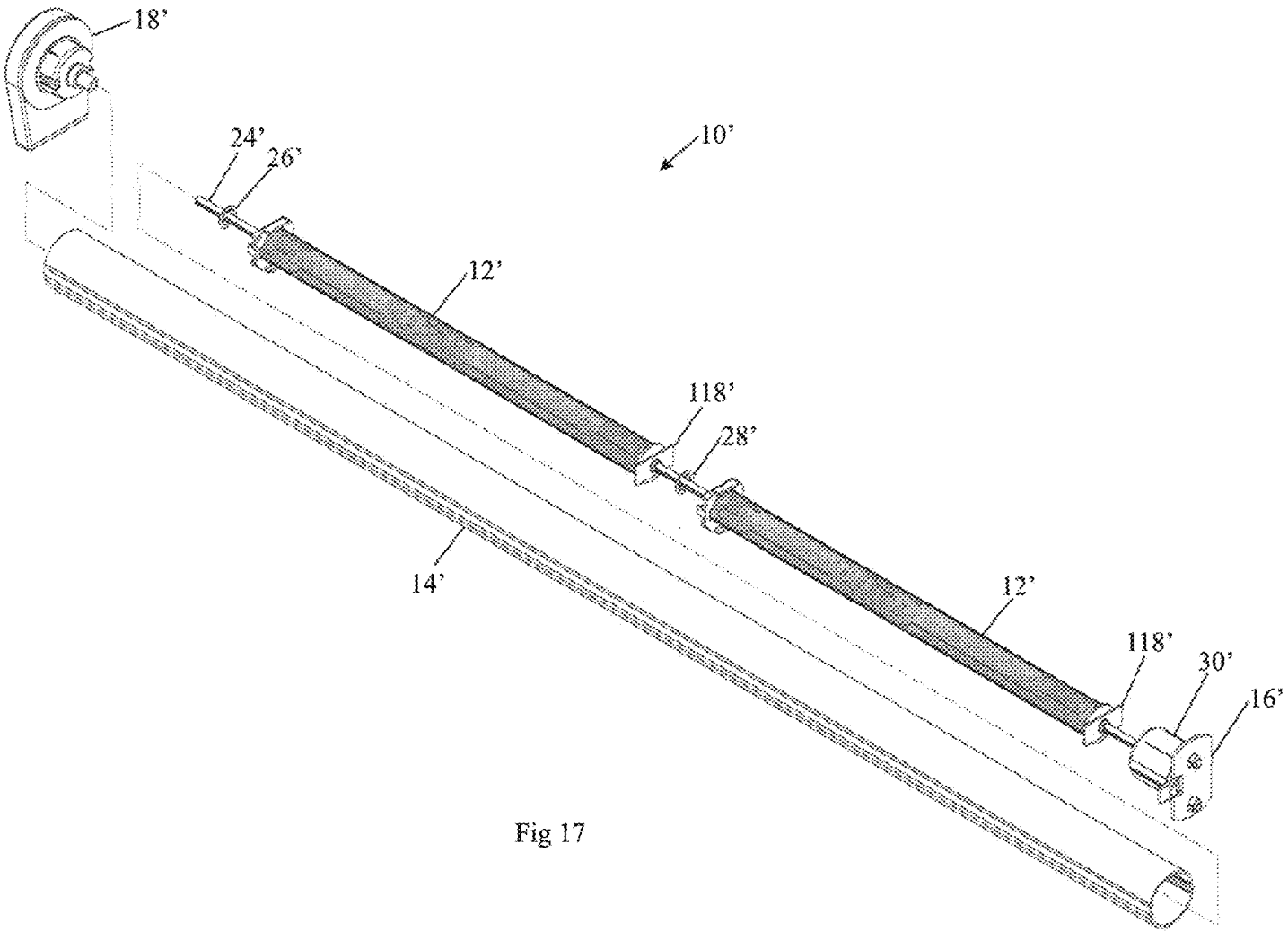
FIG. 17 illustrates a partially exploded perspective view of the roller shade of FIG. 16.
Figure 18:
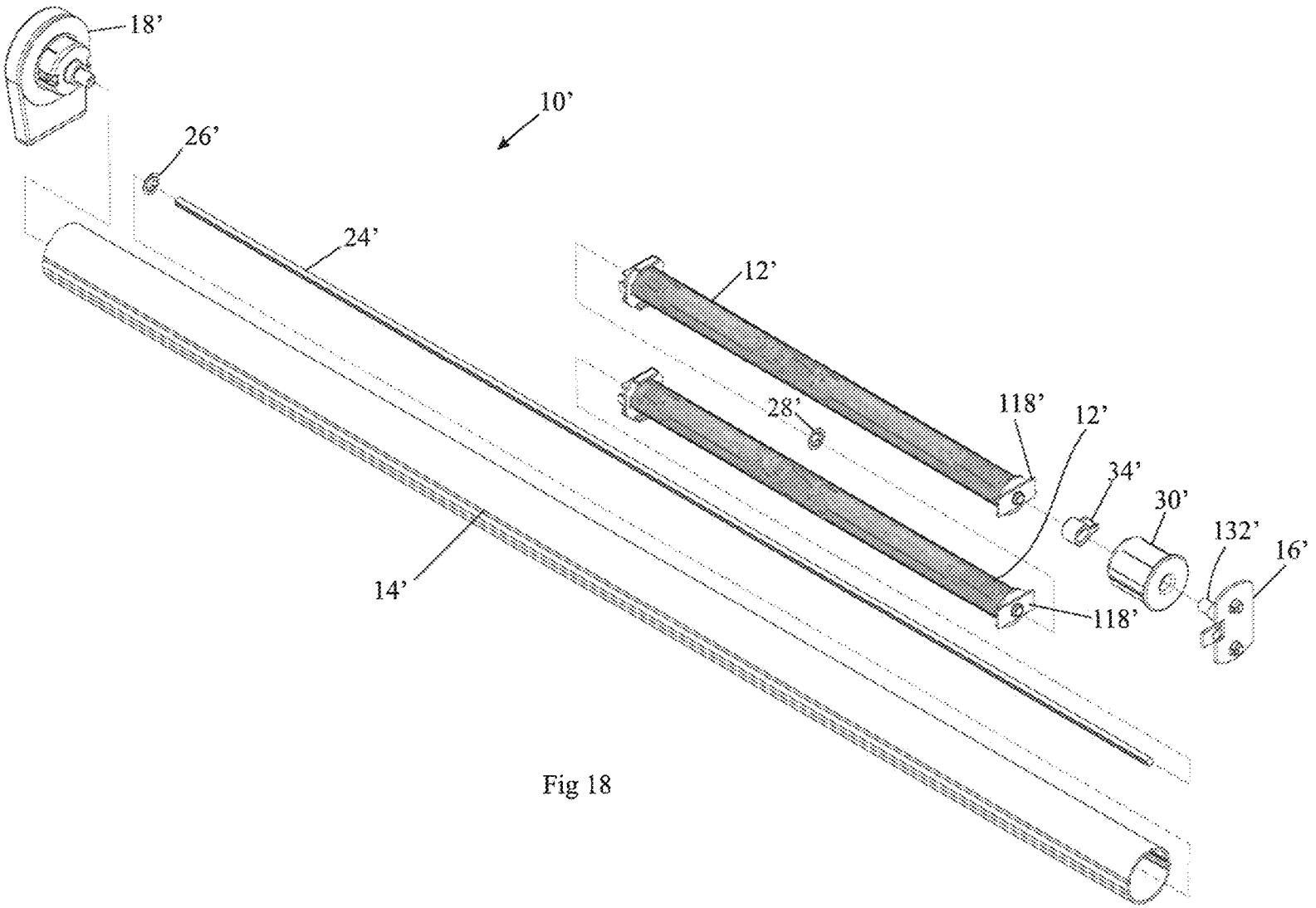
FIG. 18 illustrates a partially exploded perspective view of the roller shade of FIG. 17.
Figure 39:
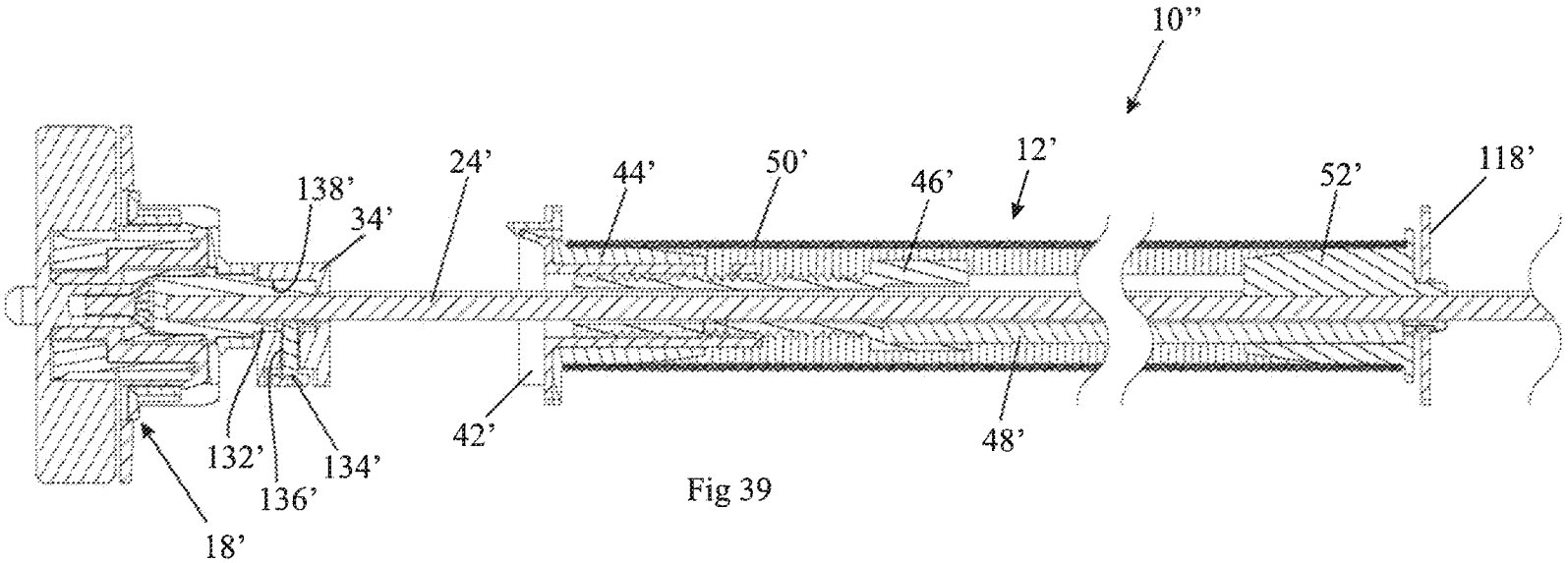
FIG. 39 illustrates a section view, similar to that of FIG. 23, but for another embodiment of a roller shade, wherein the rod is secured for non-rotation to the control mechanism for extending and retracting the shade, instead of being secured to the non-drive end mounting clip in accordance with aspects of the present subject matter.
Figure 41:
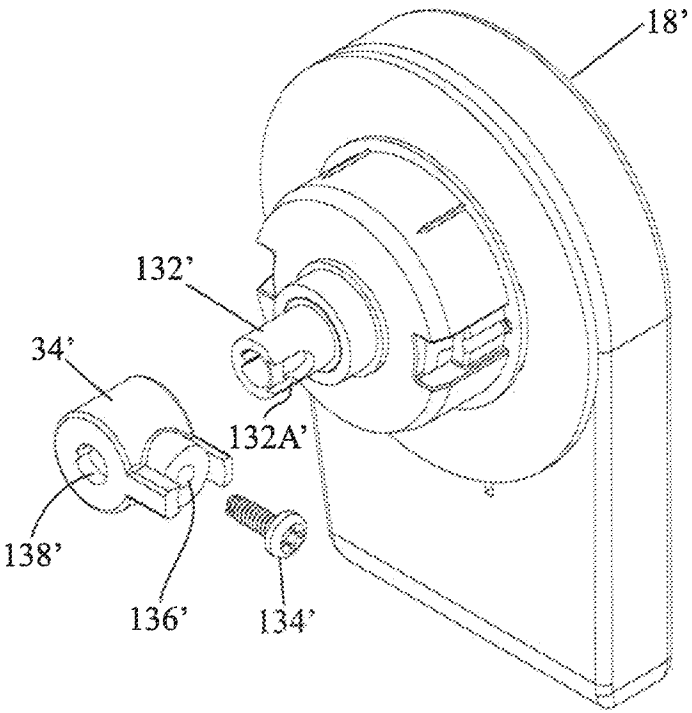
FIG. 41 illustrates a partially exploded, perspective view of the control mechanism and the coupler with screw of FIG. 40.
Figure 40:
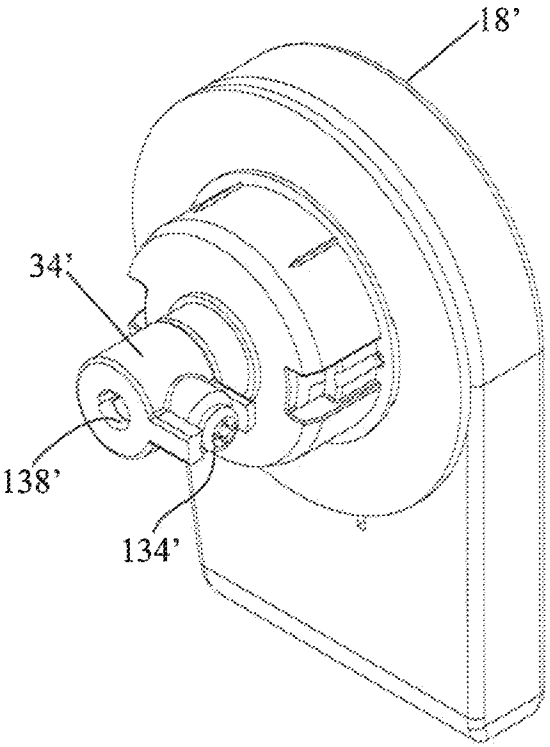
FIG. 40 illustrates an assembled, perspective view of the control mechanism and the coupler with screw of FIG. 39.

Referring to FIGS. 16-18, the roller shade 10' includes a drive mechanism 18', which may, for example, be configured the same as the drive mechanism 18 in the first embodiment. However, other alternative drive mechanisms may be used, as known in the art. The roller shade 10' also includes a rotator rail 14', a non-drive end bracket clip 16', a rod 24', first and second speed nuts 26', 28', a tube bearing 30', a coupler 34' (See FIG. 18), and one or more power assist modules 12'. As explained later, the power assist modules 12' may include rotator rail adaptors 118'. It should be noted that the rod 24' in this embodiment of a roller shade 10' is secured for non-rotation to the non-drive end bracket clip 16' via the coupler 34'. Alternatively, another embodiment of a roller shade 10" is shown in FIGS. 39-41 that has the rod 24' secured for non-rotation to the drive mechanism 18' via the coupler 34', as explained in more detail later. In general, the aforementioned components may be configured the same as or substantially similar to their counterparts in the embodiment of the roller shade 10 shown in FIGS. 1-15, with the exception of the coupler and the rotator rail adaptors (which were absent in the first embodiment 10) and the power assist modules 12', which have structural differences but function in substantially the same manner, as explained in more detail below.

Referring to FIGS. 19-26, each power assist module 12' includes a drive plug shaft 42', a drive plug 44', a limiter 46', a spring shaft 48', a spring 50', a spring plug 52', and may include a rotator rail adaptor 118'.

Figures 19, 20:
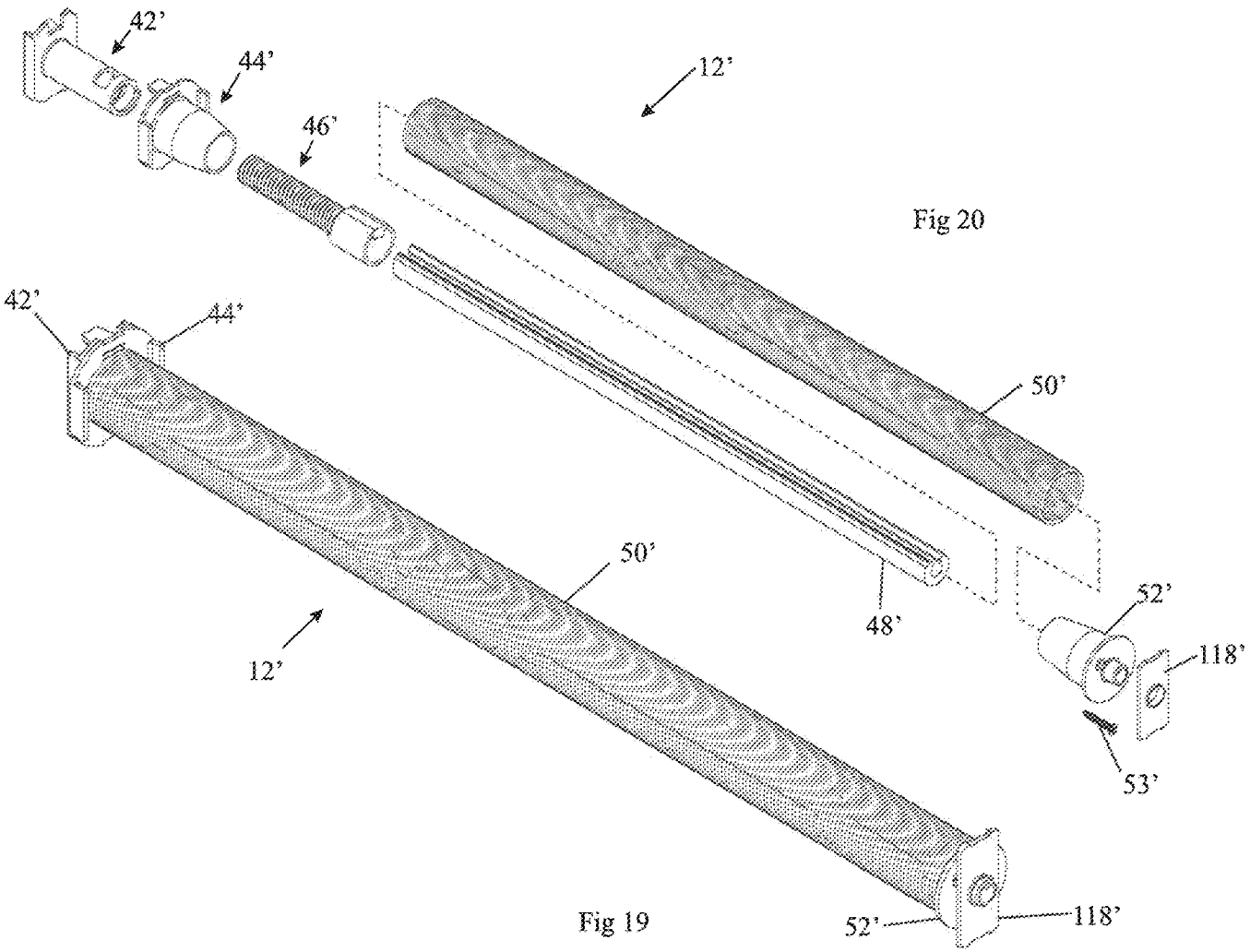
FIG. 19 illustrates a perspective view of one of the power assist modules of FIG. 18.
FIG. 20 illustrates an exploded perspective view of the power assist module of FIG. 19.
Figure 21:
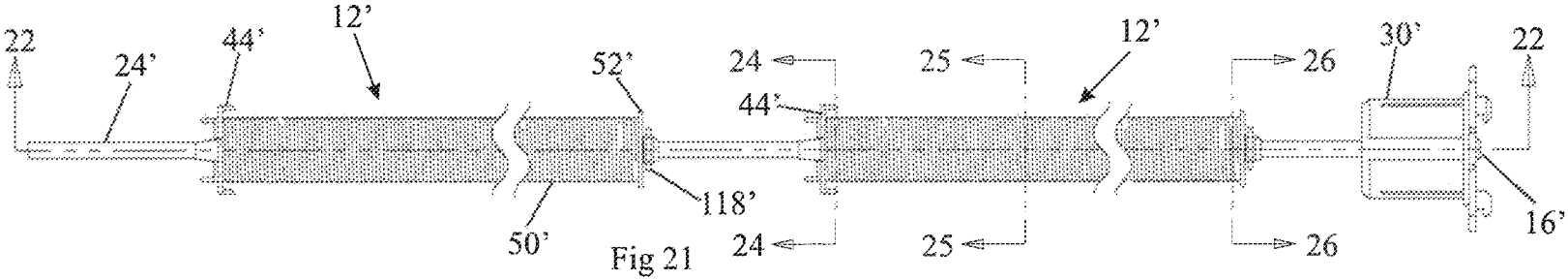
FIG. 21 illustrates a side view of the roller shade of FIG. 16, with the rotator rail and the control mechanism omitted for clarity.
Figure 26:
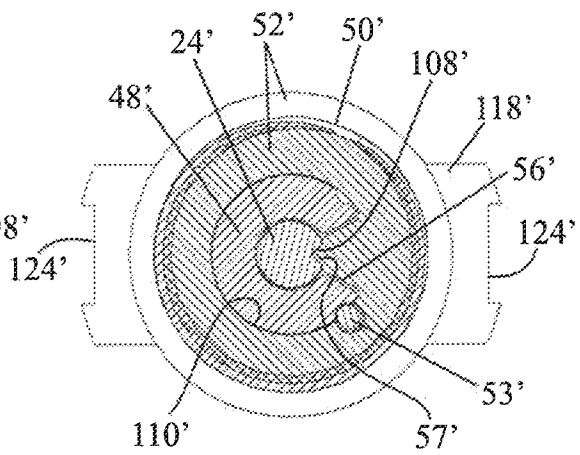
FIG. 26 illustrates a view along line 26-26 of FIG. 21.
Figure 25:
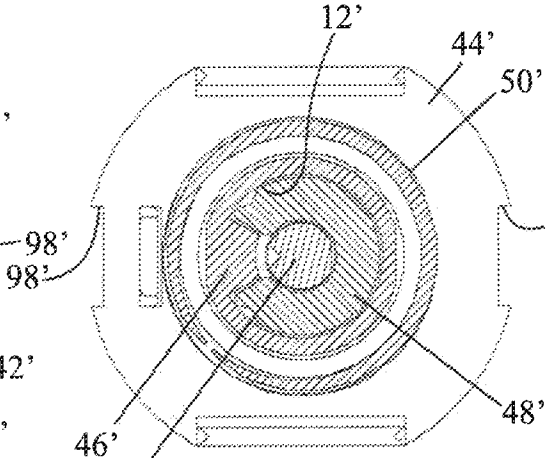
FIG. 25 illustrates a view along line 25-25 of FIG. 21.
Figure 24:
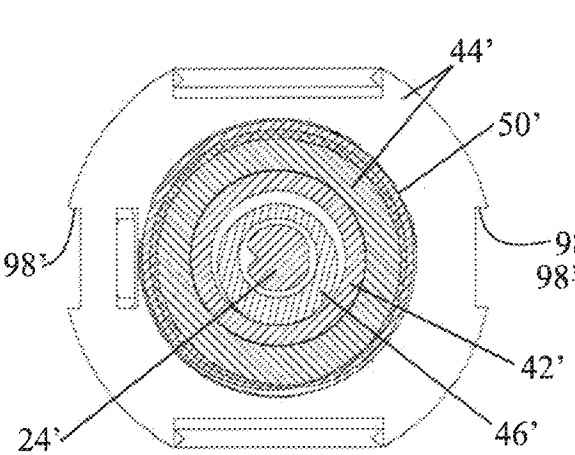
FIG. 24 illustrates a view along line 24-24 of FIG. 21.
Figure 28:
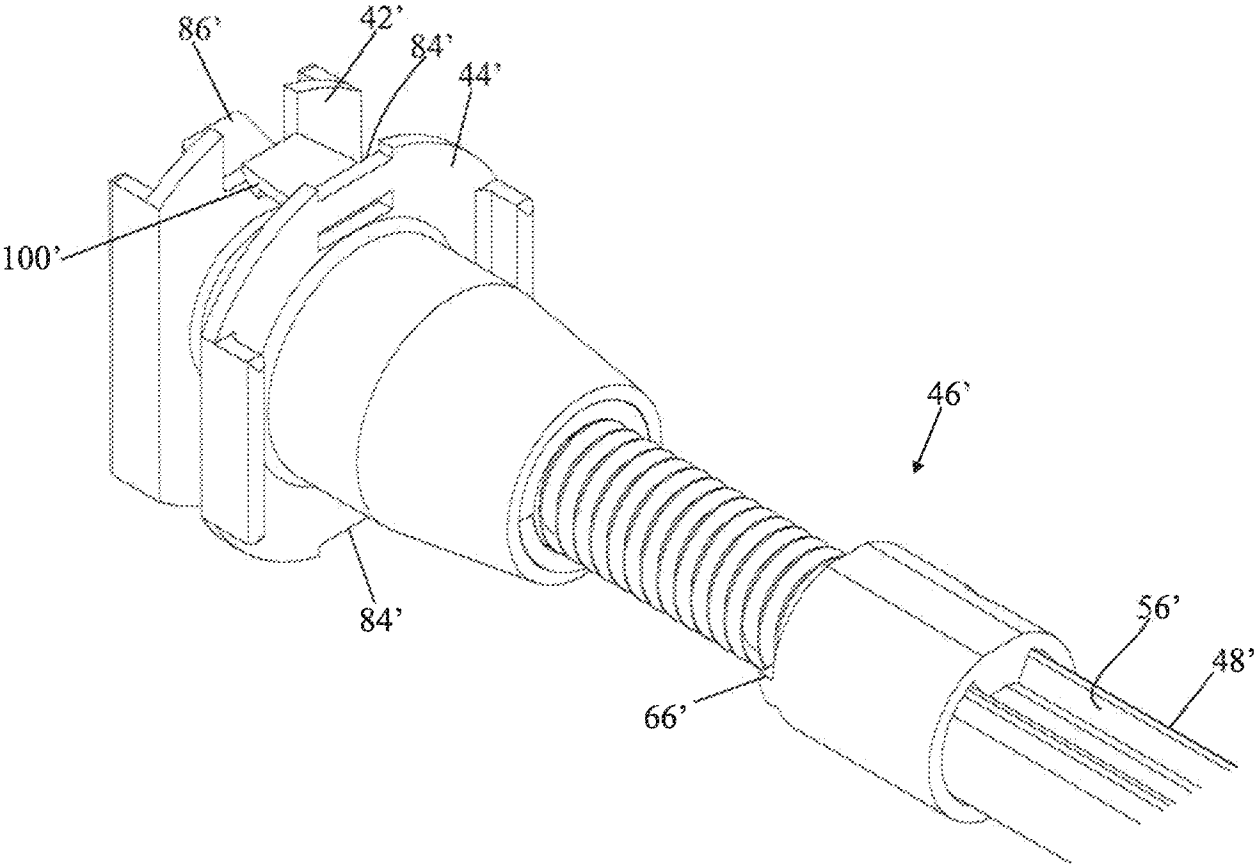
FIG. 28 illustrates a partially broken away, perspective view of a preliminary assembly step of the drive plug shaft, the drive plug, and the limiter of FIG. 9, also including the spring shaft.
Figure 30B:
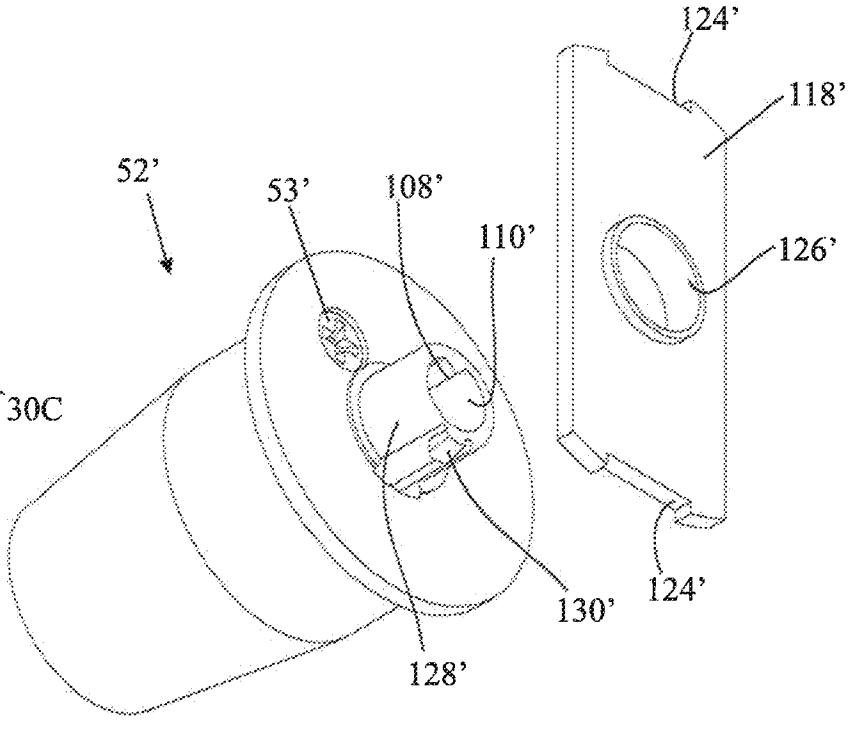
FIG. 30B illustrates an exploded, perspective view of the spring plug and rotator rail adaptor of FIG. 30A.

Referring to FIGS. 20 and 28, the spring shaft 48' is an elongated element, preferably made from a material, such as extruded aluminum (or other material of sufficient torsional strength), with a "C" channel cross-section (as may also be appreciated in FIGS. 25 and 26). As shown in FIGS. 26 and 30B, the spring plug 52' defines an inner bore 110' with a substantially "V" shaped projection 108' which, as best appreciated in FIG. 26, is received in the substantially "V" shaped notch 56' in the "C" channel cross-section of the spring shaft 48', and in the substantially "V" shaped notch 57' of the rod 24' such that the spring plug 52', spring shaft 48' and rod 24' are locked together for non-rotation. To summarize, the "V" shaped projection 108' of the spring plug 52' extends through both the "V" shaped notch 56' in the "C" channel cross-section of the spring shaft 48' and the "V" shaped notch 57' of the rod 24', locking all three of the items for non-rotation relative to each other.

The spring shaft 48' is further secured to the spring plug 52' via a screw 53' (See also FIGS. 20, 26 and 30B) which is threaded between the inner bore 110' of the spring plug 52' and the outer surface of the spring shaft 48' to lock these two parts 52', 48' together against separation in the axial direction.

Figure 27:
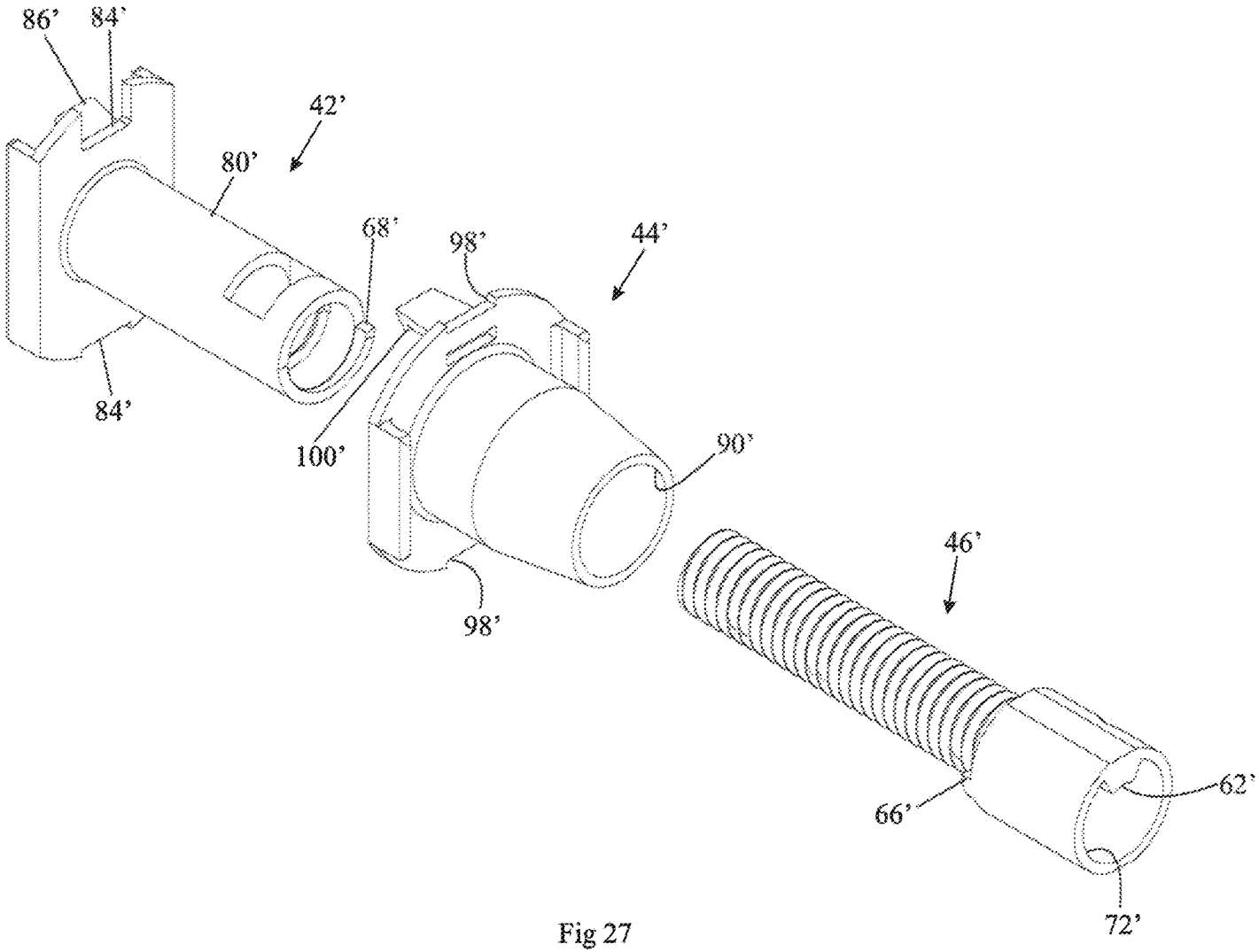
FIG. 27 illustrates an exploded perspective view of the drive plug shaft, the drive plug, and the limiter of the power assist module of FIG. 20.

As shown in FIGS. 25, 27 and 28, the other end of the spring shaft 48' fits into the inner bore 72' of the limiter 46', with the substantially "V" shaped projection 62' of the limiter 46' fitting into the substantially "V" shaped notch 56' in the "C" channel cross-section of the spring shaft 48', such that both of these parts 46', 48' are locked together for non-rotation relative to each other, as shown in FIG. 25.

Figure 38:
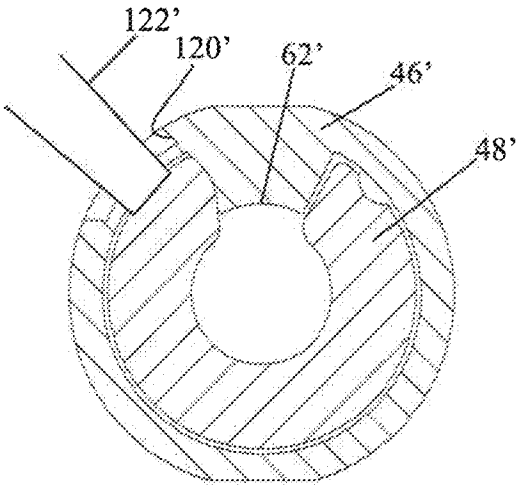
FIG. 38 illustrates a section view identical to that of FIG. 37, but immediately after impacting a punch to the spring shaft so as to swage the spring shaft to the limiter.
Figure 37:
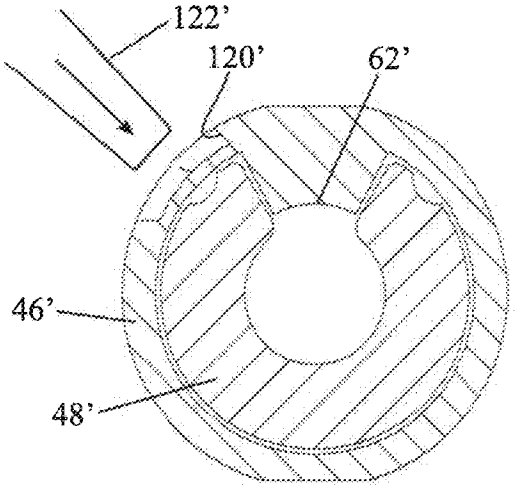
FIG. 37 illustrates a section view along line 37-37 of FIG. 36, prior to swaging the spring shaft to the limiter.
Figure 36:
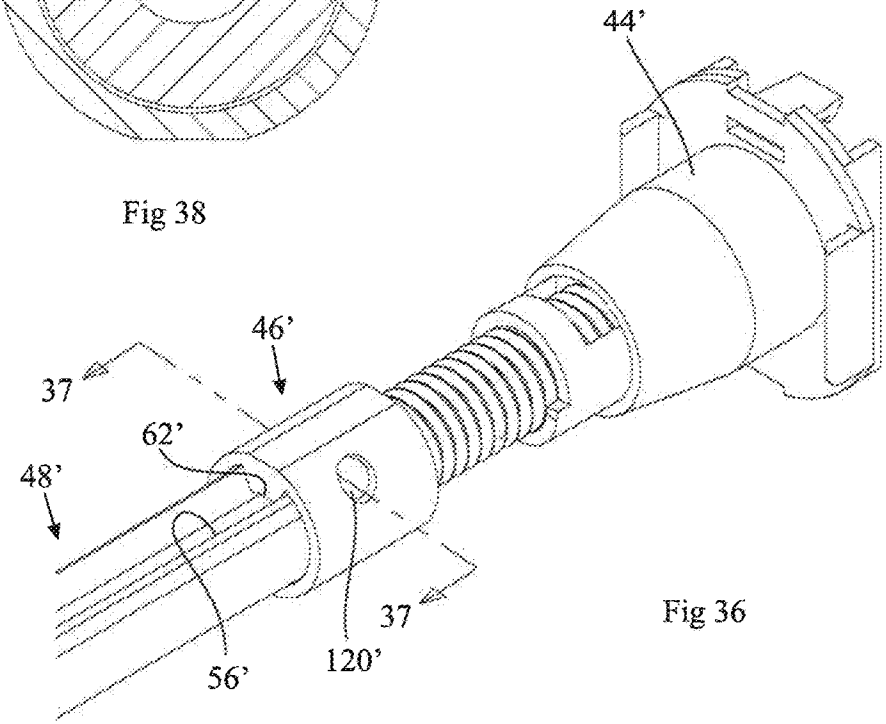
FIG. 36 illustrates a perspective view of the drive plug, the limiter, and the spring shaft, similar to FIG. 28, but shown from the opposite side, detailing the location for impacting the limiter to swage the spring shaft to the limiter.

Referring now to FIGS. 36-38, the limiter 46' includes a thinned-out spot 120' to indicate the location where the spring shaft 48' may be hit in the radial direction with a center punch 122', punching through the limiter 46' to swage the spring shaft 48' against the substantially "V" shaped projection 62' of the limiter 46' to lock these two parts 46', 48' together so they will not slide relative to each other in the axial direction.

Thus, the assembly of the spring plug 52', the spring shaft 48', and the limiter 46' is secured together for non-rotation relative to each other as well as for non-separation in the axial direction. In this assembly, only the spring plug 52' engages the rod 24' during final assembly (as shown in FIG. 26) to prevent rotation of the assembly relative to the rod 24', but the assembly permits sliding motion of the spring plug 52', spring shaft 48' and limiter 46' in the axial direction relative to the rod 24'. As explained in more detail later, the rod 24' is secured for non-rotation either to the non-drive end bracket clip 16' or to the drive mechanism 18' via a coupler 34'.

Figure 29:
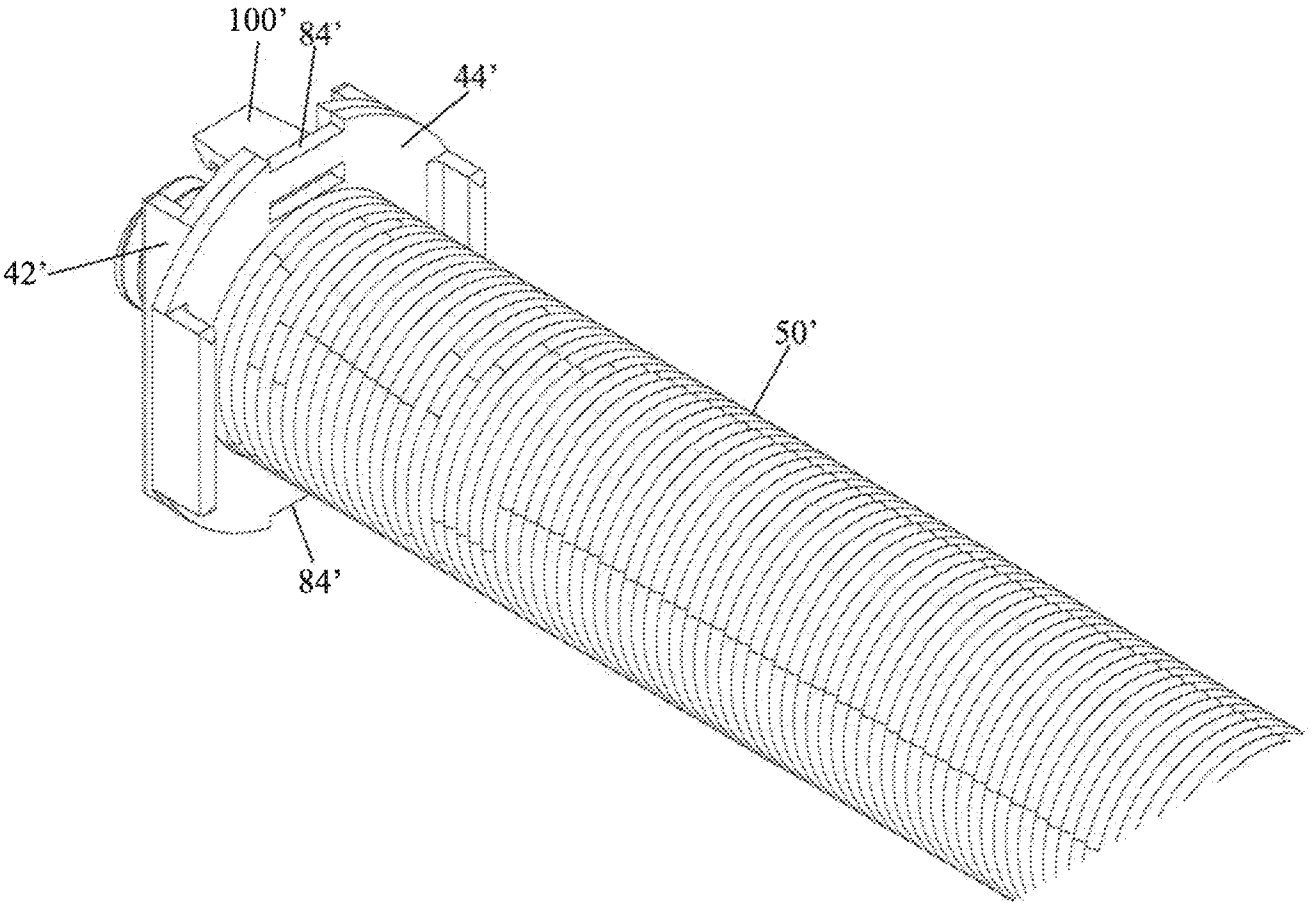
FIG. 29 illustrates a partially broken away, perspective view of the step for locking the drive plug to the drive plug shaft once the desired degree of "pre-wind" has been added to the power assist module.

Referring now to FIGS. 27-29, the drive plug 44' is similar to the drive plug 44 of the described above, with flats 98' which receive and engage the ribs 88 (See FIG. 15) of the rotator rail 14 for positive rotational engagement of these two parts 44', 14. The inner bore 90' of the drive plug 44' is supported for rotation by the smooth external surface 80' of the drive plug shaft 42'. The drive plug 44' defines a hook 100' which snaps over a projection 86' on the drive plug shaft 42' to lock these two parts together (in the assembled position of FIG. 29) after the desired degree of"pre wind" has been added to the power assist module 12', so as to "lock" the degree of pre-wind in a similar manner to how this was handled in the embodiment of the roller shade 10 described above. The drive plug shaft 42' has corresponding flats 84' which align with the flats 98' of the drive plug 44' and receive the ribs 88 of the rotator rail 14 such that both the drive plug shaft 42' and the drive plug 44' together engage the rotator rail 14.

As was the case for the embodiment(s) described above, the limiter 46' includes a stop 66' (See FIG. 27) which impacts against a stop 68' on the drive plug shaft 42' when the shade is in the fully retracted position to stop the shade from further rotation, despite the fact that the power assist modules 12' may continue to urge the rotator rail 14' to rotate in the retracting direction. Similar to the embodiment(s) described above, it may be desirable to form the drive plug shaft 42' and the limiter 46' (or at least the portions of such components forming the stop projections 66', 68') from a durable type of material(s) having suitable material properties so as to prevent damage to one or both of the stops 66', 68' as the stops 66', 68' contact each other. For instance, in one embodiment, both the drive plug shaft 42' and the limiter 46' (or at least the portions of such components forming the stops 66', 68') may be formed from a metal material (e.g., aluminum, steel, or any other suitable metal) such that metal-on-metal contact is provided at the interface between the stops 66', 68' when the roller shade 10' is retracted.

Additionally, similar to the embodiment described above, the drive plug shaft 42' is configured to be threaded onto the limiter 46'. In one embodiment, the drive plug shaft 42' may include integrally formed, internal threads configured to engage the corresponding threaded portion of the limiter 46'. Alternatively, as will be described below with reference to FIGS. 67-69, the internal threads may be defined by a separate, threaded insert positioned within the drive plug shaft 42'.

Figure 30A:
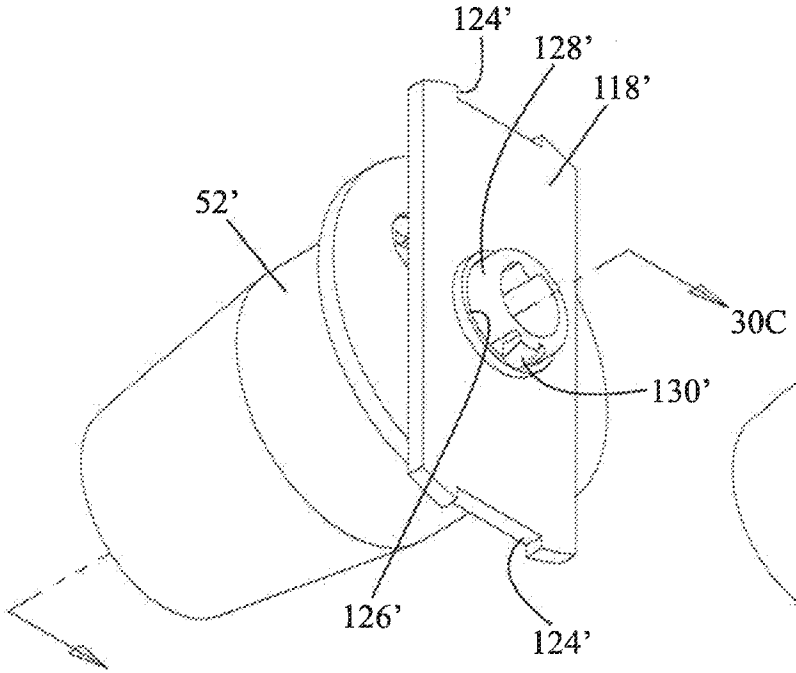
FIG. 30A illustrates an assembled, perspective view of the spring plug and rotator rail adaptor.
Figure 30C:
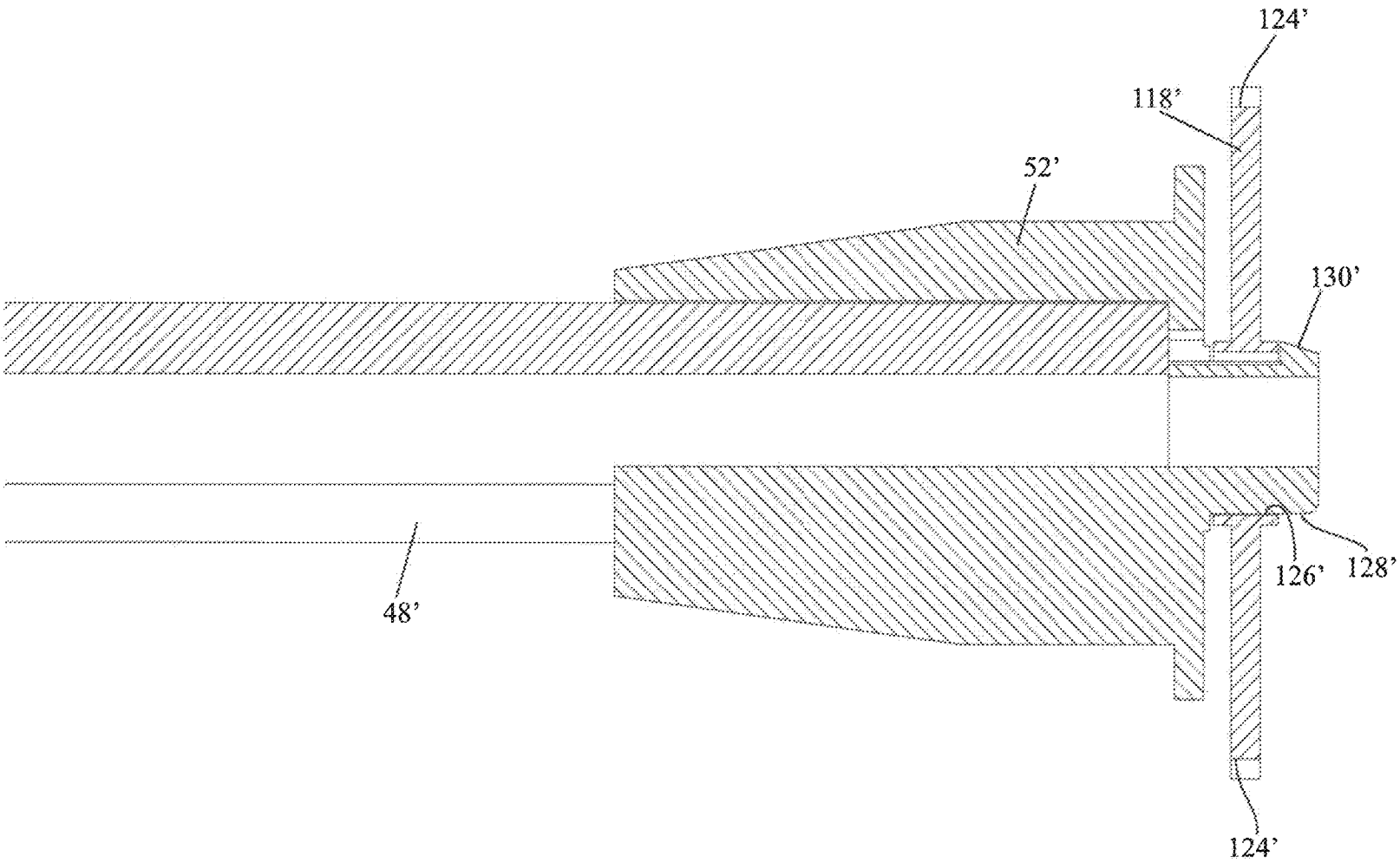
FIG. 30C illustrates a partially broken away, section view along line 30C-30C of FIG. 30A, showing the spring plug and rotator rail adaptor assembled onto a spring shaft.

Referring to FIGS. 30A-30C, the rotator rail adaptor 118' is a planar, generally rectangular element defining opposed flats 124'. It also defines a central through opening 126' which rides over the stub shaft 128' of the spring plug 52' and permits relative rotation between the rotator rail adaptor 118' and the stub shaft 128'. The stub shaft 128' defines an axial shoulder 130' which serves to lock the rotator rail adaptor 118' in the axial direction, to prevent it from slipping axially off of the spring plug 52'. The axial shoulder 130' tapers from a smaller diameter at the end of the stub shaft 128' to a larger diameter at its inner end. During assembly, the shoulder 130' flexes just enough to allow the rotator rail adaptor 118' to slide over the axial shoulder 130' during assembly, and then the shoulder 130' snaps back to its original position to rotationally lock the rotator rail adaptor 118' in place as shown in FIG. 30C.

Figure 35:
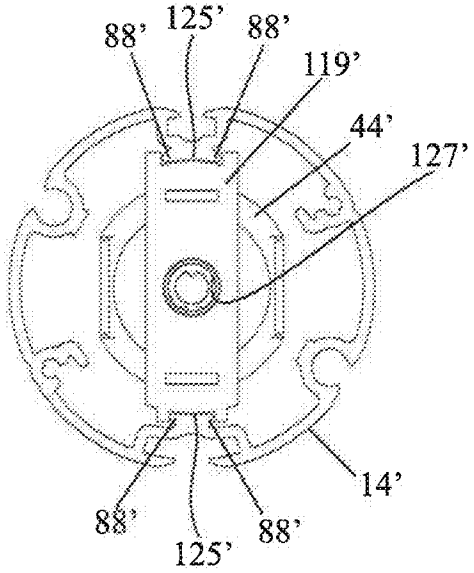
FIG. 35 illustrates an end view of the rotator rail adaptors of FIG. 32 showing how the additional rotator rail adaptor engages a 2" diameter rotator rail.
Figure 34:
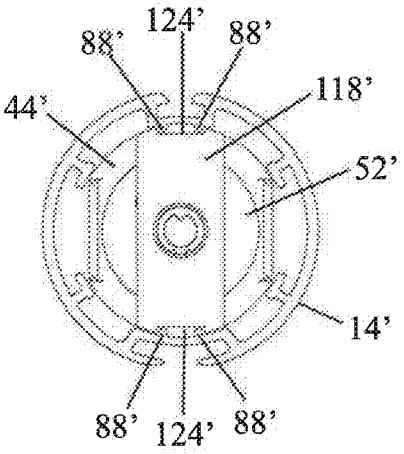
FIG. 34 illustrates an end view of the rotator rail adaptor of FIG. 30 showing how it engages a 1½" diameter rotator rail.
Figure 33:
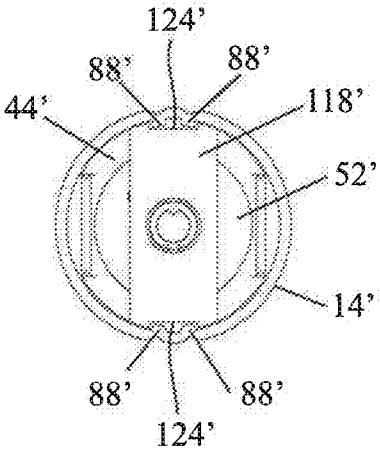
FIG. 33 illustrates an end view of the rotator rail adaptor of FIG. 30 showing how it engages a 1" diameter rotator rail.

FIGS. 33-34 show how the rotator rail adaptor 118' engages two different sizes of rotator rails 14', and FIG. 35 shows how a larger rotator rail adaptor 119 engages a still larger rotator rail 14'. As may be appreciated in FIG. 33, the rotator rail adaptor 118' engages the ribs 88' of the rotator rail 14'. This represents the smallest diameter rotator rail 14', which, in this particular embodiment, is a 1 inch diameter rotator rail. FIG. 34 shows the same rotator rail adaptor 118' installed in a slightly larger diameter rotator rail 14', in this case a 1½ inch diameter rotator rail. Again, the flats 124' of the rotator rail adaptor 118' engage the ribs 88' of this larger diameter rotator rail 14' which extend inwardly to the same position as the ribs 88' on the smaller diameter rotator rail 14'. The rotator rail adaptor 118' provides a bridge by which the rotator rail 14' supports the spring plug 52', which in turn supports the rod 24' (See FIG. 23), which supports the power assist module 12'.

Figure 22:
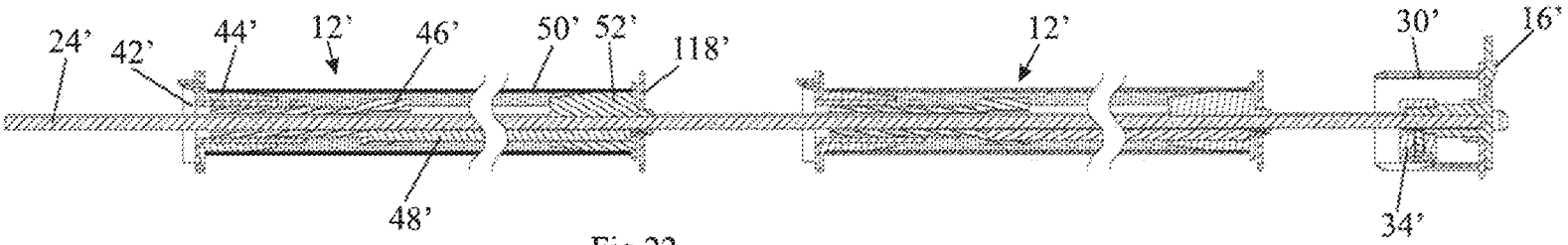
FIG. 22 illustrates a view along line 22-22 of FIG. 21.

Each power assist module 12' is supported at a first end by the drive plug 44' and the drive plug shaft 42' and at a second end by the spring plug 52'. Since the flats 98' of the drive plug 44' (See FIG. 27) and the flats 124' of the rotator rail adaptor 118' (See FIG. 33) engage the ribs 88' of the rotator rail 14', the rotator rail 14' supports the drive plug 44' and rotates with the drive plug 44' and with the rotator rail adaptor 118'. If two power assist modules 12' are located close together, as shown, for example, in FIG. 22, it may not be necessary to have a rotator rail adaptor 118' on the second end of one power assist module 12' (for example on the second end of the module on the left in FIG. 22), because the rod 24' is adequately supported by the drive plug 44' at the first end of the adjacent power assist module 12' (for example, the drive plug 44' of the module 12' on the right in FIG. 22). FIG. 22 does show the use of a rotator rail adaptor 118' at the second end of the power assist module 12' on the left, but it would not be necessary in this instance. Note that the rotator rail adaptor 118' shown in FIG. 23 also may not be necessary, since the rod 24' of the power assist module 12' is adequately supported by the shaft 132' of the nearby bracket clip 16'.

Figure 31:
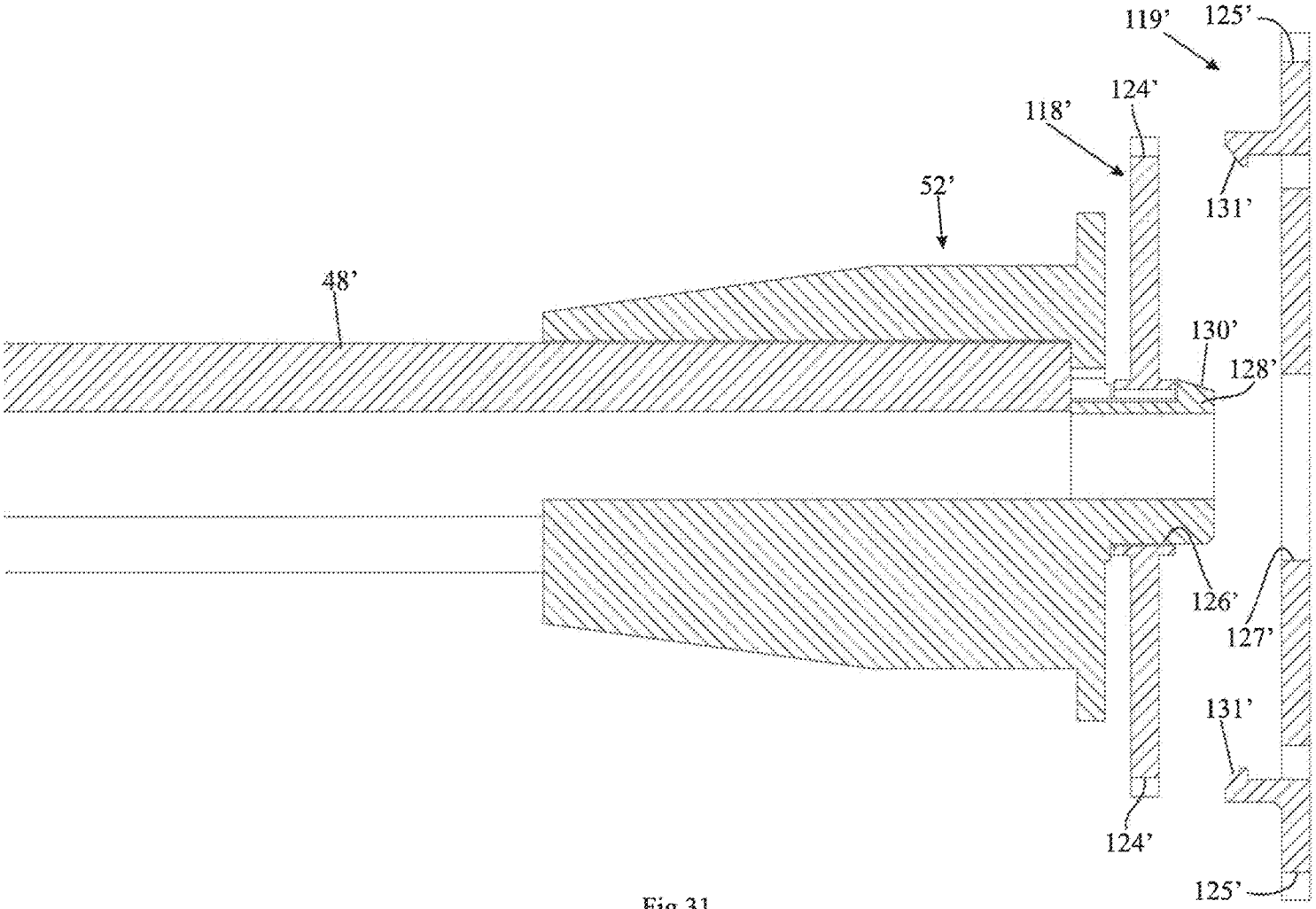
FIG. 31 illustrates a section view, similar to FIG. 30, but with an additional rotator rail adaptor ready to snap onto the existing rotator rail adaptor.
Figure 32:
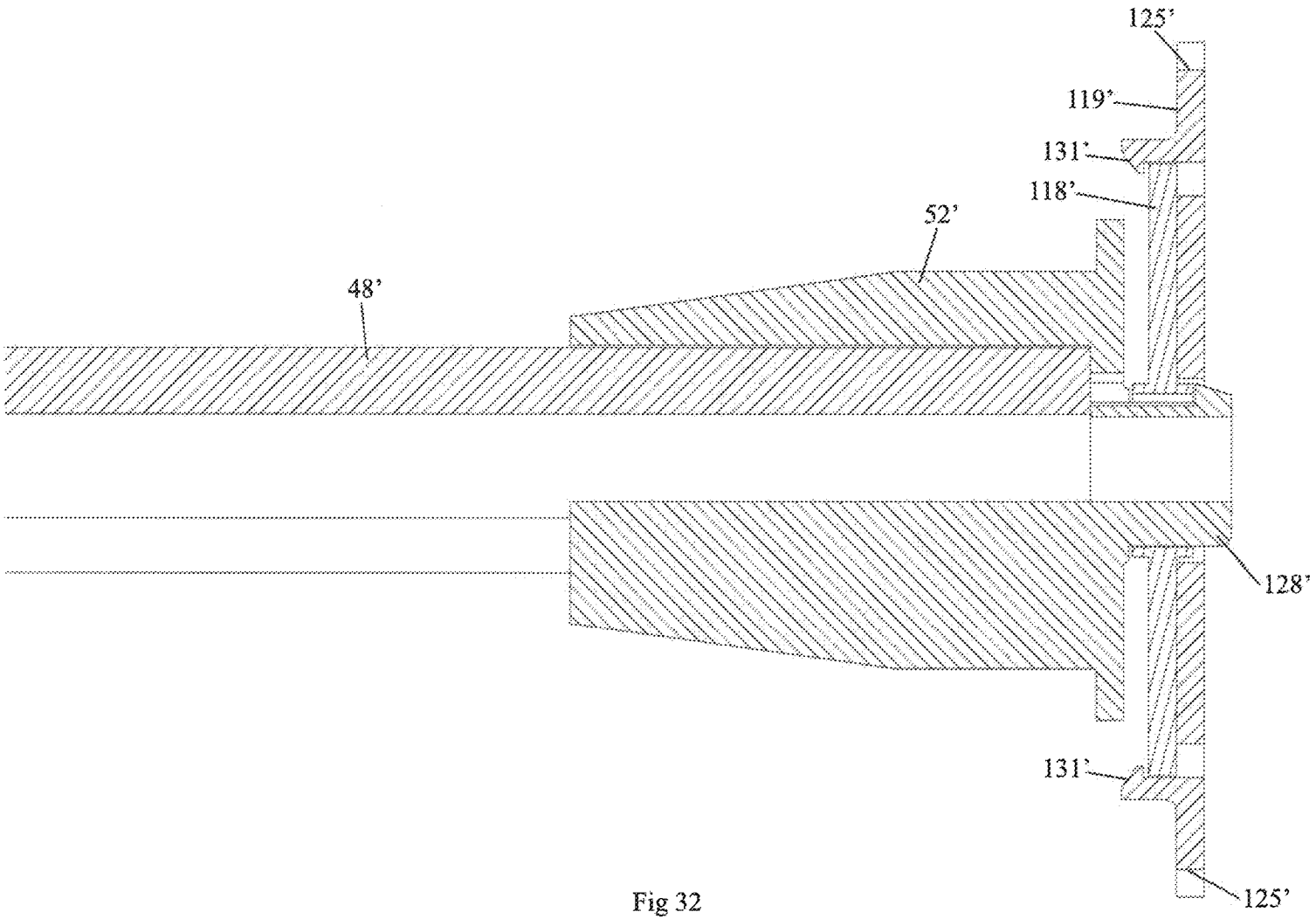
FIG. 32 illustrates a section view, similar to FIG. 31 but showing the additional rotator rail adaptor snapped onto the existing rotator rail adaptor.

FIGS. 31, 32, and 35 show a second, larger rotator rail adaptor 119' which is used for an even larger rotator rail 14', which, in this embodiment, is two inches in diameter. This second rotator rail adaptor 119' snaps over and locks onto the first rotator rail adaptor 118' with the aid of the hooks 131'. The second rotator rail adaptor 119' is a planar, elongated member defining flats 125' and a central through opening 127' which slides over the stub shaft 128' of the spring plug 52', which allows the second rotator rail adaptor 119' to rotate together with the first rotator rail adaptor 118'. As best illustrated in FIG. 35, the flats 125' of the second rotator rail adaptor 119' engage the ribs 88' of this larger diameter rotator rail 14'.

Figure 23:
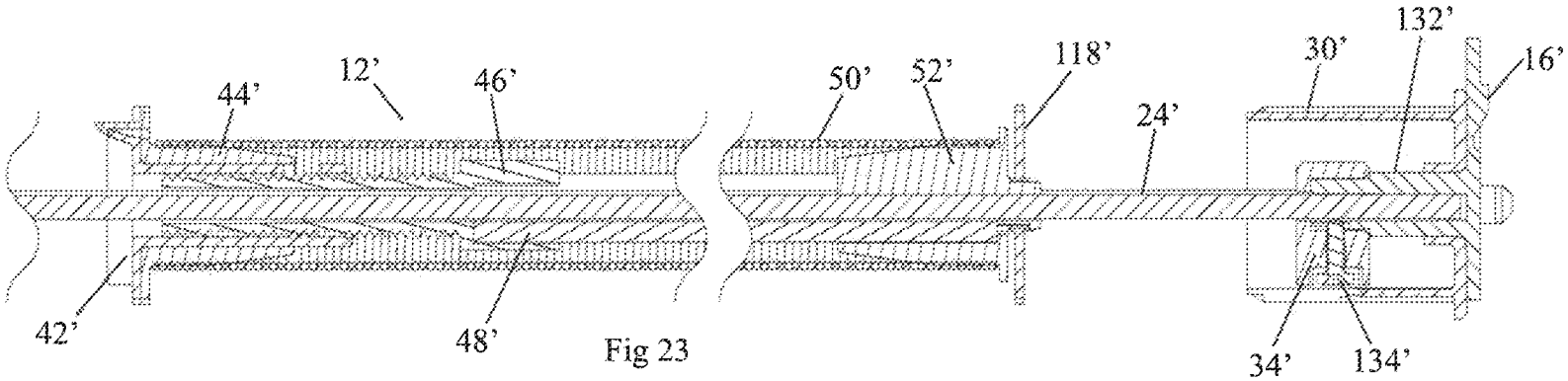
FIG. 23 illustrates an enlarged view of the right end portion of FIG. 22.

FIGS. 18 and 23 show the coupler 34' which, in this embodiment, secures the rod 24' for non-rotation relative to the non-drive end bracket clip 16'. As indicated above, FIGS. 39-41 show another embodiment of a roller shade 10" in which the same coupler 34' is used to secure the rod 24' to the mechanism 18' at the drive end of the roller shade. The use of the coupler 34' to secure the rod 24' to the mechanism 18' at the drive end of the roller shade will be described first.

Referring to FIGS. 39-41, the coupler 34' is a sleeve defining an axial through-opening 138' which receives both the rod 24' and at least a portion of a shaft 132' projecting from the mechanism 18'. The shaft 132' has an internal cross-sectional profile which matches up with and receives the non-circular, V-notch profile of the rod 24' for positive engagement between these two parts. The coupler 34' also defines a radially-directed threaded opening 136' which is aligned with an opening 132A' in the shaft 132'. (See FIG. 41) A securing screw 134' is threaded into the threaded opening 136' of the coupler 34' and through the opening 132A' in the shaft 132' and presses against the rod 24', pressing the V-notch of the rod 24' against the corresponding V-projection in the inner surface of the shaft 132'. This securely locks the rod 24' to the mechanism 18', preventing both rotational and axial motion (sliding motion) of the rod 24'. As may be seen in FIGS. 18 and 23, the same coupler 34' is used to securely lock the rod 24' to the non-drive end bracket clip 16', preventing both rotational and axial motion of the rod 24'.

From the above description, one of ordinary skill in the art will appreciated that the embodiments of the shades 10' and 10" operate in substantially the same manner as the shade 10 described initially. The most substantial functional differences are the use of the coupler 34' to make it possible to secure the rod to either end of the shade and the design of the power assist modules so that only the spring plug 52' needs to line up with the V-notch of the rod 24' during assembly, with all the other components of the power assist module 12' being secured to the spring plug 52', thereby facilitating the assembly of the power assist modules 12' onto the rod 24'.

Figures 42, 43:
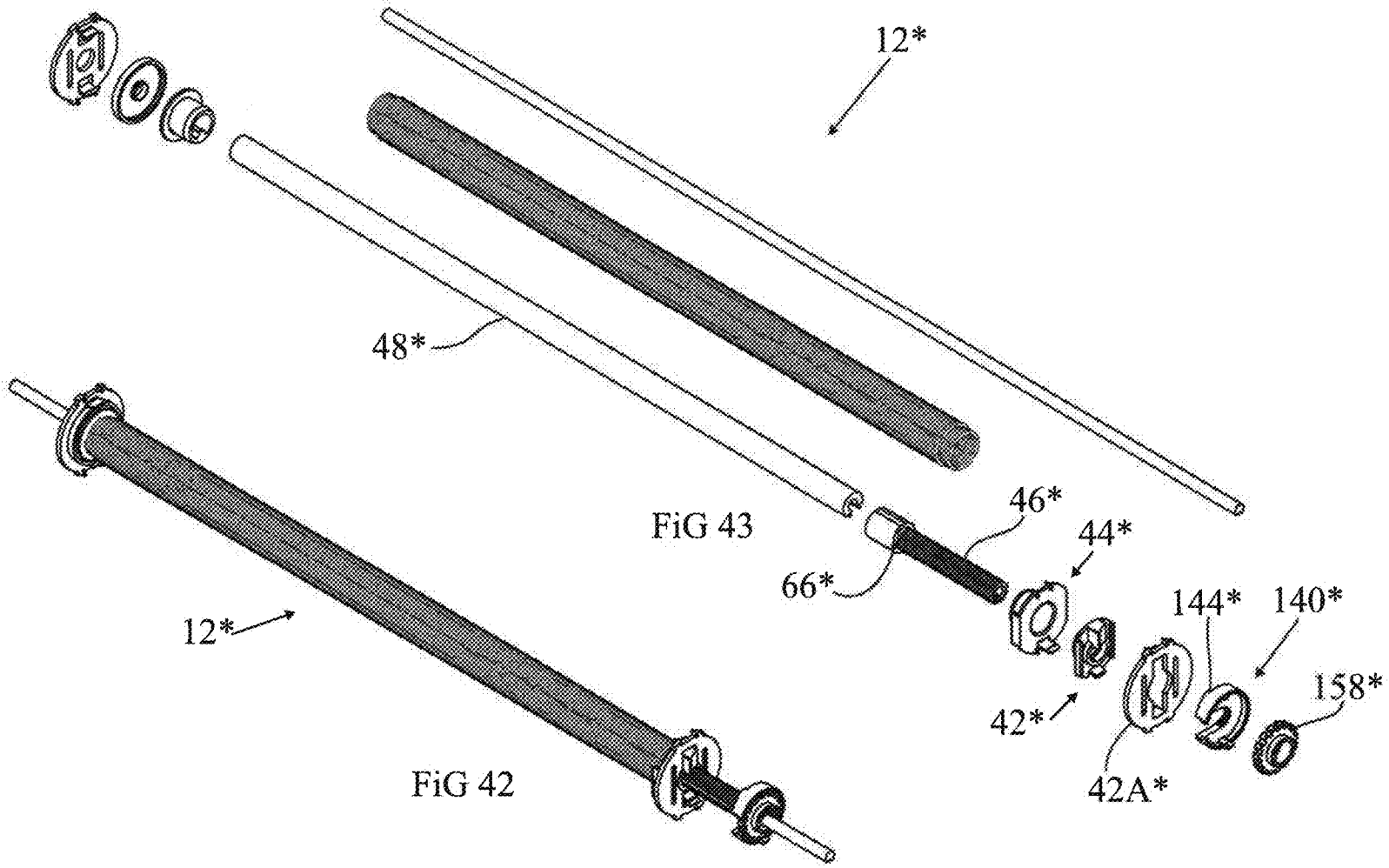
FIG. 42 illustrates a perspective view, similar to that of FIG. 19, but for another embodiment of a power assist module which incorporates both a top limiter and a bottom limiter.
FIG. 43 illustrates an exploded, perspective view of the power assist module of FIG. 42.

Referring now to FIGS. 42 and 43, another embodiment of a power assist module 12* is illustrated in accordance with aspects of the present subject matter. In general, the power assist module 12* is similar to the power assist module 12' of FIGS. 19 and 20, but it incorporates a second limiter 140*, as described in more detail below.

Figures 44, 45:
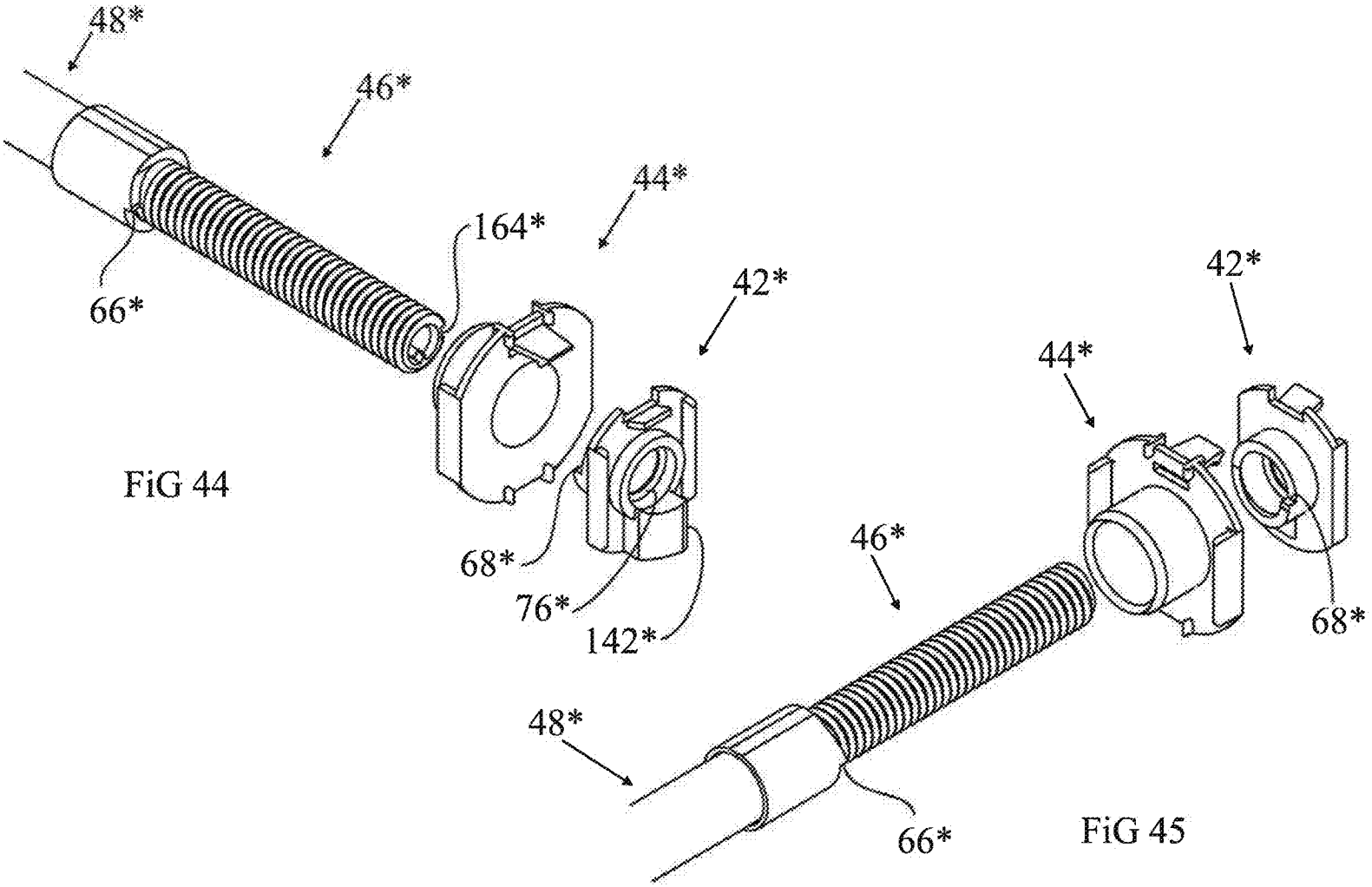
FIG. 44 illustrates a perspective view of the top limiter portion of the power assist module of FIG. 43.
FIG. 45 illustrates an opposite-end perspective view of the top limiter portion of the power assist module of FIG. 43.

Referring to FIGS. 43-45, it may be appreciated that the drive plug shaft 42* and the drive plug 44* are slightly different from the drive plug shaft 42' and the drive plug 44' of FIGS. 19 and 27. The drive plug shaft 42* and the drive plug 44* are shorter, but serve the same function as the earlier-described embodiments. Namely, in this embodiment 12*, the drive plug shaft 42* (See FIGS. 44 and 45) has a first axially-extending stop projection 68* which impacts against the shoulder 66* of the limiter 46* to limit the extent to which the drive plug shaft 42* can be threaded into the limiter 46* (and thus how far the drive plug shaft 42* can be rotated relative to the rod 24' to which the limiter 46* is keyed, as explained above with respect to the power assist module 12' of FIG. 20). The drive plug shaft 42* has ears that extend through and snap into slots in a roller tube adapter 42A*, which has recesses that receive the projections from the rotator rail 14 so that the drive plug shaft 42* and roller tube adapter 42A* rotate with the rotator rail 14.

In this embodiment of the power assist module 12*, the shoulder 68* of the drive plug shaft 42* works in conjunction with the shoulder 66* of the limiter 46* to act as a top stop, limiting how far the roller shade 10 can be raised. As explained with respect to the previous embodiment 12', as the shade 10 is raised, the drive plug shaft 42* threads onto the limiter 46* until the shoulder 68* on the drive plug shaft 42* impacts against the shoulder 66* of the limiter 46* to bring the shade 10 to a stop. The drive plug 44* may be briefly separated from the drive plug shaft 42* and rotated about the longitudinal axis of the limiter 46* to adjust the amount of "pre-wind" on the shade 10 and then snapped back together.

It should be appreciated that, similar to the embodiments described above, it may be desirable to form the drive plug shaft 42* and the limiter 46* (or at least the portions of such components forming the stops or shoulders 66*, 68*) from a durable type of material(s) having suitable material properties so as to prevent damage to one or both of the shoulders 66*, 68* as the shoulders 66*, 68* contact each other. For instance, in one embodiment, both the drive plug shaft 42* and the limiter 46* (or at least the portions of such components forming the shoulders 66*, 68*) may be formed from a metal material (e.g., aluminum, steel, or any other suitable metal) such that metal-on-metal contact is provided at the interface between the shoulder 66*, 68* when the roller shade 10 is retracted. It should also be appreciated that, similar to the embodiments described above, the internal threads 76* of the drive plug shaft 42* may be formed integrally therewith or, as will be described below with reference to FIGS. 67-69, the internal threads may be defined by a separate, threaded insert positioned within the drive plug shaft 42*.

One difference between the drive plug shaft 42* of this embodiment and the drive plug shaft 42' of the previous embodiment is that the drive plug shaft 42* of this embodiment includes a second axially-extending stop projection 142* (See FIG. 44) which impacts against the shoulder 144* of the second limiter 140* (also referred to as a locking ring 140*) to limit the extent to which the drive plug shaft 42* can be threaded out of the limiter 46*, thereby providing a bottom stop as well as a top stop, as explained in more detail below.

Figures 46A, 46B:
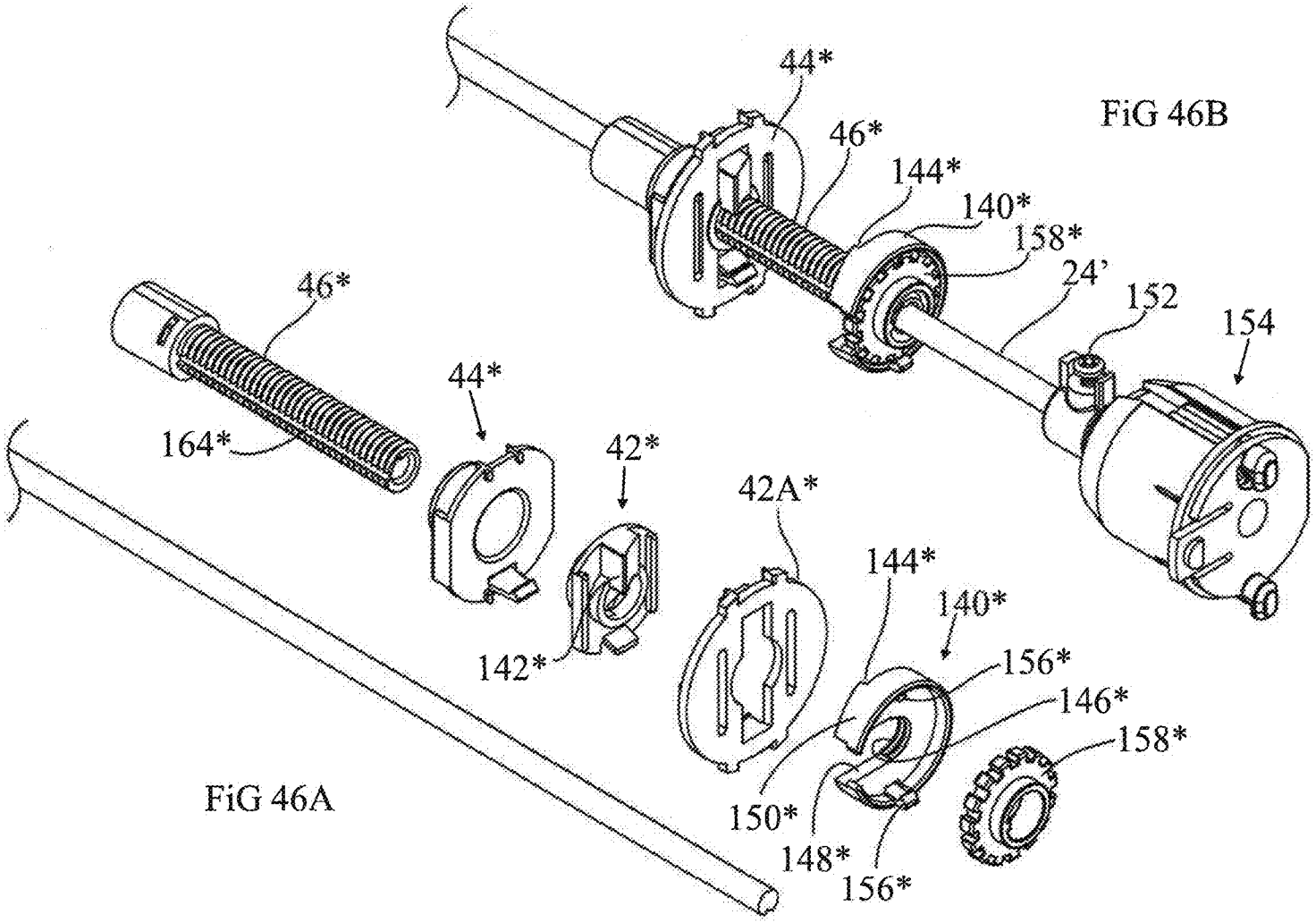
FIG. 46A illustrates an exploded, perspective view of the limiters portion of the power assist module of FIG. 43.
FIG. 46B Illustrates a perspective view of the assembled components of FIG. 46A, also including a view of an idle end mounting adapter assembly for securing the rod to an end bracket.
Figure 48:
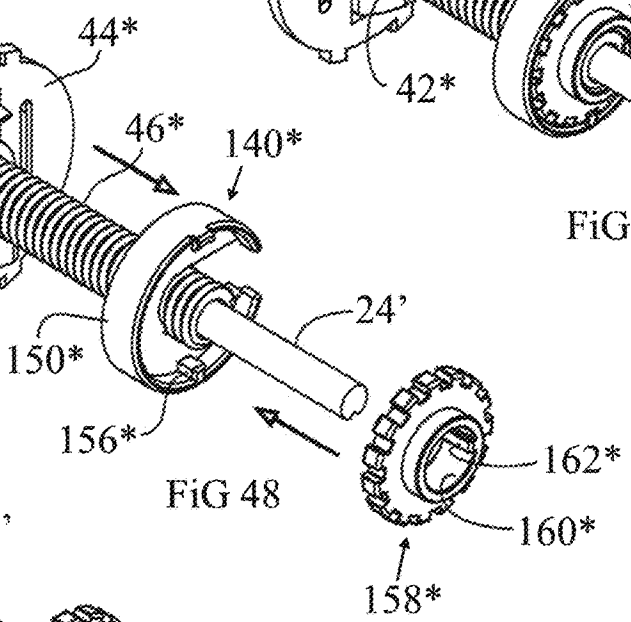
FIG. 48 illustrates a perspective view of the locking ring and locking nut portion of the bottom limiter portion of FIG. 46, during a second step of adjusting the bottom stop.

Referring to FIGS. 46A and 48, the locking ring 140* is a substantially circular disk defining a threaded central opening 146* and a slotted opening 148* extending from the threaded central opening 146* to the outer, circumferential flange 150* of the locking ring 140*. It should be noted that the slotted opening 148* is a convenience feature to allow the locking ring 140* to be slide-mounted onto the limiter 46* instead of having to disengage the power assist module 12* from the shade 10 (which could be done by loosening the screw 152 in the idle end mounting adapter assembly 154 and sliding the rod 24' out of the idle end mounting adapter assembly 154, as explained in more detail later).

The circumferential flange 150* defines the axially-projecting shoulder 144* as well as a radially-directed, axially-extending prong 156* which projects inwardly from the circumferential flange 150* and serves to lock the locking ring 140* to the locking nut 158*, as explained below.

Figure 49:
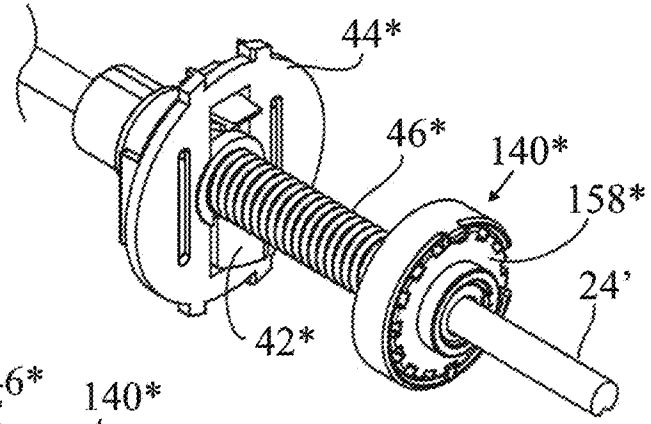
FIG. 49 illustrates a perspective view of the locking ring and locking nut portion of the bottom limiter portion of FIG. 46, during a final step of adjusting the bottom stop.
Figure 47:
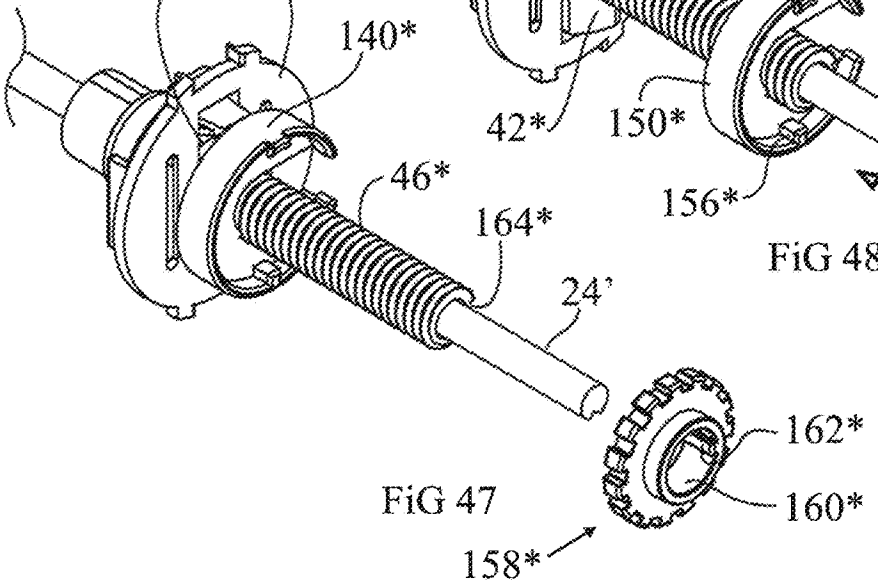
FIG. 47 illustrates a perspective view of the locking ring and locking nut portion of the bottom limiter portion of FIG. 46, during a first step of adjusting the bottom stop.

Referring to FIG. 47-49, the locking nut 158* resembles a geared wheel with an inner bore 160* defining a non-circular cross-sectional profile, including a key 162* designed to lock onto a slotted keyway 164* (See FIG. 47, this slotted keyway is better appreciated in FIG. 50) which extends axially along the length of the limiter 46*.

FIG. 47 shows the locking ring 140* abutting the drive plug shaft 42* such that the shoulder 142* on the drive plug shaft 42* is impacting against the shoulder 144* on the locking ring 140*. To adjust the bottom limiter/locking ring 140*, the locking nut 158* is first pulled out from the circumferential flange 150* of the locking ring 140* as shown in FIG. 47, sliding out the locking nut 158* axially along the length of the limiter 46*. This frees the locking ring 140* to be partially unscrewed along the limiter 46*, away from the drive plug shaft 42*, as shown in FIG. 48. Every complete turn of the locking ring 140* equals one complete rotation of the shade 10. Once the locking ring 140* has been unscrewed the correct number of turns to equal the desired lower limit of the shade 10, the locking nut 158* is reinserted into locking ring 140* as shown in FIG. 49, such that one of the geared teeth of the locking nut 158* engages the prong 156* of the locking ring 140*, and the key 162* of the locking nut 158* engages the slotted keyway 164* of the limiter 46*. This locks the locking ring 140* against rotation relative to the limiter 46*, which in turn is locked against rotation relative to the rod 24' and therefore also relative to the bracket 16 to which the rod 24' is secured. Now, as the shade 10 is lowered, the drive plug shaft 42* and the drive plug 44* rotate together. The inner threads 76* (See FIG. 44, but shown more clearly in FIG. 9, item 76) of the drive plug shaft 42* engage the limiter 46*, causing the drive plug 42* and drive plug 44* to travel toward the right (as seen from the vantage point of FIG. 49), until the shoulder 144* (See FIG. 46A) on the locking ring 140* impacts against the shoulder 142* on the drive plug shaft 42*, bringing any further lowering of the shade 10 to a stop. Note that the limiter 46* does not rotate as it is keyed against rotation relative to the rod 24'.

The idle end mounting adapter assembly 154 of FIG. 46B is substantially similar to the assembled components 16', 30' and 34' of FIGS. 17 and 18 described in an earlier embodiment and function in substantially the same manner for securing the rod 24' to the idle end bracket (opposite the drive end) of the shade 10.

The power assist module 12* described above can be adjusted by removing the locking nut 158*, unscrewing the locking ring 140*, and then reinstalling the locking nut 158*. If the bottom hem 194 (See FIGS. 56-58) of the shade 10 still is not in the desired location, the procedure may be repeated until the hem is as close to the desired location as possible. It may not be possible to get the hem to the exact location desired because the locking ring 140* may only be moved in discreet increments dictated by the position of the key 162* in the locking nut 158* relative to the tooth on the locking nut 158* that engages the prong 156* on the locking ring 140*.

Figure 50:
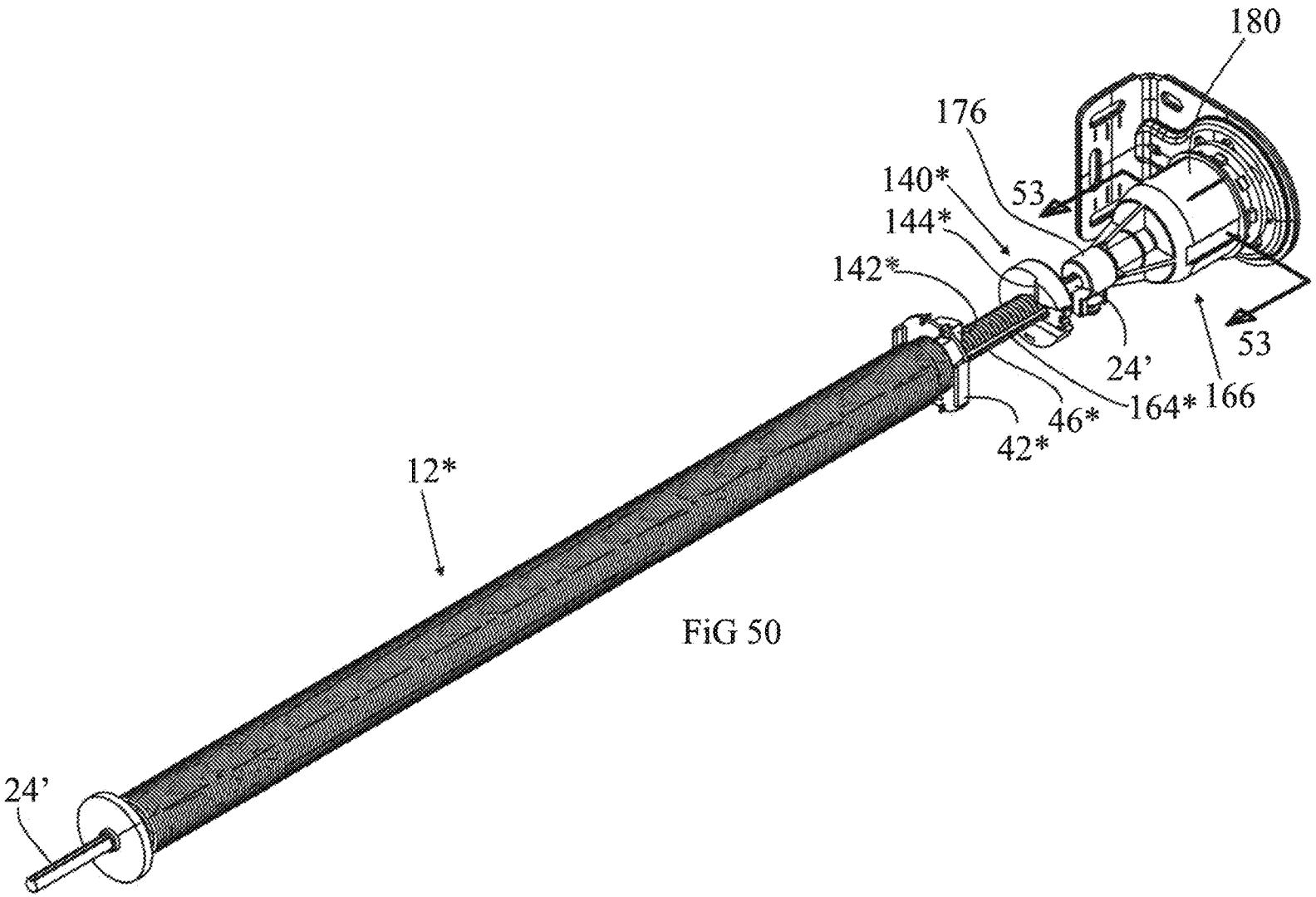
FIG. 50 illustrates a perspective view similar to that of FIG. 42, but of another embodiment of a power assist module which incorporates both a top limiter and an infinitely adjustable bottom limiter in accordance with aspects of the present subject matter.

FIG. 50 depicts the power assist module 12* of FIG. 42, but with a vernier coupling and adjusting mechanism 166 for securing the end of the power assist module 12* to the mounting bracket of the shade 10* (See FIGS. 56-58) which allows very fine and infinitely adjustable control of the bottom hem of the shade 10*, without having to remove the shade from the brackets, as described below. Note that the shade 10* is a "reverse" shade, with the covering material 232 hanging down the room side of the shade instead of the more conventional instance where the covering material hangs down the wall side of the shade. However, it should be noted that the mechanism described herein may be used in either type of installation by simply flipping the shade and all of its components end for end.

As explained in more detail below, this vernier coupling mechanism 166 allows for the rotational repositioning, relative to the end brackets, of the entire non-rotational portion of the shade 10* by selectively adjusting the angular position of the rod 24' relative to the mounting bracket 172. This rotationally repositions both the top and bottom stops to either raise or lower the shade 10*, but only when the input is by the user pushing on the adjustment tabs 228 (See FIG. 56), not when the input is from the shade 10* impacting against either of the top or bottom stops.

Figure 51:
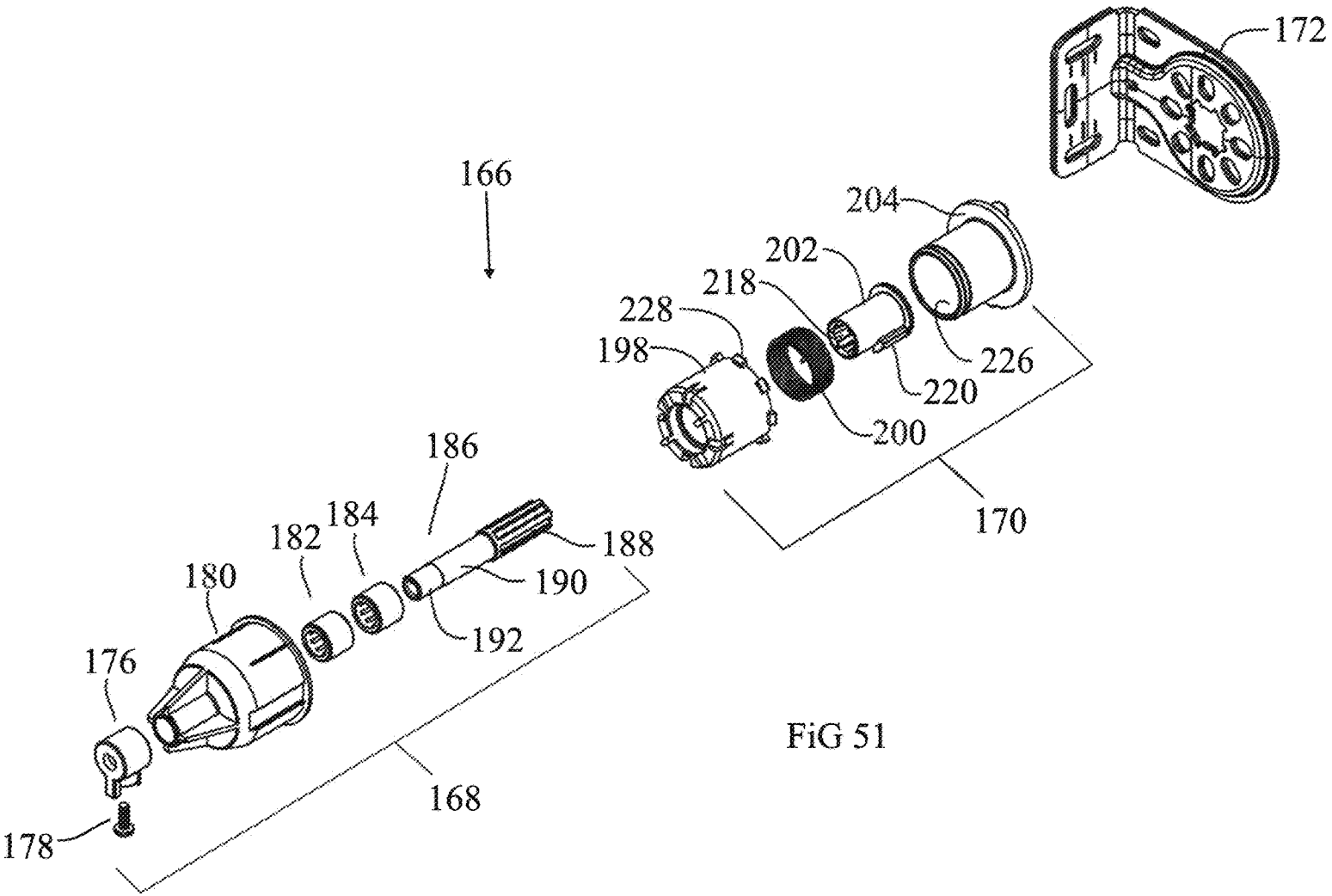
FIG. 51 illustrates an exploded, perspective view of the infinitely adjustable portion of the bottom stop limiter of FIG. 50.
Figure 57:
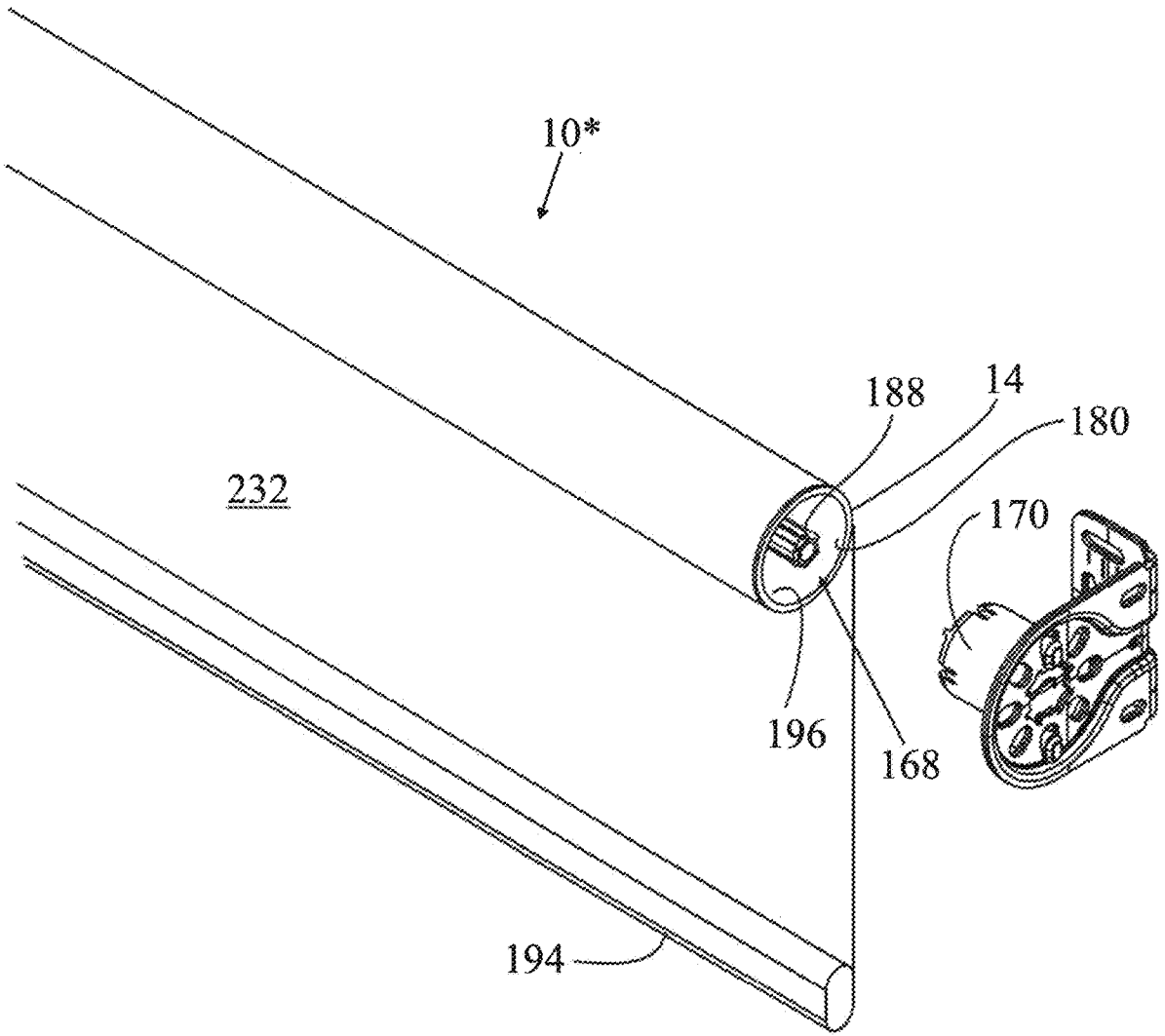
FIG. 57 illustrates a broken away, partially exploded, perspective view of the shade of FIG. 56.

FIG. 51 is an exploded, perspective view of the coupling mechanism 166 of FIG. 50. The coupling mechanism 166 has two distinct assemblies; a first portion 168 which mounts to the power assist module 12* and the tube 14' (See FIG. 17) of the shade 10*, and a second portion 170 which mounts to the idle end bracket 172 of the shade 10* as seen in FIG. 57.

The first portion 168 includes a coupler 176 and screw 178, a tube plug 180, two needle bearings 182, 184, and an idle end shaft 186. The idle end shaft 186 includes a distal, a male spline portion 188, a smooth tubular section 190 for supporting the tube plug 180 for rotation via the two needle bearings 182, 184, and a proximal end portion 192 which is used to secure the idle end shaft 186 to the connecting rod 24' via the coupler 176 and screw 178 in the same manner that the coupler 34' (See FIG. 23) and the screw 134' secure the rod 24' to the shaft 132' of the bracket clip 16'. Referring to FIG. 57, the tube 14 of the shade 10* mounts over and engages the tube plug 180, with the male spline portion 188 of the idle end shaft 186 in the "bell housing" 196 of the tube plug 180. The tube plug 180 spins freely with the tube 14 on the idle end shaft 186.

Referring back to FIG. 51, the second portion 170 (also referred to as the bracket clip assembly 170) of the coupling mechanism 166 includes a clutch output housing 198, a spring 200, a clutch input 202, and a bracket clip housing 204. As explained in more detail below, this bracket clip assembly 170 acts as a clutch assembly which allows the rotation of the clutch output housing 198 in both clockwise and counterclockwise directions, and with it the likewise rotation of the clutch input 202, which then rotates the rod 24'. Since the rod 24' is keyed to the limiter 46*, the limiter rotates likewise, as well as the locking ring 140* which is also locked to the limiter 46* via the locking nut 158*.

If, when the limiter 46* has threaded into the drive plug shaft 42* until the shoulder 144* on the locking ring 140* is impacting against the shoulder 142* of the drive plug shaft 42*, the clutch output housing 198 is turned in the counter-clockwise direction (as seen from the vantage point of FIG. 56), all the components connected to it and described above (namely the clutch input 202, the idle end shaft 186, the limiter 46*, and the locking ring 140*) will turn with it in the same direction. The shoulder 140* on the locking ring 140* pushes against the shoulder 142* of the drive plug shaft 42* which causes the tube 14 of the shade 10* to rotate so as to raise the hem 194. If instead the clutch output housing 198 is turned in the clockwise direction, all the components rotate likewise and the shoulder 140* on the locking ring 140* moves away from the shoulder 142* of the drive plug shaft 42* which causes the weight of the cover material 232 of the shade 10* to rotate the tube 14 of the shade 10* so as to lower the hem 194. However, if the clutch input 202 is pushed in either direction (because one of the shoulders 142*, 68* (See FIG. 44) of the drive plug shaft 42* is impacting against the corresponding shoulders 144* or 66* of the bottom stop and top stop respectively) the bracket clip assembly 170 locks up and does not allow rotation which brings the shade 10* to a stop, either at the top or at the bottom as explained in more detail below.

Figure 52:
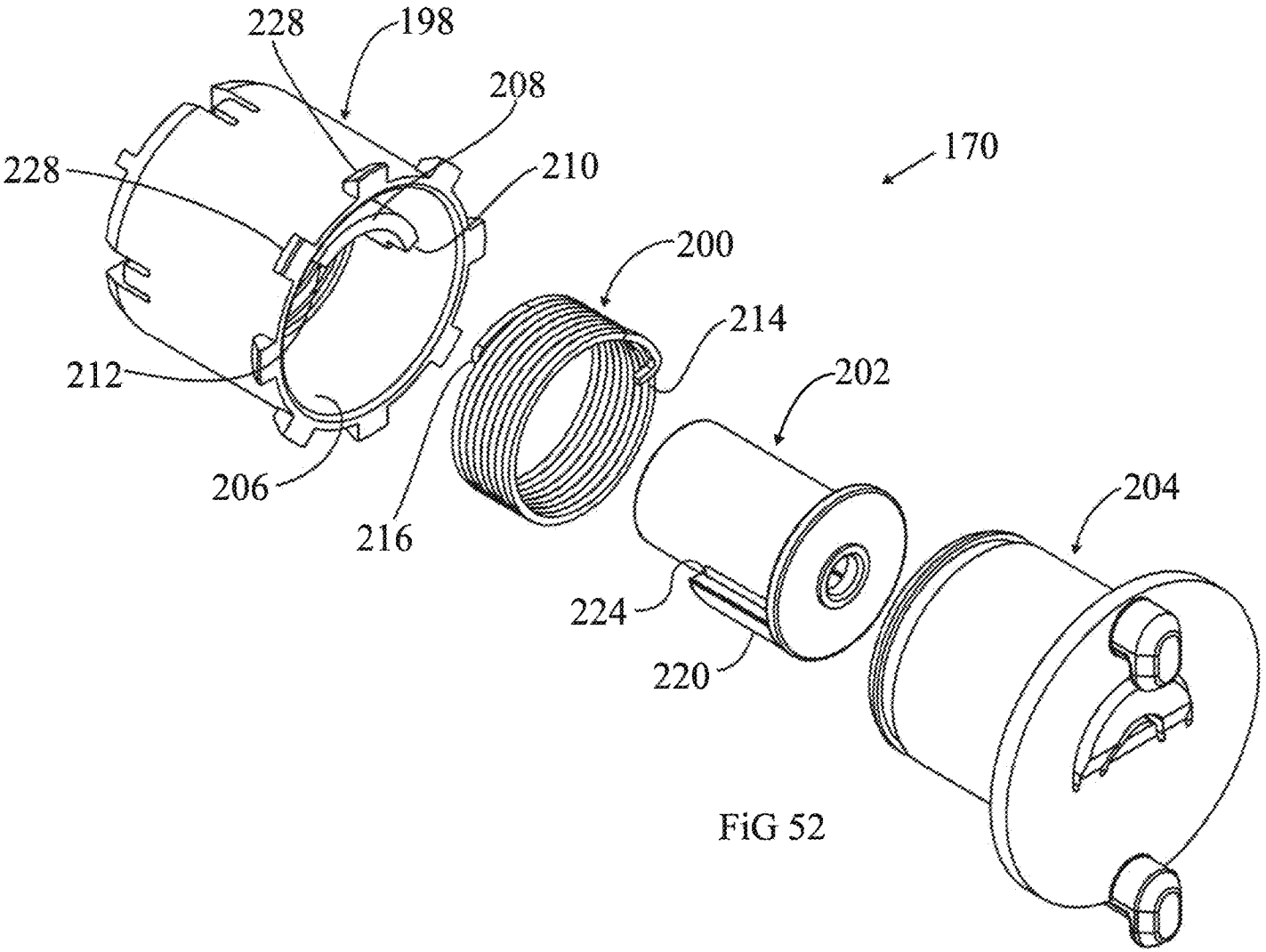
FIG. 52 illustrates an exploded, perspective view of the bracket clip assembly of FIG. 51.

FIG. 52 offers a more detailed, opposite-end perspective view of the bracket clip assembly 170 of FIG. 51. The clutch output housing 198 is a substantially cylindrical element which defines an internal cavity 206 which is open at both ends. An arcuate rib 208 protrudes into the cavity 206, as best appreciated in FIGS. 53-55. This rib 208 defines first and second shoulders 210, 212 which may press against tangs 214, 126 respectively of the spring 200.

The clutch input 202 is also a substantially cylindrical element which has a bore with a female spline 218 (See FIGS. 51 and 53-55) which receives the male spline 188 of the idle end shaft 186. The clutch input 202 also has an axially-extending locking rib 220 which defines first and second shoulders 222, 224 which may press against tangs 214, 126 respectively of the spring 200.

Figure 58:
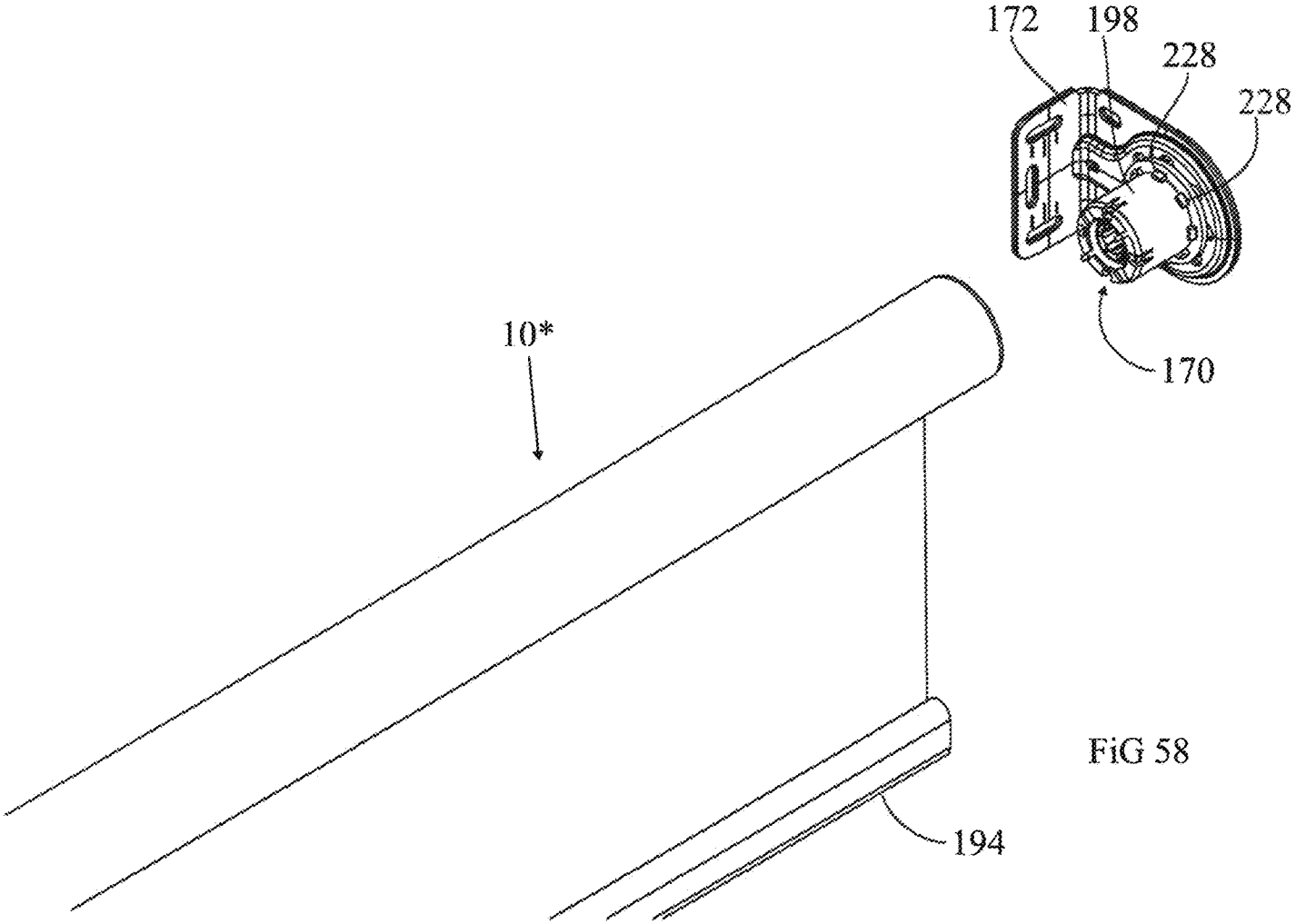
FIG. 58 illustrates a broken away, partially exploded perspective view of the shade of FIG. 56.

Finally, the bracket clip housing 204 is also a substantially cylindrical element which defines a cavity 226 (See also FIG. 51) sized to snuggly receive the spring 200, as well as the clutch input 202 and the rib 208 of the clutch output housing 198. However, the rest of the clutch output housing 198 slides over and snaps onto the bracket clip housing 204, as best seen in FIG. 58.

Figures 53, 54, 55:
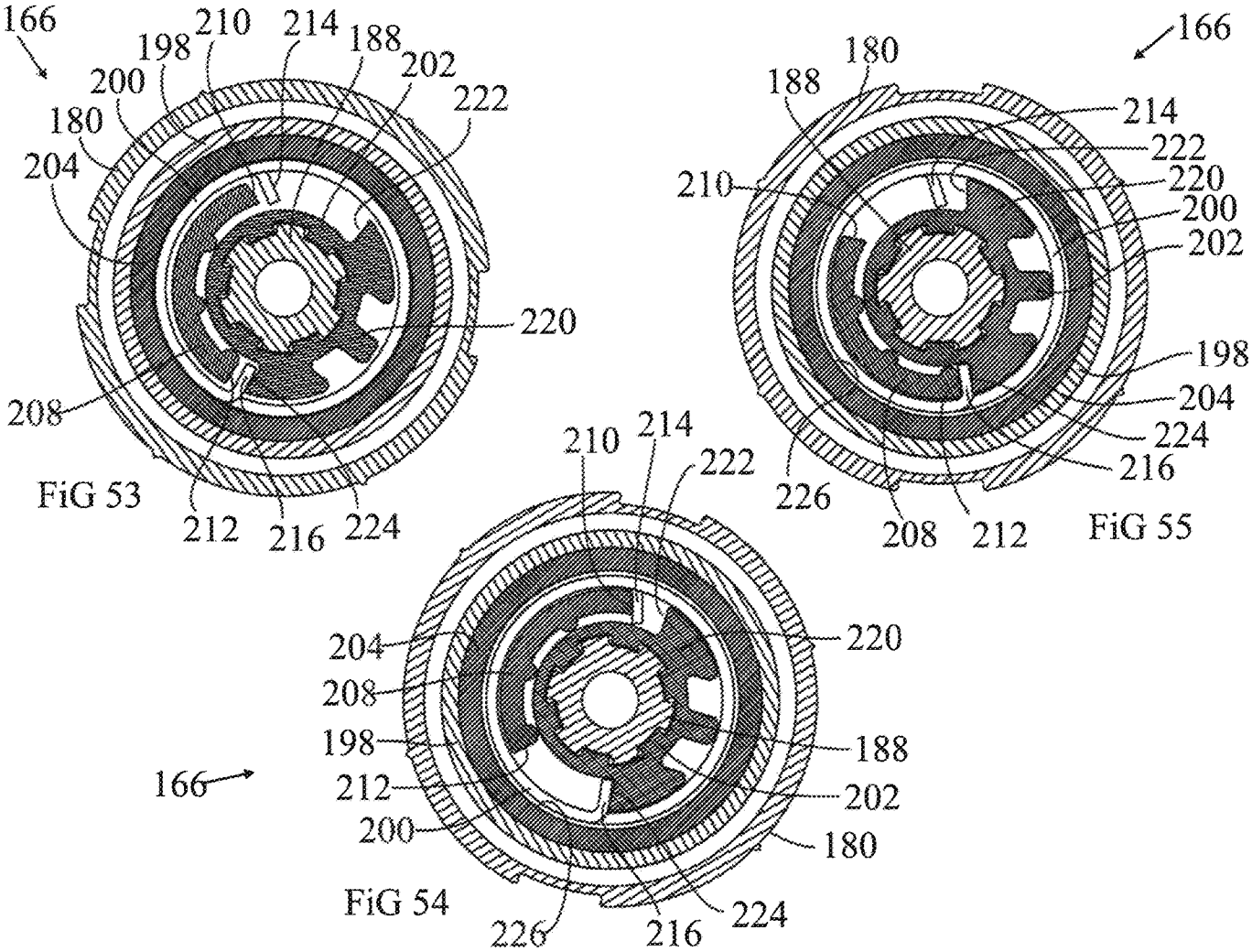
FIG. 53 illustrates a section view along line 53-53 of FIG. 50, with the clutch mechanism in the locked position
FIG. 54 illustrates a section view, similar to that of FIG. 53, but with the clutch mechanism allowing slippage of the clutch input so as to raise the hem of the shade.
FIG. 55 illustrates a section view, similar to that of FIG. 53, but with the clutch mechanism allowing slippage of the clutch input so as to lower the hem of the shade.

As shown in FIGS. 53-55 and as indicated above, the spring 200 fits snugly in the cavity 226 of the bracket clip housing 204. If one of the shoulders 222, 224 of the clutch input 202 hits against its corresponding tang 214, 216 of the spring 200, the spring 200 expands slightly and locks onto the inner surface of the cavity 226, preventing rotation of the clutch input 202 when such a rotation is initiated by the "input end" which corresponds to rotation initiated by shade 10* as it is fully raised or fully lowered.

As best illustrated in FIGS. 53-55, the rib 208 of the clutch output housing 198 also lies between the tangs 214, 216 of the spring 200. If one of the shoulders 210, 212 of the clutch output housing 198 hits against its corresponding tang 214, 216 of the spring 200, the spring 200 collapses slightly and pulls away from the inner surface of the cavity 226 (as may be appreciated in FIGS. 54 and 55), allowing rotation, not only of the clutch output housing 198, but also of the spring 200, the clutch input 202, and the assembly 168 (but not the bracket clip housing 204). For instance, in FIG. 55 the shoulder 212 of the clutch output housing 198 impacts against the tang 216 of the spring 200, which collapses slightly away from the inner surface of the cavity 226 of the bracket clip housing 204. The tang 216 pushes on the shoulder 224 of the clutch input 202 which therefore also rotates, and with it all the components locked in to the clutch input 202. The clutch output housing 198 may be rotated by the user by pushing on the tabs 228 (See FIGS. 52 and 56). Pushing on the tabs 228 in the direction depicted by the screwdriver 230 in FIG. 56 rotates the entire coupler mechanism 166 (but not the housing 204) in the counterclockwise direction (corresponding to rotation in the clockwise direction in FIG. 54). This rotates the locking ring 140*, changing the location of the stop 144*, such that, when the shade is fully extended, the stop 144* on the locking ring 140* impacts against the stop 142* on the drive plug shaft 42* at an earlier position, thereby further limiting the extension of the shade 10*.

Figure 56:
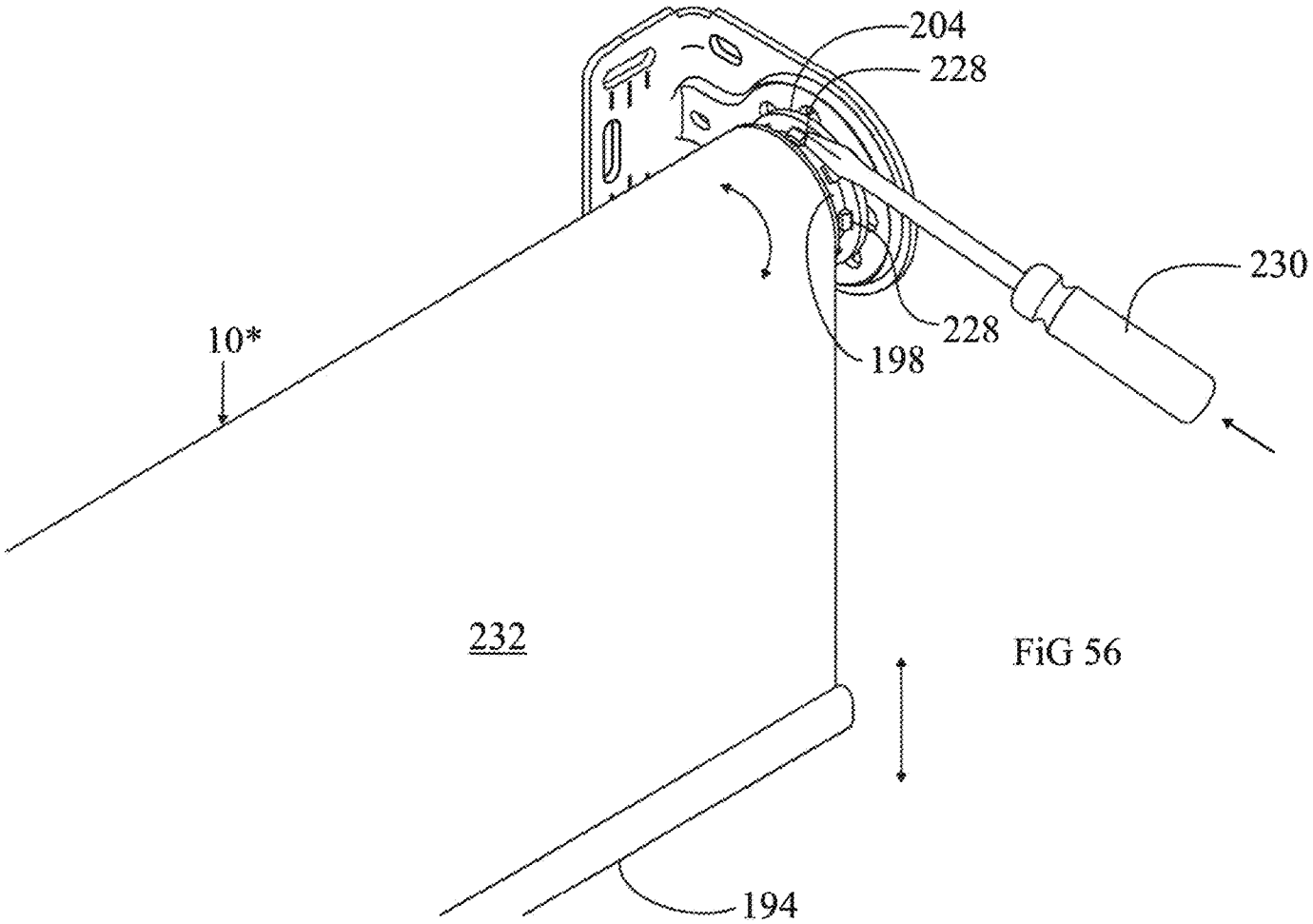
FIG. 56 illustrates a broken away, perspective view of a reverse shade with the stop of FIG. 50 being adjusted to raise or lower the bottom hem of the shade.

Pushing on the tabs 228 in the opposite direction from what is shown in FIG. 56 rotates the entire coupler mechanism 166 in the clockwise direction (corresponding to rotation in the counterclockwise direction in FIG. 55). This rotates the locking ring 140* such that the stop 144* on the locking ring 140* backs away from the stop 142* on the drive plug shaft 42*. The weight of the covering material 232 of the shade 10* causes it to rotate which lowers the hem 194 (such that the stop 142* on the drive plug shaft 42* is always abutting the stop 144* on the locking ring 140*).

To summarize, as long as the input is initiated by the user by pushing on the tabs 228 of the clutch output housing 198, the coupler mechanism 166 releases the shade 10* for rotation to adjust the position of the hem 194. However, if the input is initiated by the shade itself (either because the shoulder 68* on the drive plug shaft 42* is impacting the shoulder 66* on the limiter 46* (top stop) or because the shoulder 142* on the drive plug shaft 42* is impacting against the shoulder 144* on the locking ring 140* (bottom stop), then the coupler mechanism 166 locks up, stopping the shade 10* from further rotation.

Referring now to FIGS. 59-65, another embodiment of a power assist module 12 (including broken away view of the rotator tube 14) is illustrated in accordance with aspects of the present subject matter. The power assist module 12** includes a limiter-end roller tube adapter 42A**, a combined drive plug/drive plug shaft 44** (also referred to as a threaded follower member 44**), a limiter 46** (also referred to as a threaded shaft member 46**), a spring shaft 48**, a spring 50**, a spring plug 52**, and an opposite-limiter-end roller tube adapter 240**. Also included are a locking ring 140* and a locking nut 158*, both of which were described earlier with respect to a bottom limiter in the power assist module 12* of FIG. 43. Comparing the power assist module 12* of FIG. 43 with the power assist module 12** of FIG. 59, it may be appreciated that the power assist module 12** has a few differences from the module 12***, which can result in reduced manufacturing costs and greater ease of assembly, as discussed below.

Figure 59:
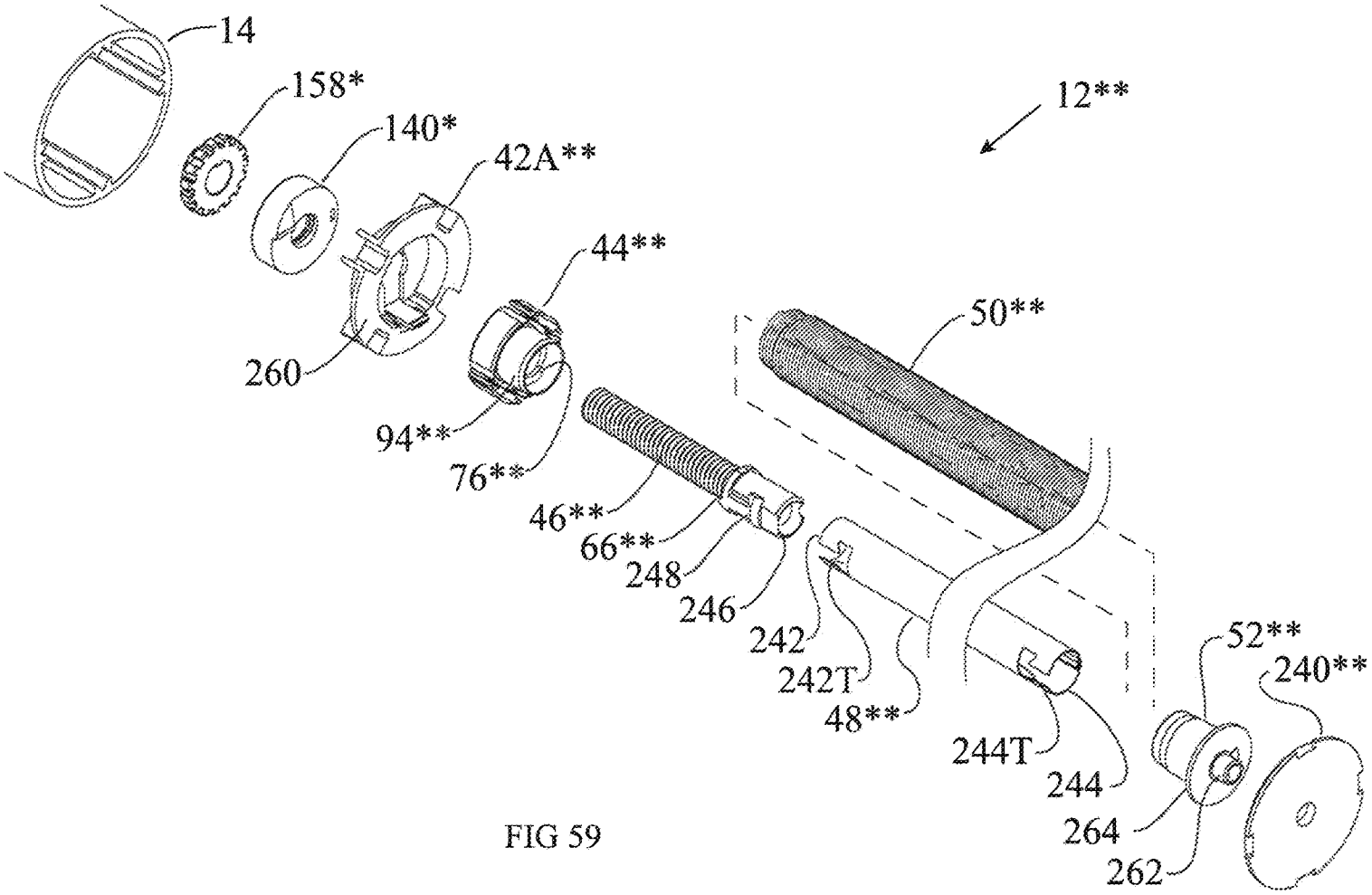
FIG. 59 illustrates an exploded perspective view of another embodiment of a power assist module in accordance with aspects of the present subject matter.
Figures 60, 61:
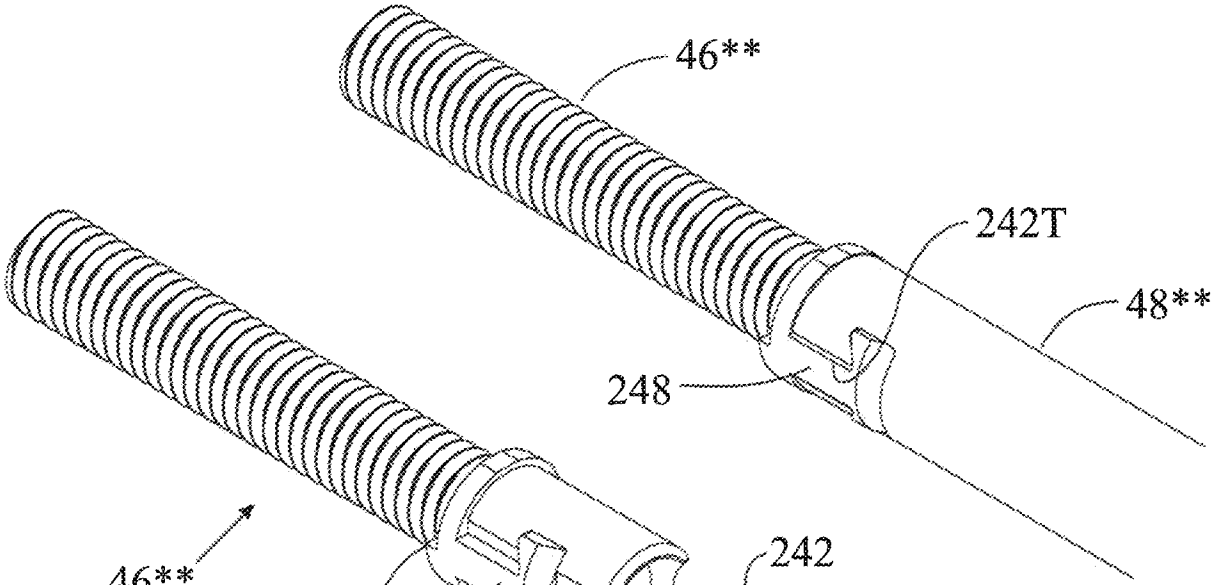
FIG. 60 illustrates a broken away, exploded perspective view of the limiter and the spring shaft of FIG. 59.
FIG. 61 illustrates broken away, assembled view of the limiter and the spring shaft of FIG. 60.
Figure 63:
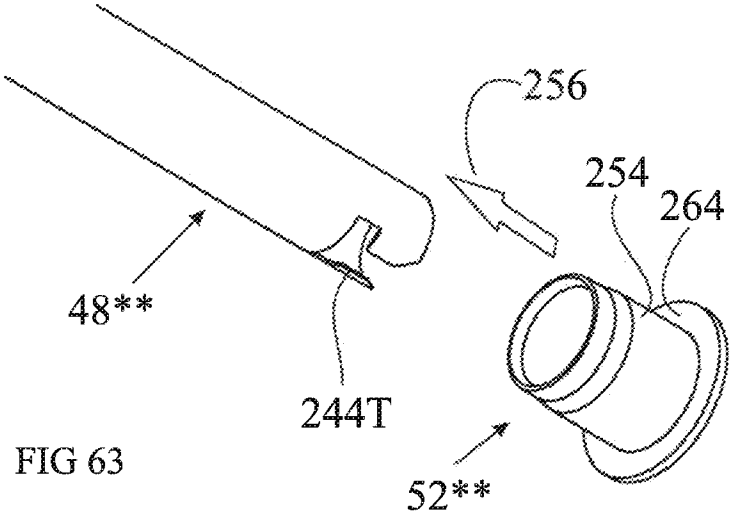
FIG. 63 illustrates the same view as FIG. 62 but from a different angle.
Figure 62:
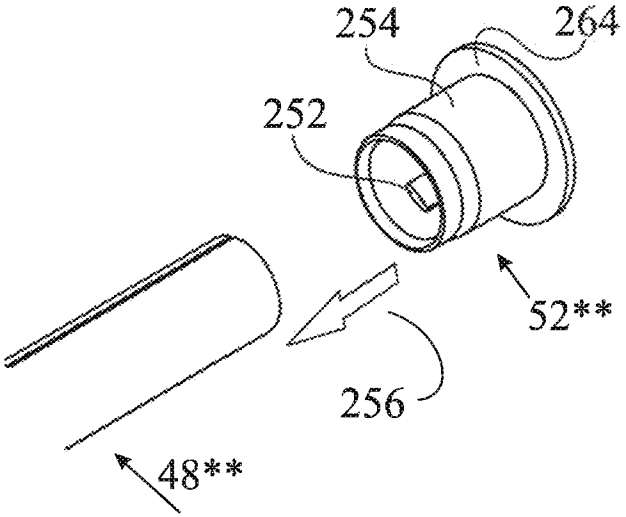
FIG. 62 illustrates a broken away, exploded perspective view of the spring shaft and the spring plug of FIG. 59.

In the module 12 of FIG. 59, the spring shaft 48** is a hollow, rolled lock seam tube providing a substantial savings in procurement cost over the previously described spring shafts 48, 48*. Referring to FIGS. 59 and 60, the spring shaft 48** is a hollow cylinder with identical ends 242, 244. Identical "T" slot openings 242T, 244T are defined adjacent to the ends 242, 244 of the spring shaft tube 48****.

The limiter 46 is similar to the limiter 46* of FIG. 43, except that it defines a 'T'-shaped projection 248 on the circumferential surface of the limiter 46** adjacent its non-threaded end 246. As best shown in FIG. 61, the end 246 of the limiter 46** slides into the end 242 of the spring shaft 48** (in the direction of the arrow 250 of FIG. 60), causing the hollow tubular spring shaft 48** to expand at the end 242 until the "T"-shaped projection 248 on the limiter 46** snaps into the "T" slot 242T, at which point the end 242 of the spring shaft 48** springs back to its original, unexpanded shape. The T-shaped projection 248 is then retained within the T-shaped slot 242T, so the spring shaft 48** and the limiter 46**** are positively engaged, both against rotation and against axial movement, relative to each other.

It may be noted that the T-shaped projection 248 has a ramped leading edge, for causing the spring shaft 48 to expand in order to receive the T-shaped projection 248, and it has an abrupt shoulder on its trailing edge, to help retain the T-shaped projection 248 within the slot 242**T once the projection has been received in the slot.

The spring plug 52 is similar to the spring plug 52 of FIG. 5 except that it does not have the striations 108. Instead, the spring plug 52** defines a hollow shaft 254 and an internal rectangular key 252 (See FIG. 62). The spring shaft 48** slides into the hollow shaft 254 of the spring plug 52** in the direction of the arrow 256 of FIGS. 62 and 63, allowing the internal rectangular key 252 of the spring plug 52** to slide into the "T" slot 244T (See FIG. 63) of the spring shaft 48**. Note that the key 252 has a rectangular shape; it is not T-shaped like the projection 248 on the limiter 46**. Therefore, the spring plug 52** is positively engaged for non-rotation relative to the spring shaft 48**, but the spring plug 52** may readily slide out axially along the 'T' slot 244T of the spring shaft 48**, as discussed later when describing the procedure for pre-winding the power assist module 12****.

Figure 64:
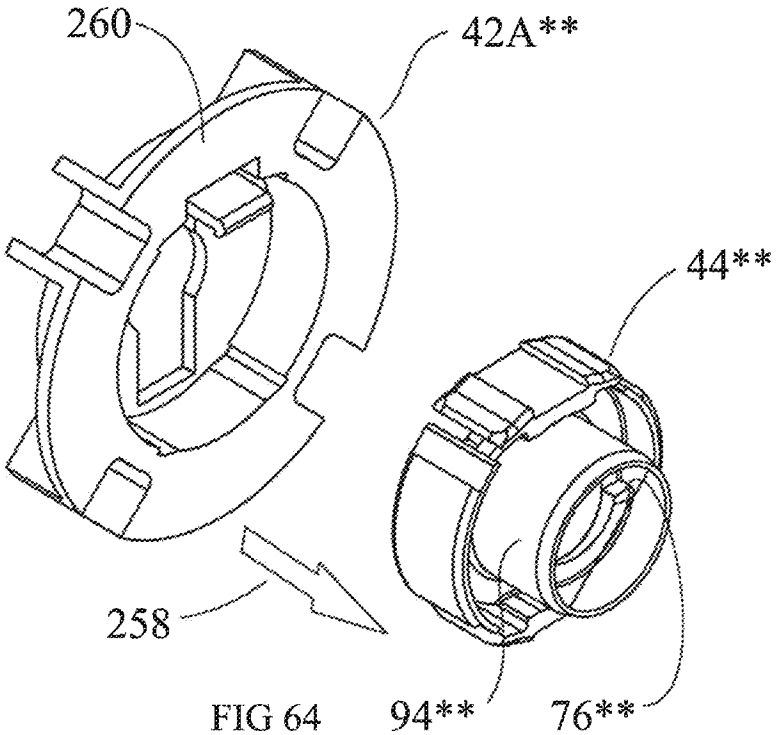
FIG. 64 illustrates an exploded perspective view of the roller tube adapter and the combination drive plug/drive plug shaft of FIG. 59.
Figure 65:
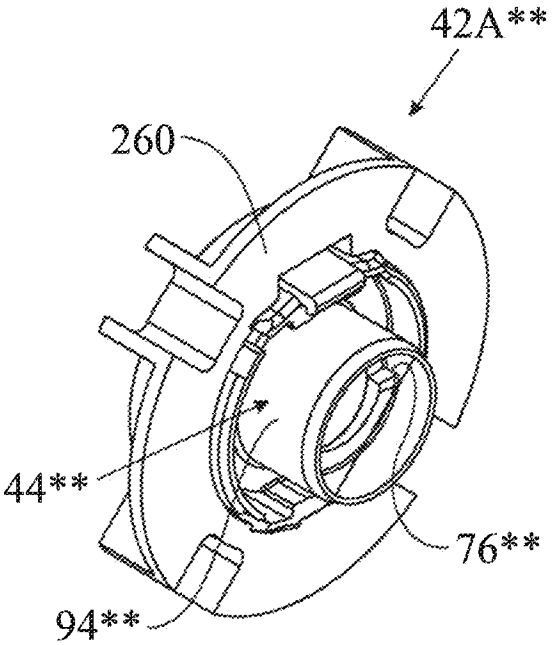
FIG. 65 illustrates a perspective view of the assembled roller tube adapter and the combination drive plug/drive plug shaft of FIG. 64.

Referring now to FIGS. 59 and 64, the threaded follower member 44 generally combines the drive plug shaft 42* and the drive plug 44* of the embodiment of FIG. 45 into a single component with all of the same operational features except the ability to rotate the drive plug 44* relative to the drive plug shaft 42* in order to pre-wind the spring 50*. As explained below, the pre-wind feature is still available in this power assist module 12** but is done a bit differently. The threaded follower member 44** is received in the limiter end roller tube adapter 42A** and they snap together by sliding the limiter end roller tube adapter 42A** towards the threaded follower member 44** in the direction of the arrow 258 (See FIG. 64**).

It should be appreciated that, similar to the embodiments described above, the threaded follower member 44 may include internal threads configured to threadably engage the threaded portion of the limiter 46**. In such an embodiment, the internal threads may be formed integrally with the threaded follower member 44**. Alternatively, as will be described below with reference to FIGS. 67-69, the internal threads may be defined by a separate, threaded insert positioned within the threaded follower member 44****.

It should also be appreciated that several different sizes of the limiter end roller tube adapter 42A may be available, each having a different outer diameter of its flange 260 so as to accommodate different size roller tubes 14 (See FIG. 59). Moreover, the opposite end roller tube adapter 240** is supported for rotation on the short shaft 262 of the spring plug 52** (See FIG. 59). This opposite end roller tube adapter 240** also is available in several diameter sizes to accommodate different size roller tubes 14**.

In several embodiments, the user assembles the power assist module 12 by sliding the end 246 of the threaded limiter 46** into the end 242 of the spring shaft 48** until the "T"-shaped projection 248 snaps into the T-slot 242T, locking the limiter 46** and spring shaft 48** together. The user then threads the limiter 46** into the follower member 44** until the radially-directed face of its axially-extending stop 66** abuts the corresponding internal, radially-directed face of the axially-extending stop 76** in the threaded follower member 44****.

It should be appreciated that, similar to the embodiments described above, it may be desirable to form the threaded follower member 44 and the limiter 46** (or at least the portions of such components forming the stops 66**, 76**) from a durable type of material(s) having suitable material properties so as to prevent damage to one or both of the stops 66**, 76** as the stops 66**, 76** contact each other. For instance, in one embodiment, both the threaded follower member 44** and the limiter 46** (or at least the portions of such components forming the stops 66**, 76**) may be formed from a metal material (e.g., aluminum, steel, or any other suitable metal) such that metal-on-metal contact is provided at the interface between the shoulder stops 66**, 76** when the roller shade 10** is retracted.

The threaded follower member 44 is snapped into the limiter-end roller tube adapter 42A, and a first end of the spring 50 is extended over the spring shaft 48** and limiter 46** and is "screwed" onto the shaft 94** of the threaded follower member 44**, by rotating the spring to drive it onto the threaded follower member 44**. Then, the user "screws" the second end of the spring 50** onto the spring plug 52** in a similar manner as the first end of the spring 50** was screwed onto the threaded follower member 44**. Note that, at this point the spring plug 52** is not yet engaged with the spring shaft 48****.

The user uses one hand to hold tightly to the flange 260 of the limiter-end roller tube adapter 42A, and the user uses his other hand to rotate the spring plug 52** at the opposite end of the spring shaft 48** in the clockwise direction (as seen from the vantage point of FIG. 59). Since the second end of the spring 50** is secured to the spring plug 52**, this second end of the spring 50** rotates with the spring plug 52**. The user continues to rotate the spring plug 52** until the desired amount of pre-wind on the spring 50** is reached. Then, the user simply slides the spring plug 52** in the direction of the arrow 256 (See FIG. 63) until the key 252 engages the T-slot 244T in the spring shaft 48**. This prevents the spring 50** from unwinding relative to the spring shaft 48**, thereby retaining the prewind of the spring 50****.

In a preferred embodiment, the length of the spring 50 is substantially equal to the length of the power assist module 12** between the face of the flange 260 of the limiter-end roller tube adapter 42A and the face of the flange 264 on the spring plug 52** when the limiter 46** is fully threaded into the threaded follower member 44**. This ensures that, once the spring 50** has been pre-wound and the key 252 is in the T-slot 244T, the spring tension helps keep the spring plug 52** in the spring shaft 48**** so as to preserve the pre-wind condition.

The rest of the assembly, including the installation of the locking ring 140* and the locking nut 158* and the installation of the power assist module 12 in the roller shade, is identical to what has already been described in the earlier embodiments. For example, a rod 24 as shown in FIG. 3 is inserted through the limiter 46** and spring shaft 48** and through the adapters 42A and 240** and is mounted on the bracket clip 16. This power assist module 12** operates in the same manner as the earlier embodiments, with the changes described essentially affecting only the cost of the components and the ease of assembly and of adjustment for the desired degree of pre-wind on the spring 50****.

Figure 66:
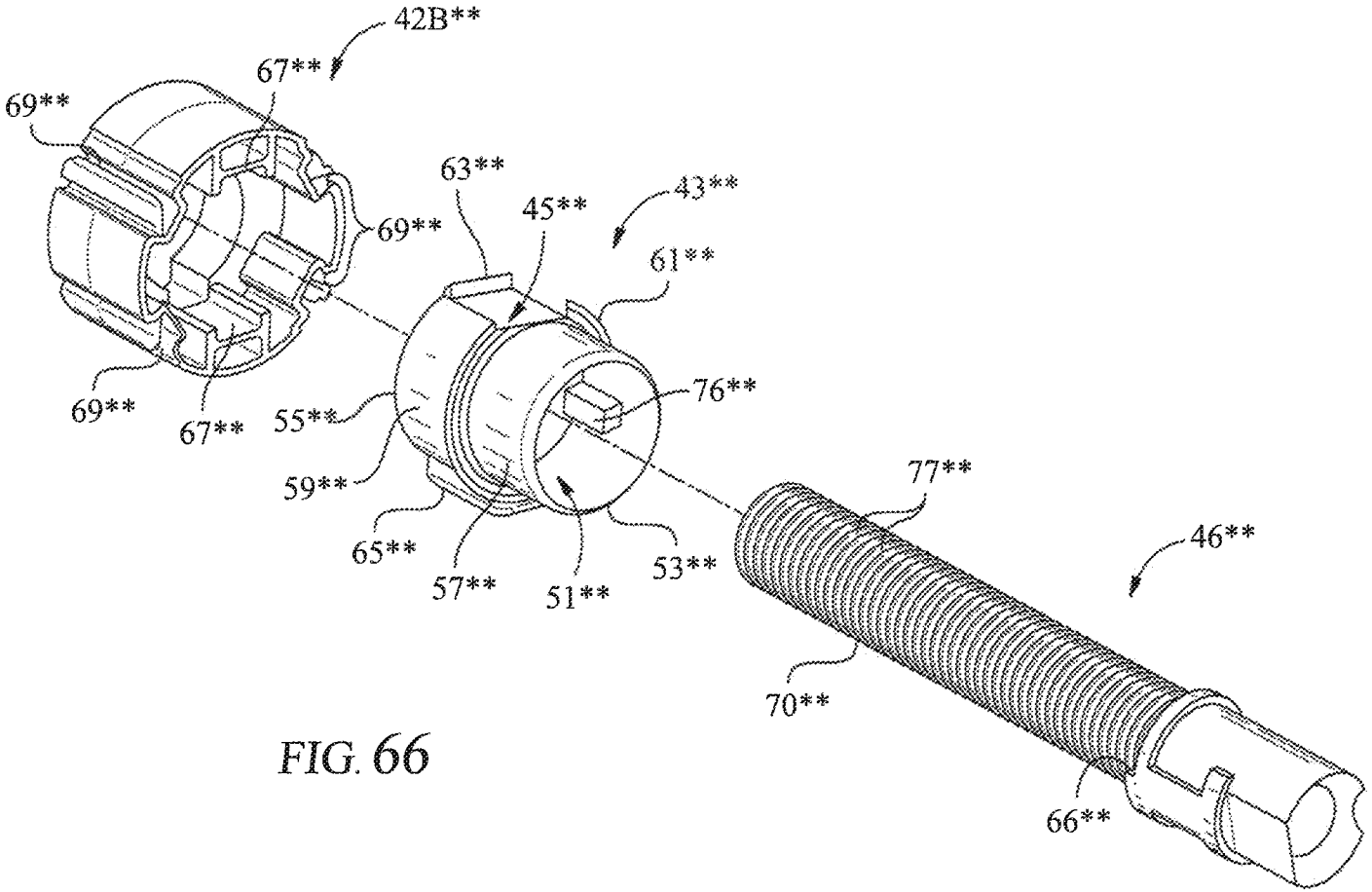
FIG. 66 illustrates a perspective view of one embodiment of a drive plug assembly suitable for use within a power assist module in accordance with aspects of the present subject matter, particularly illustrating the drive plug assembly exploded away from a corresponding drive adapter and a limiter suitable for use within a power assist module.
Figure 67:
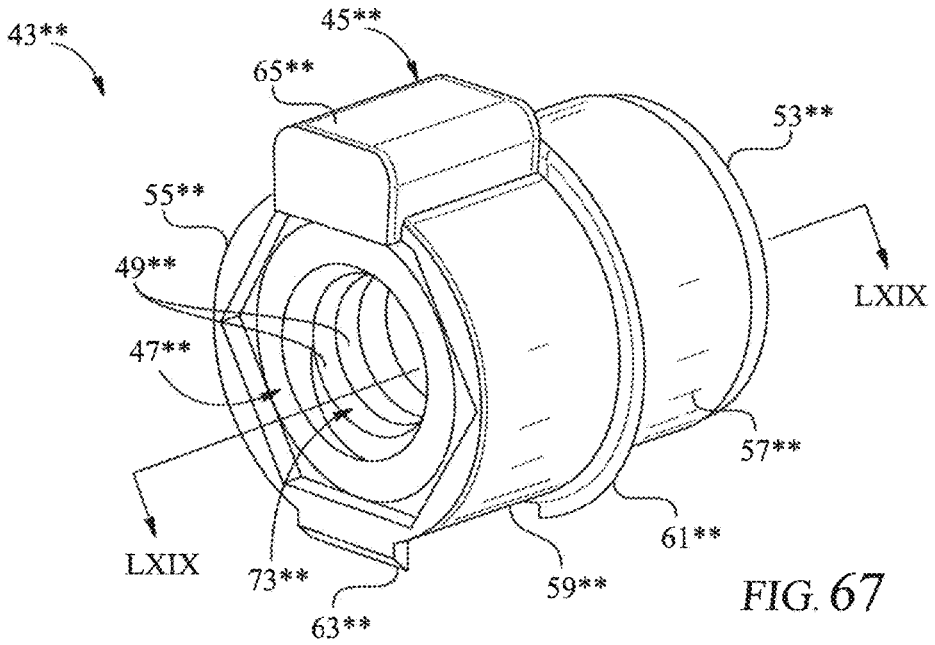
FIG. 67 illustrates another perspective view of the drive plug assembly shown in FIG. 66.
Figure 68:
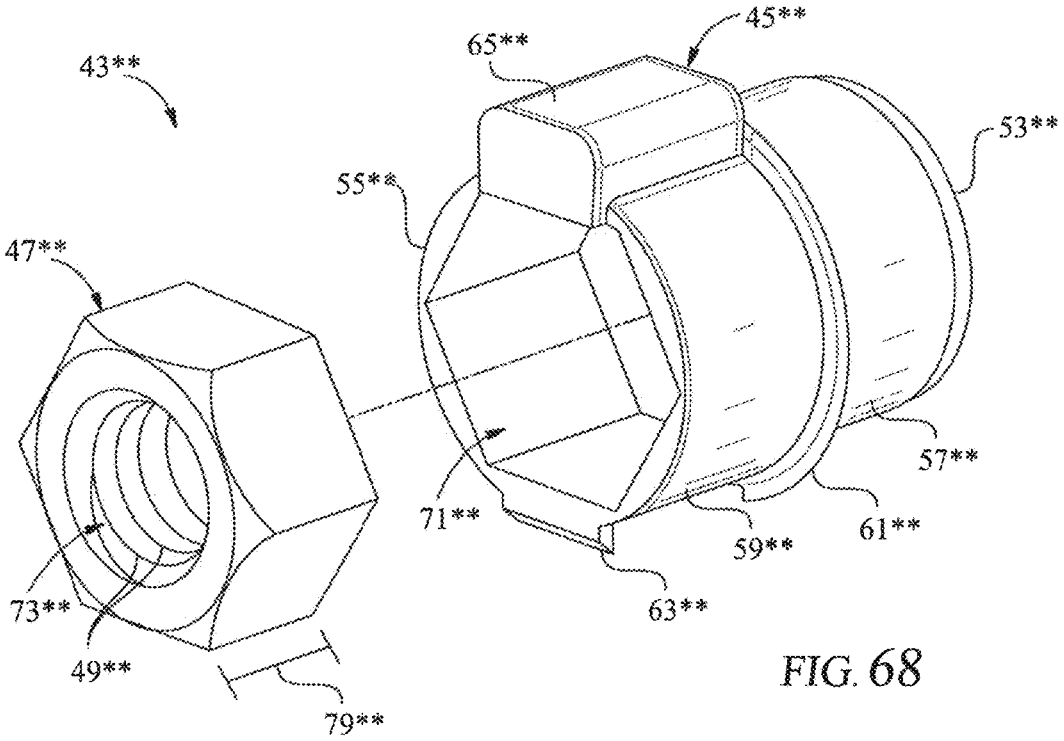
FIG. 68 illustrates an exploded, perspective view of the drive plug assembly shown in FIG. 67.
Figure 69:
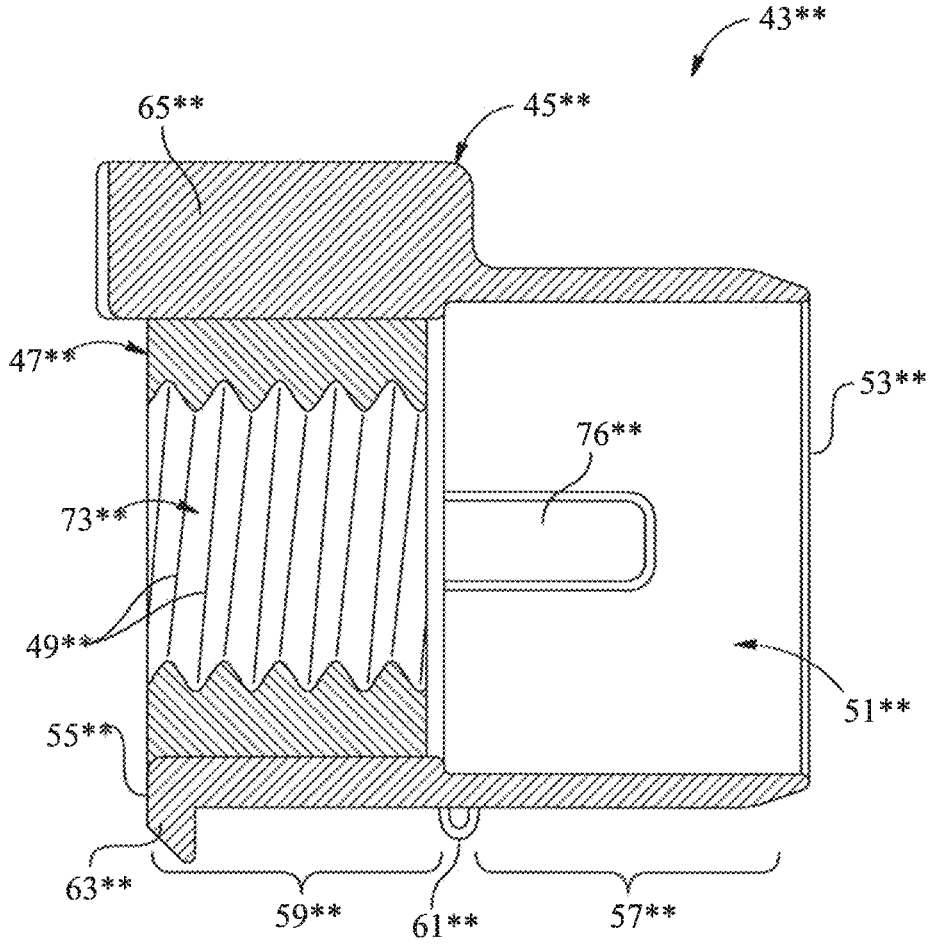
FIG. 69 illustrates a cross-sectional view of the drive plug assembly shown in FIG. 67 taken about line LXIX-LXIX.

Referring now to FIGS. 66-69, one embodiment of a drive plug assembly 43 suitable for use within a power assist module is illustrated in accordance with aspects of the present subject matter. Specifically, FIG. 66 illustrates a perspective view of the drive plug assembly 43** exploded away from both the limiter 46** (also referred to herein as the threaded shaft member) shown in FIGS. 59-61 and one embodiment of a roller tube adapter 42B suitable for use with the drive plug assembly 43**. FIGS. 67 and 68 illustrates assembled and exploded perspective views, respectively, of the drive plug assembly 43** shown in FIG. 66. Additionally, FIG. 69 illustrates a cross-sectional view of the drive plug assembly 43** shown in FIG. 67 taken about line LXIX-LXIX. It should be appreciated that, in general, the drive plug assembly 43** will be described herein with reference to the embodiment of the power assist module 12** shown in FIGS. 59-65. However, in other embodiments, various aspects of the drive plug assembly 43** shown in FIGS. 66-69** may also be incorporated into any of the other power assist modules described above.

As shown, the drive plug assembly 43 may include both a follower member 45** and a threaded insert 47** configured to be received within the follower member 45**. As will be described below, the threaded insert 45** may be configured to be installed within the follower member 45** such that a plurality of internal threads 49** (FIGS. 67-69) are provided within the follower member 45** via the threaded insert 45**, thereby allowing the follower member 45** to be readily threaded onto or relative to the associated limiter 46**. As such, when the follower member 45** is rotated relative to the limiter 46** (e.g., with rotation of the rotator rail 14), the follower member 45** may be moved axially toward and away from the mechanical stop 66** on the limiter 46** depending on the direction of rotation via the threaded engagement provided between the threaded insert 47** and the threaded portion 70** of the limiter 46****.

In general, the follower member 45 may be configured similar to the threaded follower member 44** described above with reference to FIGS. 59-65, particularly with reference to the follower member 45** incorporating aspects of the functionality of both the drive plug shafts and the drive plugs described herein. However, it should be appreciated that various aspects of the follower member 45** shown in FIGS. 66-69 may also be incorporated into any of the individual drive plug shafts described above, such as the drive plug shafts 42, 42', and 42*** configured to be utilized in connection with a separate drive plug.

In several embodiments, the follower member 45 may be a substantially cylindrical, hollow component defining a shaft opening 51** extending axially between opposed first and second axial ends 53**, 55** of the follower member 45** for receiving the threaded portion 70** of the associated limiter 46**. As shown in FIGS. 67-69, the follower member 45** may include both a first axial portion 57** and a second axial portion 59**, with the first axial portion 57** extending axially from the first end 53** of the follower member 45** to a radially extending flange 61** of the follower member 45** and the second axial portion 59** extending axially from the flange 61** to the second end 55** of the follower member 45**. As particularly shown in FIGS. 66 and 69, a shoulder or mechanical stop 76** may be provided within the first axial portion 57** of the follower member 45** that extends radially inwardly into the shaft opening 51**. Similar to the various embodiments described above including stops or shoulders, the stop 76** may be configured to engage or contact the corresponding shoulder or mechanical stop 66** on the limiter 46** in order to limit the extent to which the follower member 45** can be moved axially relative to the limiter 46**. Specifically, when the disclosed shade is moved to the fully retracted position, the stop 76** of the follower member 45** may be configured to impact or contact against the stop 66** on the limiter 46**, thereby preventing further movement (e.g., rotation) of the follower member 45** relative to the limiter 46****.

In several embodiments, given the periodic contact between the stops 66, 76** as the roller shade 10 is retracted, the follower member 45** and the limiter 46** (or at least the portions of such components forming the stops 66**, 76**) may be formed from a durable type of material(s) having suitable material properties so as to prevent damage to one or both of the stops 66**, 76** as the stops 66**, 76** repeatedly contact each other. For instance, in one embodiment, both the follower member 45** and the limiter 46** (or at least the portions of such components forming the stops 66**, 76**) may be formed from a metal material (e.g., aluminum, steel, or any other suitable metal) such that metal-on-metal contact is provided at the interface between the stops 66**, 76** when the roller shade is retracted. As a result, the component life of the follower member 45** and the limiter 46** may be significantly improved as compared to the use of a less durable material(s) for one or both of the stops 66**, 76** (e.g., when a plastic-on-metal contact interface is provided between the stops 66**, 76**). It should be appreciated that, when forming the follower member 45** and the limiter 46** from a metal material, the components may both be formed from the same metal material or from differing metal materials. For instance, in one embodiment, the follower member 45** may be formed from aluminum while the limiter 46**** may be formed from steel.

Additionally, in one embodiment, one or more radially outwardly projecting features or external ribs may be provided on the second axial portion 59 of the follower member 45**. For instance, as shown in FIGS. 67-69, the follower member 45** includes first and second radially outwardly extending ribs 63**, 65**, with the ribs 63**, 65** being spaced apart circumferentially around the second axial portion 59** of the follower member 45** by approximately 180 degrees. In one embodiment, the external ribs 63**, 65** may be configured to be received within and/or engage a corresponding feature of the associated roller tube adapter 42B. For instance, as shown in FIG. 66, the roller tube adapter 42B may define opposed slots 67** configured to receive the opposed ribs 63**, 65** of the follower member 45**. As such, when the ribs 63**, 65** of the follower member 45** are received within the slots 67** of the roller tube adapter 42B, the follower member 45** may be rotationally coupled to the roller tube adapter 42B and, thus, to the associated rotator rail 14**.

It should be appreciated that, similar to the various other adapters described herein, the roller tube adapter 42B** may be provided in various different sizes or diameters to accommodate different sized rotator rails 14. Additionally, similar to the adapters described above, the roller tube adapter 42B may include one or more recesses 69** along its outer perimeter that are configured to receive corresponding, inwardly extending projections of the rotator rail 14, thereby allowing the roller tube adapter 42B to be rotationally coupled to the rotator rail 14**.

Moreover, in several embodiments, the threaded insert 47 of the drive plug assembly 43** may be configured to be received within a portion of the shaft opening 51** defined between the axial ends 53**, 55** of the follower member 45**. For instance, as shown in FIGS. 68 and 69, the shaft opening 51** may include an enlarged section defined by the second axial portion 55** of the follower member 45** that forms an insert cavity 71** coaxially aligned with the remainder of the shaft opening 51** for receiving the threaded insert 47**. In such an embodiment, the insert cavity 71** of the follower member 45** may be shaped, sized, and/or otherwise configured to allow the threaded insert 47** to be installed or inserted within the shaft opening 51** at the second axial end 55** of the follower member 45**. For instance, in one embodiment, the insert cavity 71** may be sized and/or shape so as to correspond to or match the size and/or shape of the threaded insert 47**. Specifically, in the illustrated embodiment, the threaded insert 47** defines a hexagonal shape. In such an embodiment, as shown in FIG. 68, the insert cavity 71** may be configured to define a corresponding hexagonal shaped cavity or opening for receiving the threaded insert 47**. Additionally, in one embodiment, the insert cavity 71** may be sized such that an interference fit is defined between the follower member 45** and the threaded insert 47** when the insert 47** is installed within the insert cavity 71*, thereby ensuring that the threaded insert 47** remains rotationally engaged with the follower member 45** during operation of the associated power assist module 12**. Alternatively, the threaded insert 47** may be coupled within insert cavity 71**, such as by applying an adhesive(s) between the threaded insert 47** and the follower member 45** within the insert cavity 71***.

In several embodiments, the threaded insert 47 may correspond to any suitable component or member that defines a threaded opening 73** for receiving the threaded portion 70** of the limiter 46**. For instance, as shown in the illustrated embodiment, the threaded insert 47** corresponds to a nut defining a threaded opening 73** having a plurality of internal threads 49** configured to threadably engage the corresponding external threads 77** defined on the threaded portion 70** of the limiter 46**. As such, when the limiter 46** is inserted within the shaft opening 51** at the first axial end 53** of the follower member 45**, the threaded portion 70** of the limiter 46** may be received within the threaded opening 73** of the threaded insert 47**, thereby allowing the follower member 45** to move axially relative to the limiter 46** with rotation of the drive plug assembly 43** via the threaded connection provided between the limiter 45** and the threaded insert 47****.

Additionally, in several embodiments, the threaded insert 47 and the threaded portion 70** of the limiter 46** may be formed from dissimilar types of material such that the internal threads 49** of the threaded insert 47** are formed from a first type of material and the external threads 77** of the limiter 46** are formed from second type of material. For instance, as indicated above, in one embodiment, the limiter 46** may be formed from a metal material. In such an embodiment, the threaded insert 47** may be formed from a dissimilar or non-metal material that is selected to provide sufficient wear resistance for the internal threads 49** of the threaded insert 47** while also providing a smooth, threaded engagement between the threaded insert 47** and the limiter 46**. For example, when the limiter 46** is formed from a metal material, it may be desirable to form the threaded insert 47** from a polymer material, such as any suitable lubrous plastic material. In such an embodiment, suitable polymer materials for the threaded insert 47**** may include, but are not limited to, nylon, acetyl, polycarbonate, polyvinyl chloride, and/or the like (including any combinations thereof). In particular, suitable nylon materials may include, but are not limited to, nylon 66 and nylon ST810A.

As indicated above, in one embodiment, both the follower member 45 and the limiter 46** may both be formed from a metal material. In such an embodiment, a non-metal threaded insert 47** may be provided within the follower member 45** (e.g., as opposed to the follower member 45** including internal, integrally formed threads) to avoid a metal-on-metal threaded interface between the follower member 45** and the limiter 46**. As a result, the threaded insert 47** may provide an effective solution to the various issues associated with metal-on-metal threaded interfaces, such as durability and/or wear issues as well as sticking/friction issues. Additionally, the separate threaded insert 47** may facilitate forming the follower member 45** from a different, more durable type of material to allow the follower member 45** to exhibit increased durability, particularly at the location of its mechanical stop 76****.

Moreover, by providing a separate threaded insert 71, the insert 71** may be manufactured or formed with more internal threads 49** along an axial length 79** (FIG. 68) of its threaded opening 73** (e.g., four to five threads) as opposed to forming integral internal threads within the follower member 45** (which is often limited to only a single or partial thread due to molding limitations and/or other manufacturing issues). As a result, the threaded engagement between the limiter 46** and the threaded insert 47** may be significantly more robust as compared to embodiments utilizing a follower member 45** with an integrally formed thread (or partial thread). Specifically, the numerous internal threads 49** may allow the loads transferred between the limiter 46** and the drive plug assembly 43** to spread out amongst the internal threads 45**, thereby increasing the load carrying capability of the internal threads 45** and preventing or minimizing thread wear. Additionally, by providing numerous internal threads 49** for engagement with the threaded portion 70** of the limiter 46**, the limiter 46** may track better within the threaded insert 47**, thereby preventing axial "cocking" or displacement of the limiter 46** relative to the drive plug assembly 43****.

It should be appreciated that, as indicated above, one or more of the aspects or features of the drive plug assembly 43 may be utilized or incorporated within any of the other embodiments of the power assist modules described herein. For instance, in one embodiment, each drive plug shaft 42, 42', and 42* described above may be configured to accommodate a corresponding threaded insert or may be formed from a durable type of material along with the associated limiter 46, 46', 46* to prevent damage to the corresponding stops. Similarly, the threaded follower member 44** described above may be configured to accommodate a corresponding threaded insert or may be formed from a durable type of material along with the associated limiter 46**** to prevent damage to the corresponding stops.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A power assist module for a covering for an architectural structure, said power assist module comprising:

a spring shaft;

a spring mounted on said spring shaft;

a threaded shaft member coupled to said spring shaft said, threaded shaft member including a threaded portion defining a plurality of external threads; and a drive plug assembly coupled to said threaded shaft member for rotation relative thereto, said drive plug assembly comprising:

a follower member defining a shaft opening configured to receive said threaded shaft member; and a separate threaded insert positioned within a portion of said shaft opening of said follower member, said threaded insert defining a plurality of internal threads, said plurality of internal threads configured to threadably engage said plurality of external threads of said threaded shaft member such that said follower member is moved axially along said threaded shaft member as said drive plug assembly is rotated relative to said threaded shaft member;

wherein said internal threads of said threaded insert are formed from a dissimilar type of material than said external threads of said threaded shaft member.

2. The power assist module of claim 1, wherein:

said external threads of said threaded shaft member are formed from a metal material; and said internal threads of said threaded insert are formed from a non-metal material.

3. The power assist module of claim 2, wherein said non-metal material comprises a polymer material.

4. The power assist module of claim 3, wherein said polymer material comprises a nylon material.

5. The power assist module of claim 1, wherein:

said threaded shaft member includes a first stop;

said follower member includes a second stop;

said second stop is configured to contact said first stop when said follower member has moved axially relative to said threaded shaft member a given axial distance to prevent further rotation of said drive plug assembly relative to said threaded shaft member in a given rotational direction.

6. The power assist module of claim 5, wherein said follower member and said threaded shaft member are both formed from a metal material such that a metal-on-metal interface is defined between said follower member and said threaded shaft member when said second stop contacts said first stop.

7. The power assist module of claim 1, wherein:

said follower member extends axially between a first axial end and a second axial end; and said portion of said shaft opening forms an insert cavity at one of said first axial end or said second axial end for receiving said threaded insert within said follower member.

8. The power assist module of claim 7, wherein said insert cavity is sized such that an interference fit is defined between said follower member and said threaded insert when said threaded insert is installed within said insert cavity.

9. The power assist module of claim 1, wherein said follower member and said threaded insert are formed from dissimilar types of material.

10. The power assist module of claim 1, wherein:

said spring has a first end and a second end;

a spring plug is coupled to said first end of said spring;

said drive plug assembly further comprises a tube adapter member configured to be selectively coupled to said second end of said spring via said follower member; and said follower member is configured to be decoupled from said tube adapter member to allow said follower member to be rotated relative to said tube adapter member to adjust a spring force of said spring.

11. A power assist module for a covering for an architectural structure, said power assist module comprising:

a spring shaft;

a spring mounted on said spring shaft;

a threaded shaft member coupled to said spring shaft, said threaded shaft member including a first stop formed from a first metal material; and a drive plug assembly including a follower member and a separate threaded insert received within said follower member, said threaded insert configured to threadably engage a threaded portion of said threaded shaft member such that said follower member is moved axially along said threaded shaft member as said follower member is rotated relative to said threaded shaft member, said follower member including a second stop formed from a second metal material;

wherein said second stop is configured to contact said first stop when said follower member has moved axially relative to said threaded shaft member a given axial distance to prevent further rotation of said follower member relative to said threaded shaft member in a given rotational direction.

12. The power assist module of claim 11, wherein said first and second metal materials correspond to the same metal material or differing metal materials.

13. The power assist module of claim 11, wherein:

said threaded insert defines a plurality of internal threads along an axial length of said threaded insert;

said threaded portion of said threaded shaft member defines a plurality of external threads;

said internal threads of said threaded insert are configured to threadably engage said external threads of said threaded shaft member along said axial length of said threaded insert; and said internal threads of said threaded insert are formed from a non-metal material and said external threads of said threaded shaft member are formed from said first metal material.

14. The power assist module of claim 13, wherein said non-metal material comprises a polymer material.

15. The power assist module of claim 14, wherein said polymer material comprises at least one of nylon, acetyl, polycarbonate, polyvinyl chloride, or any combinations thereof.

16. The power assist module of claim 11, wherein:

said spring has a first end and a second end;

a spring plug is coupled to said first end of said spring;

said drive plug assembly further comprises a tube adapter member configured to be selectively coupled to said second end of said spring via said follower member; and said follower member is configured to be decoupled from said tube adapter member to allow said follower member to be rotated relative to said tube adapter member to adjust a spring force of said spring.

17. A power assist module for a covering for an architectural structure, said power assist module comprising:

a spring shaft;

a spring mounted on said spring shaft;

a threaded shaft member coupled to said spring shaft, said threaded shaft member including a first stop and defining a plurality of external threads, said first stop and said external threads being formed from at least one first metal material; and a drive plug assembly coupled to said threaded shaft member for rotation relative thereto, said drive plug assembly comprising:

a follower member defining a shaft opening configured to receive said threaded shaft member, said follower member including a second stop formed from at least one second metal material; and a separate threaded insert positioned within a portion of said shaft opening of said follower member, said threaded insert defining a plurality of internal threads formed from a polymer material, said internal threads of said threaded insert being configured to threadably engage said external threads of said threaded shaft member such that said follower member is moved axially along said threaded shaft member as said drive plug assembly is rotated relative to said threaded shaft member;

wherein said second stop is configured to contact said first stop when said follower member has moved axially relative to said threaded shaft member a given axial distance to prevent further rotation of said follower member relative to said threaded shaft member in a given rotational direction.

18. A covering for an architectural structure, said covering comprising:

a rotator tube; and a power assist module configured to be installed within said rotator tube, said power assist module comprising a spring having a first end and a second end;

a threaded shaft member extending at least partially through said spring;

a spring plug coupled to said first end of said spring;

a drive plug assembly coupled to said threaded shaft member for rotation relative thereto, said drive plug assembly comprising:

a tube adapter member coupled to said rotator tube for rotation therewith;

a follower member coupling said second end of said spring to said tube adapter, said follower member defining a shaft opening configured to receive said threaded shaft member; and a separate threaded insert positioned within a portion of said shaft opening of said follower member, said threaded insert being configured to threadably engage a threaded portion of said threaded shaft member such that said follower member is moved axially along said threaded shaft member as said drive plug assembly is rotated relative to said threaded shaft member;

wherein said follower member is configured to be rotated relative to said tube adapter member to adjust a spring force of said spring.

19. The covering of claim 18, wherein said tube adapter member is positioned within said rotator tube and is configured to engage ribs projecting inwardly from an inner surface of said rotator tube.

20. The covering of claim 18, wherein:

said threaded insert defines a plurality of internal threads along an axial length of said threaded insert;

said threaded portion of said threaded shaft member defines a plurality of external threads;

said internal threads of said threaded insert are configured to threadably engage said external threads of said threaded shaft member along said axial length of said threaded insert; and said internal threads of said threaded insert are formed from a dissimilar type of material than said external threads of said threaded shaft member.

* * * * *